US012050081B2

(12) United States Patent
Roman et al.

(10) Patent No.: US 12,050,081 B2
(45) **Date of Patent: *Jul. 30, 2024**

(54) TRUE CALIBRATION BY MATCHING RELATIVE TARGET ICON AND INDICATORS TO RELATIVE TARGET

(71) Applicants: Kendyl A. Roman, Sunnyvale, CA (US); John Livacich, Sunnyvale, CA (US)

(72) Inventors: Kendyl A. Roman, Sunnyvale, CA (US); John Livacich, Sunnyvale, CA (US)

(73) Assignee: Evrio, Inc., Santa Clara, CA (US)

( * ) Notice: Subject to any disclaimer, the term of this patent is extended or adjusted under 35 U.S.C. 154(b) by 151 days.

This patent is subject to a terminal disclaimer.

(21) Appl. No.: 17/579,568

(22) Filed: Jan. 19, 2022

(65) Prior Publication Data

US 2022/0307799 A1 Sep. 29, 2022

Related U.S. Application Data

(63) Continuation-in-part of application No. 15/150,393, filed on May 9, 2016, now Pat. No. 11,255,638, which is a continuation of application No. 14/591,950, filed on Jan. 8, 2015, now Pat. No. 9,335,120, which is a continuation-in-part of (Continued)

(51) Int. Cl.

| | |
|---|---|
| ***F41G 1/473*** | (2006.01) |
| ***F41G 1/467*** | (2006.01) |
| ***F41G 3/06*** | (2006.01) |
| ***F41G 3/08*** | (2006.01) |
| ***F41G 3/16*** | (2006.01) |
| *F41G 3/14* | (2006.01) |

(52) U.S. Cl.

CPC ..... *F41G 1/473* (2013.01); *F41G 1/467* (2013.01); *F41G 3/06* (2013.01); *F41G 3/08* (2013.01); *F41G 3/165* (2013.01); *F41G 3/142* (2013.01)

(58) Field of Classification Search

CPC ... F41G 1/38; F41G 1/44; F41G 1/467; F41G 1/473; F41G 3/06; F41G 3/08; F41G 3/142; F41G 3/165; F41G 3/323

See application file for complete search history.

(56) References Cited

U.S. PATENT DOCUMENTS

2001/0055095 A1* 12/2001 D'Souza ..... A61B 3/107 351/212
2002/0191282 A1* 12/2002 Edwards ..... F41G 1/38 359/405

(Continued)

*Primary Examiner* — Thien M Le

(57) ABSTRACT

An improved display provides a relative aiming point indicated in relation to a relative target icon or user selectable target reference image. A range finding device is calibrated, using a relative target, to a specific firing device having a sight, for example, a rifle having a riflescope calibrated at 100 yards, or a bow having a bow sight calibrated with a 20-yard pin. The user places the riflescope cross hairs on the point visualized in the display relative to the relative target icon. In bow mode, user places a bow sight pin, for example, the 20-yard pin, on the point visualized in the display relative to the relative target icon. The relative aiming point is separate and distinct from an absolute aiming point that may be visualized in the display relative to the visual image of the target.

20 Claims, 51 Drawing Sheets

Related U.S. Application Data application No. 14/471,786, filed on Aug. 28, 2014, now Pat. No. 9,057,587.

(56) References Cited

U.S. PATENT DOCUMENTS

| | | | | |
|---|---|---|---|---|
| 2005/0021282 | A1* | 1/2005 | Sammut | F41G 1/473 702/181 |
| 2009/0235570 | A1* | 9/2009 | Sammut | G02B 27/32 235/404 |
| 2011/0132983 | A1* | 6/2011 | Sammut | F41G 1/38 235/404 |
| 2014/0059915 | A1* | 3/2014 | Sammut | F41G 3/00 42/122 |
| 2019/0376755 | A1* | 12/2019 | Teetzel | A61F 11/14 |
| 2020/0232762 | A1* | 7/2020 | Hamilton | G02B 23/16 |
| 2020/0232764 | A1* | 7/2020 | Macdonald | F41G 1/467 |
| 2021/0033370 | A1* | 2/2021 | Hodnett | F41G 1/38 |
| 2021/0199784 | A1* | 7/2021 | Ashjaee | G01S 17/42 |

* cited by examiner

TRUE CALIBRATION BY MATCHING RELATIVE TARGET ICON AND INDICATORS TO RELATIVE TARGET

RELATED APPLICATIONS

This application is a continuation-in-part of U.S. patent application Ser. No. 15/150,393, which was a continuation of U.S. patent application Ser. No. 14/591,950, now U.S. Pat. No. 9,335,120.

U.S. patent application Ser. No. 15/461,436, exception for purposes of continuity, was filed Mar. 16, 2017, and contains the same subject matter.

U.S. patent application Ser. No. 14/591,950 is a continuation-in-part of U.S. patent application Ser. No. 14/471,786, which was filed on Aug. 28, 2014, now U.S. Pat. No. 9,057,587.

U.S. patent application Ser. Nos. 15/150,393, 14/591,950 and 14/471,786 are included herein by reference.

This application claims priority based on U.S. patent application Ser. Nos. 15/150,393, 14/591,950, 14/471,786, and 15/461,436.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

Field of the Invention

The present invention relates to calibration of a handheld rangefinder to match the ballistics of a specific firing device, such as a bow, pistol, or rifle, with specific projectiles using a relative target and relative target icon.

Description of Prior Art

Bows and arrows, spears, crossbows, guns, and artillery have been used for sport, hunting, and military.

An arrow is typically shot using the arms to pull back the bow string, and to aim and sight by holding the bow and arrow next to the archer's eye. More recently bow sights have been added to all types of bows. Typically a bow sight comprises a plurality of pins that may be adjusted by the archer for aiming at targets at different distances. Some bow sights have a single adjustable pin that is moved to the match the distance to the target.

Balls and/or bullets are typically shot from a gun using the arms to aim and sight by aligning the gun sights or gun scope reticle with the target.

Artillery balls and shells are typically shot by adjusting the aim mechanically.

Arrows, spears, balls, bullets, and shells when fired follow a ballistic trajectory. Such projectiles, which are not self-propelled, move through air according to a generally parabolic (ballistic) curve due primarily to the effects of gravity and air drag.

Rifle and bow scopes conventionally have been fitted with reticles of different forms. Some have horizontal and vertical cross hairs. Others reticles such as mil-dot add evenly spaced dots for elevation and windage along the cross hairs. U.S. Design Patent D522,030, issued on May 30, 2006, shows a SR reticle and graticle design for a scope. Various reticles, such as Multi Aim Point (MAP) and Dot are provided, for example, by Hawke Optics (http://hawkeoptics.com). These reticles are fixed in that the display does not change based on range information. Also, these reticles indicate the approximate hold-over position in that they are positioned under the center of the scope, i.e. below where the cross hairs intersect. They are not necessarily precise, for example, for a specific bow and archer or for a specific rifle and ammunition, but are approximation for the general case.

Hunters and other firearm and bow users commonly utilize handheld rangefinders (see device 10 in FIG. 2) to determine ranges to targets. Generally, handheld rangefinders utilize lasers to acquire ranges for display to a hunter. Utilizing the displayed ranges, the hunter makes sighting corrections to facilitate accurate shooting.

For example, U.S. Pat. No. 7,658,031, issued Feb. 9, 2010, discloses handheld rangefinder technology from Bushnell, Inc, and is hereby included by reference. As shown in FIG. 1, a handheld rangefinder device 10 generally includes a range sensor 12 operable to determine a first range to a target, a tilt sensor 14 operable to determine an angle to the target relative to the device 10, and a computing element 16, coupled with the range sensor 12 and the tilt sensor 14, operable to determine a hold over value based on the first range and the determined angle. The range information is displayed on a display 30. A housing 20 contains the elements of the device 10. Bushnell Angle Range Compensation (ARC) rangefinders show the first linear range to the target and also show an angle and a second range, which represents the horizontal distance to the target. Handheld rangefinders, telescope sights, and other optical devices typically comprise a laser range sensor and an inclinometer.

The range information is superimposed over the image that is seen through the optics. For example, U.S. Design Patent D453,301, issued Feb. 5, 2002, shows an example of a design for a display for a Bushnell rangefinder, and is hereby included by reference. FIG. 2 shows an exemplary display 30 appearing in a handheld rangefinder device 10.

With convention rangefinder and a rifle there is no correlation between the display of the rangefinder and the user's individual rifle sight or scope. To make an effective shot requires several steps. All of the movement and time taken during these steps will likely be noticed by the target and allow the target an opportunity to move resulting in having to repeat the process or miss the shot altogether.

Further in order to show an accurate aiming point a rangefinder needs to be calibrated to a specific bow and rifle or other firearm.

What is needed is an improved display that provides a relative aiming point relative to a reference with a predetermined size or height, so the user can visualize where to aim.

SUMMARY OF THE INVENTION

The present invention solves the above-described problems and provides a distinct advance in the art of rangefinder display. More particularly, the invention provides a display that provides a relative aiming point relative to a reference with a predetermined size or height, so the user can visualize where to aim. Such information facilitates accurate, effective, and safe firearm use.

In multiple embodiments, a display provides a relative aiming point that is display relative to a reference that shows the relative target size.

In some embodiments of a display with relative aiming point, the reference is a relative target icon.

In some embodiments of a display with relative aiming point, the reference is a reference image.

In some embodiments of a display with relative aiming point, the reference is a reference indicator, shown as reference lines.

In some embodiments of a display with relative aiming point, the display further comprises reference multiples.

In some embodiments of a display with relative aiming point, the reference is a user selectable image.

In some embodiments of a display with relative aiming point, the reference is a generic reference image.

In some embodiments of a display with relative aiming point, the reference is an enlarged target reference.

In some embodiments of a display with relative aiming point, the reference is a zoomed target image.

Accordingly, it is an objective of the present invention to provide a display that includes a relative target icon that is aligned to a relative target and is used to calibrate to any bow and arrow or other firearm.

Other aspects and advantages of the present invention will be apparent from the following detailed description of the preferred embodiments and the accompanying drawing figures.

Objects and Advantages

Accordingly, the present invention includes the following advantages:

a) To provide a display that provides a relative aiming point.
b) To provide a display that provides a relative target icon.
c) To provide a relative target icon in the display of range finding device that can be used to calibrate the range finding device to the ballistic curve for a specific firing device and specific projectile, such as a specific bow and arrow and a specific rifle and ammunition.
d) To provide a universal calibration method for any range finding device.
e) To provide a display that provides a relative aiming point relative to a reference target point.
f) To provide a display that provides a relative aiming point relative to an enlarged actual image.
g) To provide a display that provides a relative aiming point relative to a reference image.
h) To provide a display that provides a relative aiming point relative to a reference indicator.
i) To provide a display that provides a relative aiming point relative to a reference indicator and reference multiples.
j) To provide a display that provides a relative aiming point relative to a generic reference.
k) To provide a display that provides dynamic information regarding a projectile trajectory.
l) To provide a rangefinder display having variable focal range (or zoom) with automatically adjusting indications of a virtual aiming point.
m) To provide an improved rangefinder which enable the user to visualize the projectile's trajectory creating confidence of a clear and safe shot.
n) To provide a digital display of a relative aiming point.
o) To provide a digital display of a relative aiming point and zoom control.
p) To provide an improved display of line of sight distance, horizontal distance, and angle.
q) To provide a relative target that can be used to determine the ballistic curve for a specific firing device and projectile, such as a specific bow and arrow and a specific rifle and ammunition.

DRAWING FIGURES

A preferred embodiment of the present invention is described in detail below with reference to the attached drawing figures, wherein.

Figure 1:
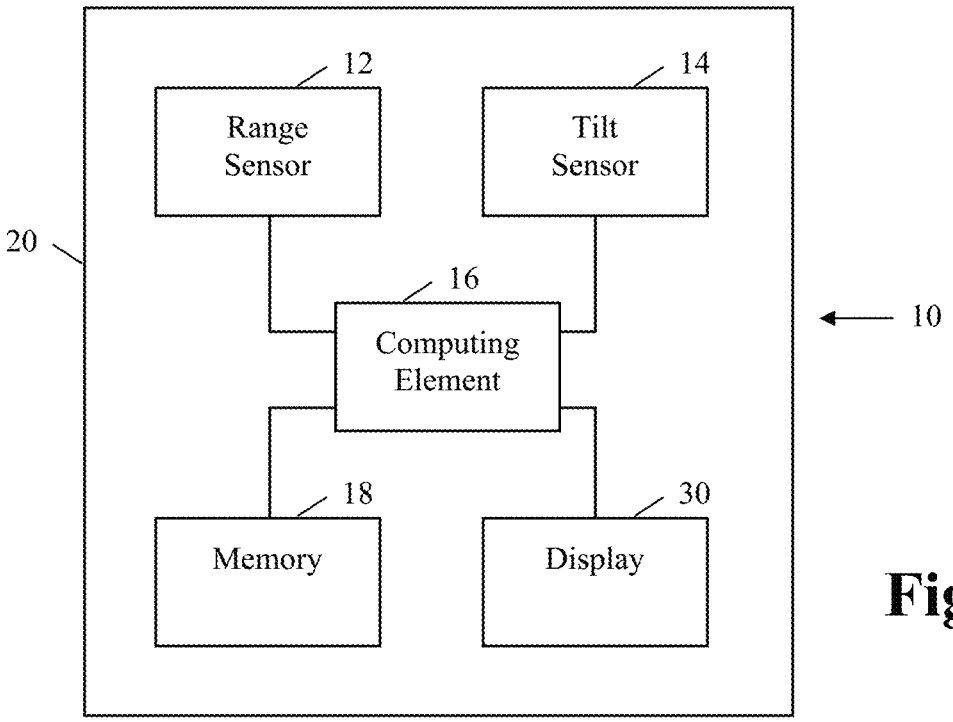
FIG. 1 is a block diagram of a rangefinder device.

FIGS. 21A through 21D illustrate the steps of the relative target preparation process with a specific rifle and specific ammunition; and FIGS. 22A through 22F show the rifle ballistic calibration process used to calibrate the device. The drawing figures do not limit the present invention to the specific embodiments disclosed and described herein. The drawings are not necessarily to scale, emphasis instead being placed upon clearly illustrating the principles of the invention.

| REFERENCE NUMERALS IN DRAWINGS | |
|---|---|
| 1 a-c | line of departure |
| 2 a-c | projectile trajectory |
| 3 a-c | line of sight |
| 4 | horizontal line |
| 10 | device |
| 11 | iPhone |
| 12 | range sensor |
| 14 | tilt sensor |
| 16 | computing element |
| 18 | memory |
| 20 | housing |
| 21 | alternate housing |
| 22 | eyepiece |
| 23 | housing slot |
| 24 | lens |
| 25 | digital camera |
| 26 | distal end |
| 27 | handle |
| 28 | proximate end |
| 30 | display |
| 31 | high-resolution display |
| 32 | inputs |
| 34 a-b | dipaly inputs |
| 35 | visor or shroud |
| 100 | archer or user |
| 102 | bow |
| 104 | arrow |
| 110 | bow sight |
| 198 | calibration instructions |
| 220 | twenty-yard pin |
| 240 | forty-yard pin |
| 260 | sixty-yard pin |
| 300 | rifle |
| 900 | cross hairs |
| 910 | distance indicator |
| 912 | angle indicator |
| 914 | horizontal distance indicator |
| 920 | twenty-yard indicator |
| 930 | (selectable) path indicators |
| 932 | off screen indicator |
| 940 | forty-yard indicator |
| 950 | clear shot indicator |
| 960 | don't shoot indicator |
| 970 | not clear indicator |
| 982 | absolute aiming point |
| 990 | second numerical indicator |
| 992 | bow mode indicator |
| 994 | rifle mode indicator |
| 996 | trajectory mode indicator |
| 1000 | relative aiming point |
| 1002 | reference image |
| 1004 | reference target |
| 1005 | generic reference |
| 1006 | reference indicator |
| 1007 a-c | reference multiple |
| 1008 | separator |
| 1010 | aiming point indicators |
| 1012 | too high indicator |
| 1014 | too low indicator |
| 1020 | enlarged target image |
| 1022 | reference measurement |
| 1030 | zoom control |
| 1032 | settings control |
| 1034 | settings |
| 1042 | sight in indicator |
| 1044 | distance text |
| 1046 | drop text |

-continued

| REFERENCE NUMERALS IN DRAWINGS | |
|---|---|
| 1048 | target type indicators |
| 1050 | setup indicator |
| 1052 | antelope reference image |
| 1054 | deer reference image |
| 1100 | relative target |
| 1102 | target center |
| 1110 a-d | concentric square |
| 1112 | scale |
| 1120 a-b | relative target icon |
| 1130 a-b | shot mark |
| T | target |

DESCRIPTION OF THE INVENTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Projectile Trajectories

Figure 3A:
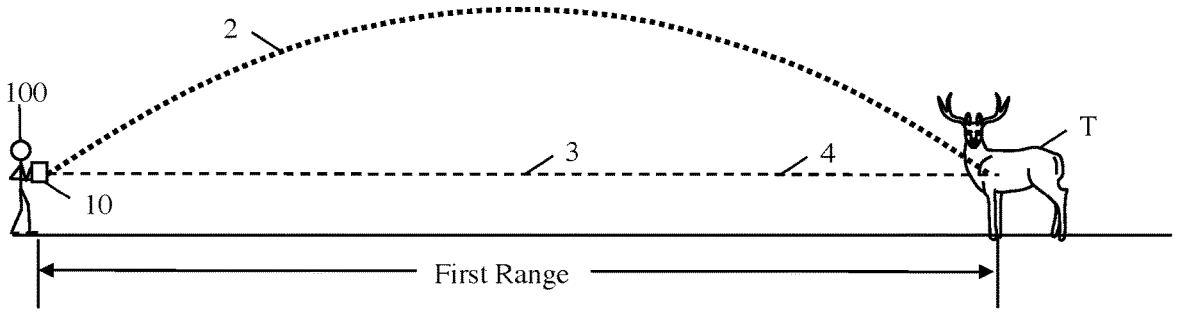
FIG. 3A is a diagram illustrating a first range to a target and an associated projectile trajectory.

FIG. 3A is a diagram illustrating a first range to a target T and an associated projectile trajectory 2. The rangefinder device 10 is show level such and the associated projectile trajectory leaves the firing device and enters the target at substantially the same true elevation (horizontal line 4).

The first range preferably represents a length of an imaginary line drawn between the device 10 and the target T, as shown in FIG. 3A, such as the number of feet, meters, yards, miles, etc., directly between the device 10 and the target T. Thus, the first range may correspond to a line of sight 3 between the device 10 and the target T.

Figure 3B:
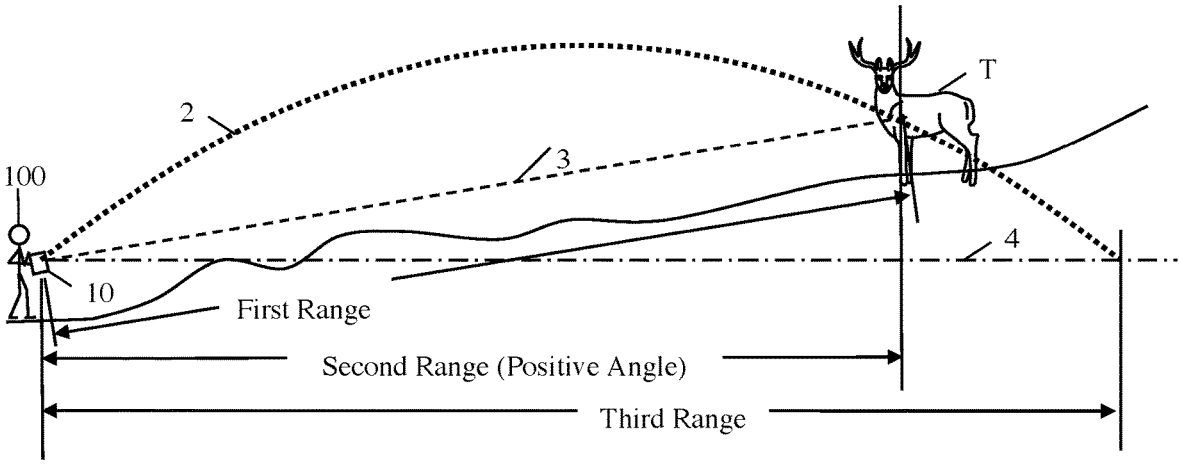
FIG. 3B is a diagram illustrating a second range and an associated projectile trajectory to the target of FIG. 3A when the target is elevated, i.e. at a positive angle.

FIG. 3B is a diagram illustrating a second range and an associated projectile trajectory 2 to the target T when the target T is elevated, i.e. is at a positive angle. The first range is the sensed range along the line of sight 3. The second range is the true horizontal distance to the target T, as measured along the horizontal line 4. A third range is the true horizontal distance, as measured along the horizontal line 4, to the projectile trajectory 2 intercept. Half of the third range is the x-axis distance to the vertex V of the projectile trajectory 2. The second range is determined by multiplying the first range by the cosine of the angle.

Figure 3C:
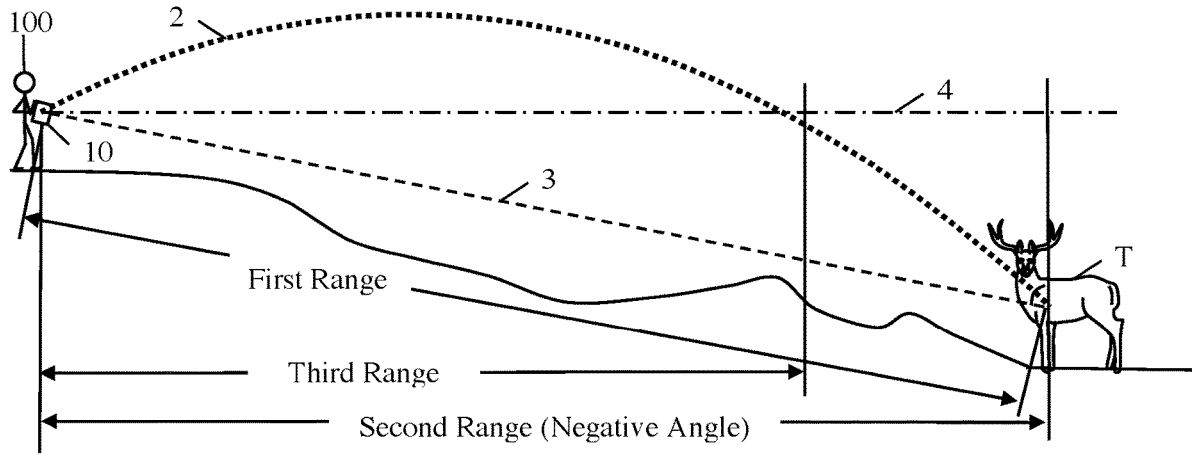
FIG. 3C is a diagram illustrating a second range and an associated projectile trajectory to the target when the target is at a lower elevation, i.e. at negative angle.

FIG. 3C is a diagram illustrating a second range and an associated projectile trajectory 2 to the target T when the target T is at a lower elevation, i.e. is at a negative angle. The first range is the sensed range along the line of sight 3. The second range is the true horizontal distance to the target T, as measured along the horizontal line 4. The third range is the true horizontal distance, as measured along the horizontal line 4, to the projectile trajectory 2 intercept. Half of the third range is the x-axis distance to the vertex V of the projectile trajectory 2.

In situations where the angle is non-zero, such as when the target T is positioned above (FIG. 3B) or below (FIG. 3C) the device 10, the parabolic movement of the projectile affects the range calculation, such that the projectile may have to travel a longer or shorter distance to reach the target T. Thus, the second range provides an accurate representation to the user of the flat-ground distance the projectile must travel to intersect the target T.

FIGS. 3A through 3C are shown with an exemplary projectile trajectory 2 based on a parabola with an A value of −0.005.

Aiming Point Displays

Figure 4:
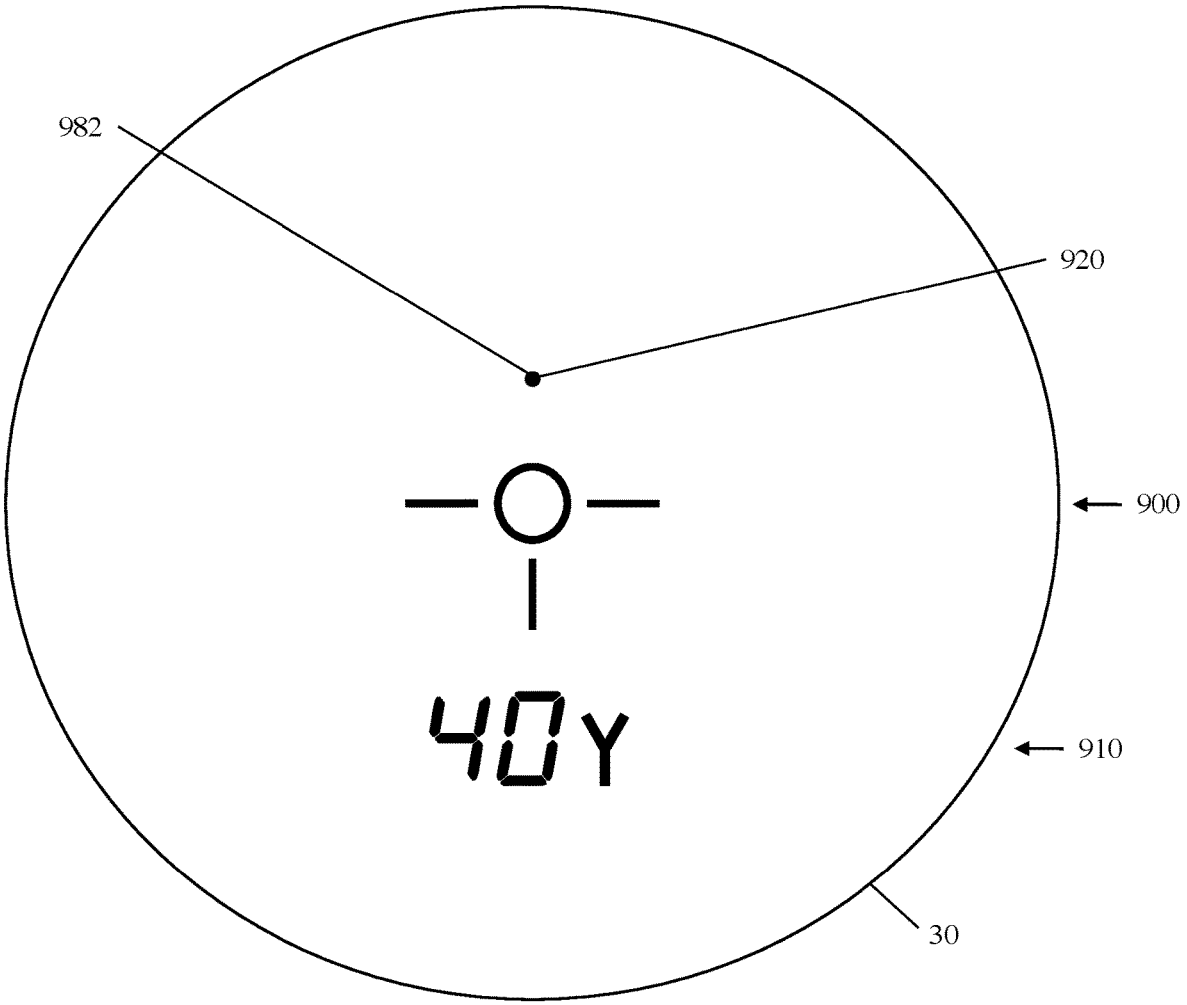
FIG. 4 illustrates a display having an aiming point.

FIG. 4 shows the active display elements when the target T (not shown for clarity) is ranged at forty yards. The display 30 shows the cross hairs 900 (show here with a center circle) which are placed on the target T. The display 30 dynamically shows that the range is forty yards in the distance indicator 910. The display 30 also dynamically illuminates a twenty-yard indicator 920. The twenty-yard indicator 920 informs the user where the projectile will be at twenty yards distance. Because the twenty-yard indicator 920 shows an intermediate trajectory path point where the arrow will be at twenty yards distance, the twenty-yard indicator 920 is a twenty-yard pin aiming point 982. A bow hunter can place the twenty-yard pin 220 of the bow sight 110 on the same visual spot indicated, for example as shown in FIG. 4, and the arrow will hit the target T at the cross hairs 900.

In this case the aiming point 982 is an absolute aiming point being displayed in relation to the actual visual image of the target T. Compare this to a relative aiming point 1000 as discussed, for example, in relation to FIGS. 8A through 8F, where the separate and distinct relative aiming point 1000 is displayed in relation to a separate and distinct reference image 1002, such as deer reference image 1054 shown in FIG. 8A or the relative target icon 1120 shown in FIG. 8F.

In the figures the symbols used for the various indicators are exemplary and other shapes or styles of indicators could be used. For example, the cross hairs 900 are shown with a center circle, but other styles such as intersecting lines, a solid center dot, and so forth could be used. Also the distance indicator 910 is shown having using seven segments for the digits, but other shapes of styles could be used. Positions are also exemplary.

The examples herein generally use yards as the unit of measure. The invention is not limited to yards, but could also be set using feet, meters, kilometers, miles, and so forth.

In some bow embodiments the display 30 or device 10 is calibrated such that the location of the twenty-yard indicator 920 matches the relative position of the twenty-yard pin 220 on the individual user's bow and bow sight 110.

Rangefinder Device

Figure 2:
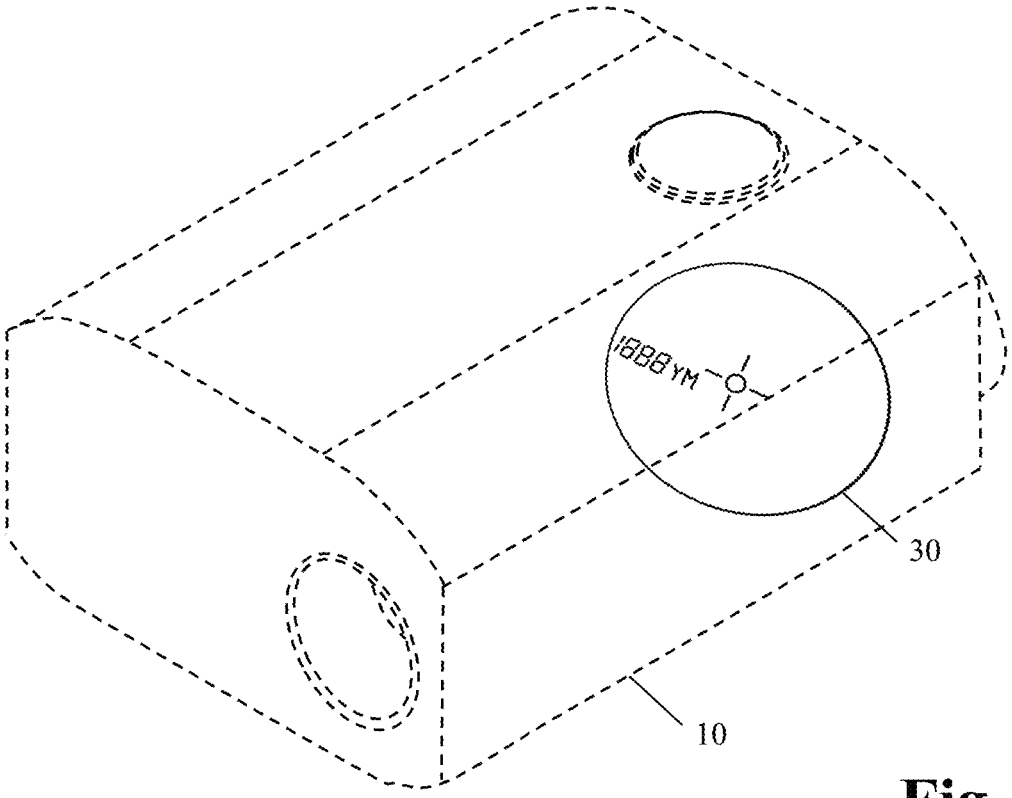
FIG. 2 shows the appearance of an exemplary display within a device.

FIG. 2 is a rear perspective view of an exemplary range finding device 10, shown as a handheld laser rangefinder. FIG. 1 shows the internal components.

For instance, the user may look through the eyepiece 22, align the target T, view the target T, and generally simultaneously view the display 30 to determine the first range, the angle, the clear shot indications, and/or other relevant information. The generally simultaneous viewing of the target T and the relevant information enables the user to quickly and easily determine ranges and ballistic information corresponding to various targets by moving the device 10 in an appropriate direction and dynamically viewing the change in the relevant information on the display 30.

The portable handheld housing 20 houses the range sensor 12, tilt sensor 14, computing element 16, and/or other desired elements such as the display 30, one or more inputs 32, eyepiece 22, lens 24, laser emitter, laser detector, etc. The handheld housing 20 enables the device 10 be easily and safely transported and maneuvered for convenient use in a variety of locations.

For example, the portable handheld housing 20 may be easily transported in a backpack for use in the field. Additionally, the location of the components on or within the housing 20, such as the position of the eyepiece 22 on the proximate end 28 of the device 10, the position of the lens 24 on the distal end 26 of the device, and the location of the inputs 32, enables the device 10 to be easily and quickly operated by the user with one hand without a great expenditure of time or effort.

As discussed in reference to FIG. 3, generally a rangefinder device 10 generally includes a range sensor 12 for determining a first range to a target T, a tilt sensor 14 for determining an angle to the target T, a computing element 16 coupled with the range sensor 12 and the tilt sensor 14 for determining ballistic information relating to the target T based on the first range and the determined angle, a memory 18 for storing data such as ballistic information and a computer program to control the functionality of the device 10, and a portable handheld housing 20 for housing the range sensor 12, the tilt sensor 14, the computing element 16, the memory 18, and other components.

A computer program preferably controls input and operation of the device 10. The computer program includes at least one code segment stored in or on a computer-readable medium residing on or accessible by the device 10 for instructing the range sensor 12, tilt sensor 14, computing element 16, and any other related components to operate in the manner described herein. The computer program is preferably stored within the memory 18 and comprises an ordered listing of executable instructions for implementing logical functions in the device 10. However, the computer program may comprise programs and methods for implementing functions in the device 10 which are not an ordered listing, such as hard-wired electronic components, programmable logic such as field-programmable gate arrays (FPGAs), application specific integrated circuits, conventional methods for controlling the operation of electrical or other computing devices, etc.

Similarly, the computer program may be embodied in any computer-readable medium for use by or in connection with an instruction execution system, apparatus, or device, such as a computer-based system, processor-containing system, or other system that can fetch the instructions from the instruction execution system, apparatus, or device, and execute the instructions.

The device 10 and computer programs described herein are merely examples of a device and programs that may be used to implement the present invention and may be replaced with other devices and programs without departing from the scope of the present invention.

The range sensor 12 may be any conventional sensor or device for determining range. The first range may correspond to a line of sight 3 between the device 10 and the target T. Preferably, the range sensor 12 is a laser range sensor which determines the first range to the target by directing a laser beam at the target T, detecting a reflection of the laser beam, measuring the time required for the laser beam to reach the target and return to the range sensor 12, and calculating the first range of the target T from the range sensor 12 based on the measured time.

The range sensor 12 may alternatively or additionally include other range sensing components, such as conventional optical, radio, sonar, or visual range sensing devices to determine the first range in a substantially conventional manner.

The tilt sensor 14 is operable to determine the angle to the target T from the device 10 relative to the horizontal. As discussed in reference to FIGS. 3A, 3B, and 3C, the tilt sensor is used to determine the angle of the line of sight 3. The tilt sensor 14 preferably determines the angle by sensing the orientation of the device 10 relative to the target T and the horizontal.

The tilt sensor 14 preferably determines the angle by sensing the orientation of the device 10 relative to the target T and the horizontal as a user 100 of the device 10 aligns the device 10 with the target T and views the target T through an eyepiece 22 and an opposed lens 24.

For example, if the target T is above the device 10 (e.g. FIG. 3B), the user of the device 10 would tilt the device 10 such that a distal end 26 of the device 10 would be raised relative to a proximate end 28 of the device 10 and the horizontal. Similarly, if the target T is below the device 10 (e.g. FIG. 3C), the user of the device 10 would tilt the device 10 such that the distal end 26 of the device 10 would be lowered relative to the proximate end 28 of the device and the horizontal.

The tilt sensor 14 preferably determines the angle of the target to the device 10 based on the amount of tilt, that is the amount the proximate end 28 is raised or lowered relative to the distal end 26, as described below. The tilt sensor 14 may determine the tilt of the device, and thus the angle, through various orientation determining elements. For instance, the tilt sensor 14 may utilize one or more single-axis or multiple-axis magnetic tilt sensors to detect the strength of a magnetic field around the device 10 or tilt sensor 14 and then determine the tilt of the device 10 and the angle accordingly. The tilt sensor 14 may determine the tilt of the device using other or additional conventional orientation determine elements, including mechanical, chemical, gyroscopic, and/or electronic elements, such as a resistive potentiometer.

Preferably, the tilt sensor 14 is an electronic inclinometer, such as a clinometer, operable to determine both the incline and decline of the device 10 such that the angle may be determined based on the amount of incline or decline. Thus, as the device 10 is aligned with the target T by the user, and the device 10 is tilted such that its proximate end 28 is higher or lower than its distal end 26, the tilt sensor 14 will detect the amount of tilt which is indicative of the angle.

The computing element 16 is coupled with the range sensor 12 and the tilt sensor 14 to determine ballistic information relating to the target T, including clear shot information, as is discussed herein. The computing element 16 may be a microprocessor, microcontroller, or other electrical element or combination of elements, such as a single integrated circuit housed in a single package, multiple integrated circuits housed in single or multiple packages, or any other combination. Similarly, the computing element 16 may be any element that is operable to determine clear shot information from the range and angle information as well as other information as described herein. Thus, the computing element 16 is not limited to conventional microprocessor or microcontroller elements and may include any element that is operable to perform the functions described.

The memory 18 is coupled with the computing element 16 and is operable to store the computer program and a database including ranges, projectile drop values, and configuration information. The memory 18 may be, for example, an electronic, magnetic, optical, electromagnetic, infrared, or semi-conductor system, apparatus, device, or propagation medium.

The device 10 also includes a display 30 to indicate relevant information such as the cross hairs 900, distance indicator 910, selectable path indicators 930, clear shot indicator 950, don't shoot indicator 960, not clear indicator 970. The display 30 may be a conventional electronic display, such as a LED, TFT, or LCD display. Preferably, the display 30 is viewed by looking through the eyepiece 22 such that the user may align the target T and simultaneously view relevant information. The illuminated segments may be parallel to the optical path (e.g. horizontal) between the eyepiece 22 and the opposed lens 24 and reflect to a piece of angled glass in the optical path.

The inputs 32 are coupled with the computing element 16 to enable users or other devices to share information with the device 10. The inputs 32 are preferably positioned on the housing 20 to enable the user to simultaneously view the display 30 through the eyepiece 22 and function the inputs 32.

The inputs 32 preferably comprise one or more functionable inputs such as buttons, switches, scroll wheels, etc., a touch screen associated with the display 30, voice recognition elements, pointing devices such as mice, touchpads, trackballs, styluses, combinations thereof, etc. Further, the inputs 32 may comprise wired or wireless data transfer elements.

In operation, the user aligns the device 10 with the target T and views the target T on the display 30. The device 10 may provide generally conventional optical functionality, such as magnification or other optical modification, by utilizing the lens 24 and/or the computing element 16. Preferably, the device 10 provides an increased field of vision as compared to conventional riflescopes to facilitate conventional rangefinding functionality. The focal magnification typically is 4×, 5×, 6×, 7×, 12× and so forth. In some embodiments the magnification factor is variable, such as with a zoom feature. This magnification value is used by the computing element 16 in performing the mapping of the various indicators on the optical image.

Further, the user may function the inputs 32 to control the operation of the device 10. For example, the user may activate the device 10, provide configuration information as discussed below, and/or determine a first range, a second range, angle, and ballistic information by functioning one or more of the inputs 32.

For instance, the user may align the target T by centering the reticle over the target T and functioning at least one of the inputs 32 to cause the range sensor 12 to determine the first range. Alternatively, the range sensor 12 may dynamically determine the first range for all aligned objects such that the user is not required to function the inputs 32 to determine the first range. Similarly, the tilt sensor 14 may dynamically determine the angle for all aligned objects or the tilt sensor may determine the angle when the user functions at least one of the inputs 32. Thus, the clear shot information discussed herein may be dynamically displayed to the user.

In various embodiments, the device 10 enables the user to provide configuration information. The configuration information includes mode information to enable the user to select between various projectile modes, such as bow hunting and firearm modes. Further, the configuration information may include projectile information, such as a bullet size, caliber, grain, shape, type, etc. and firearm caliber, size, type, sight-in distance, etc. The user may provide the configuration information to the device 10 by functioning the inputs 32.

Further, the memory 18 may include information corresponding to configuration information to enable the user-provided configuration information to be stored by the memory 18.

In various embodiments, the device 10 is operable to determine a second range to the target T and display an indication of the second range to the user. The computing element 16 determines the second range to the target T by adjusting the first range based upon the angle. Preferably, the computing element 16 determines the second range by multiplying the first range by the sine or cosine of the angle. For instance, when the hunter is positioned above the target, the first range is multiplied by the sine of the angle to determine the second range. When the hunter is positioned below the target, the first range is multiplied by the cosine of the angle to determine the second range.

Thus, the second range preferably represents a horizontal distance the projectile must travel such that the estimated trajectory of the projectile generally intersects with the target T.

High-Resolution Digital Display

Figure 5:
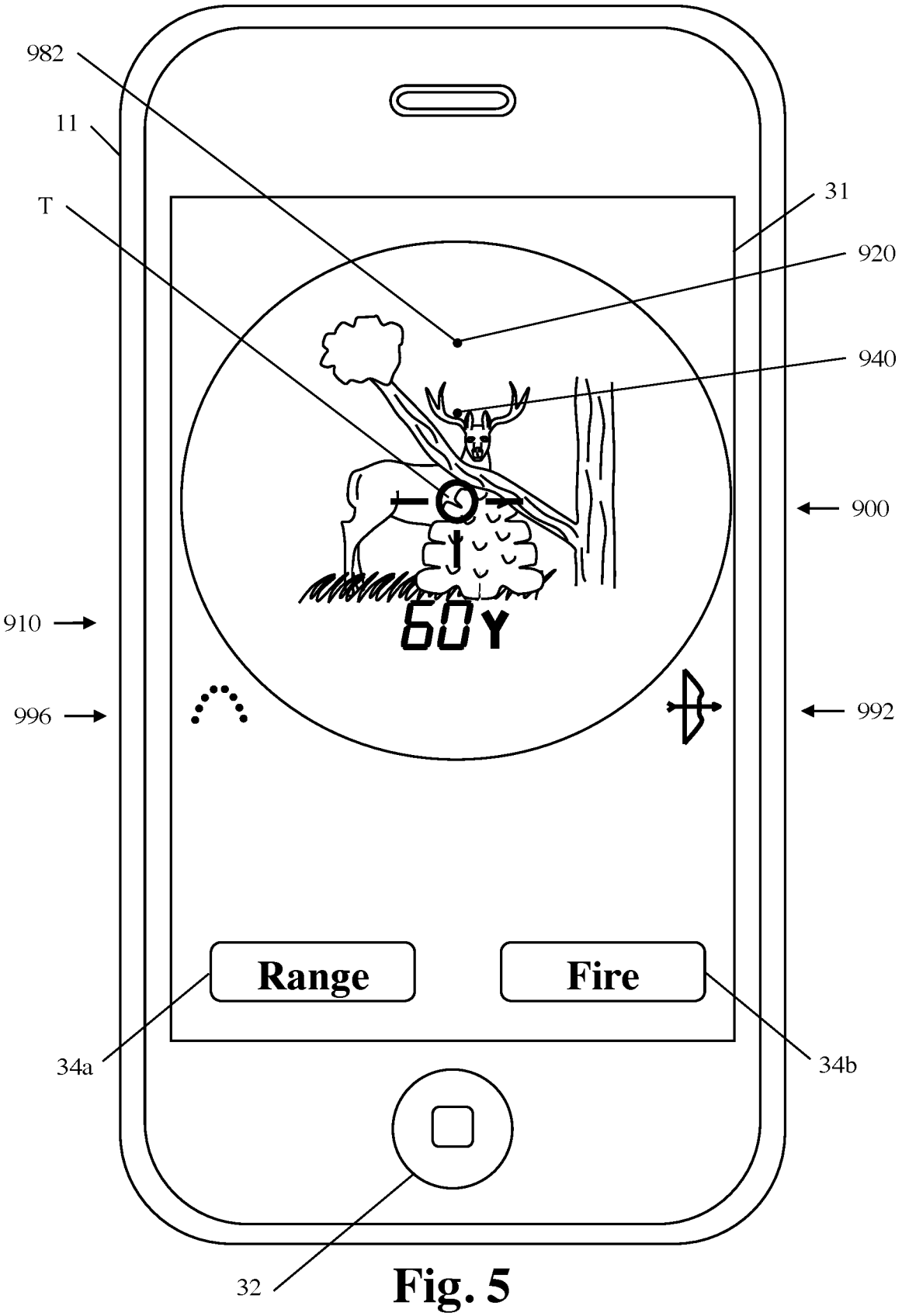
FIG. 5 shows a high-resolution digital display providing a clear shot indication and also shows optional game inputs.

FIG. 5 shows a high-resolution display 31 providing digital video superimposed with a clear shot indication, such as the twenty-yard indicator 920 and the forty-yard indicator 940. The digital video shows the target, such as a deer and its surroundings.

FIG. 5 also shows optional placement of various mode indicators. For example, the bow mode indicator 992 and the trajectory mode indicator 996 are shown in the corners of a rectangular digital, high-resolution display 31, in this example, a touch screen display of an Apple iPhone 11.

One advantage of a digital, high-resolution display 31 is that it is not limited to the circular optical focus area. The additional area of the rectangular display can be used for various purposes. As shown in FIG. 5 the various mode indicators, including bow mode indicator 992, rifle mode indicator 994 (not shown), trajectory mode indicator 996, can be moved outside the circular focus area, for example, to the lower corners. Other indicators, such as the distance indicator 910 angle and second range indicator 990, can also be moved outside the circular focus area. This has the advantage of allowing the circular focus area to be less cluttered and to obscure less of the optical image information. Further, the rectangular high-resolution display 31 can provide more optical information.

Another advantage of a high-resolution display 31 is that the overlay information is produced by software rather than by a hardware chip. Custom hardware chips can be expensive to design and manufacture and are less flexible. The overlay information generated by software for display on the high-resolution display 31 is higher quality, such as easier to read fonts, and move flexible, such as being able to display in different colors or locations of the screen to avoid obscuring the optical information being overlaid. The display can have more options, such as natural languages, different number systems such as Chinese, different units of measure, and so forth. Further, the software can be easily updated to incorporate new features, to improve calculations, or to support addition projectile information. Updates can be made in the field as well as in new models at a lower cost. For example, in some embodiments, new software can be downloaded over the Internet.

Other advantages of high-resolution display 31 will be discussed in references to FIGS. 6 and 7.

High-Resolution Touch Screen Display

FIG. 5 also shows an exemplary touch screen display as an embodiment of the high-resolution display 31. The high-resolution display 31 displays the video image as digitally captured by the digital camera 25 or as simulated by the game software; the overlay information such as the twenty-yard indicator 920 and the forty-yard indicator 940, the cross hairs 900, the distance indicator 910, the mode indicators (e.g. 992 and 996), and the display inputs 34, shown as range button (34*a*) and fire button (34*b*). The display inputs 34 are virtual buttons that are tapped on a touch screen, or clicked on with a pointing device (or game controller). The input 32 is a physical button. Both inputs 32 and display inputs 34 provide input to the computing element 16 (FIG. 3).

The embodiment shown comprises a mobile smart phone, in particular an Apple iPhone 11. Correlating FIG. 1 with FIG. 5, the computing element 16 is the processor of the iPhone 11; the memory 18 is the memory of the iPhone 11; the tilt sensor 14 is the accelerometer of the iPhone 11; and the display 30 is the touch screen display of the iPhone 11, an embodiment of the high-resolution display 31. The range sensor 12 is simulated in the game embodiments, or as enhancement to the iPhone 11.

Digital Rangefinder Devices

Figure 6:
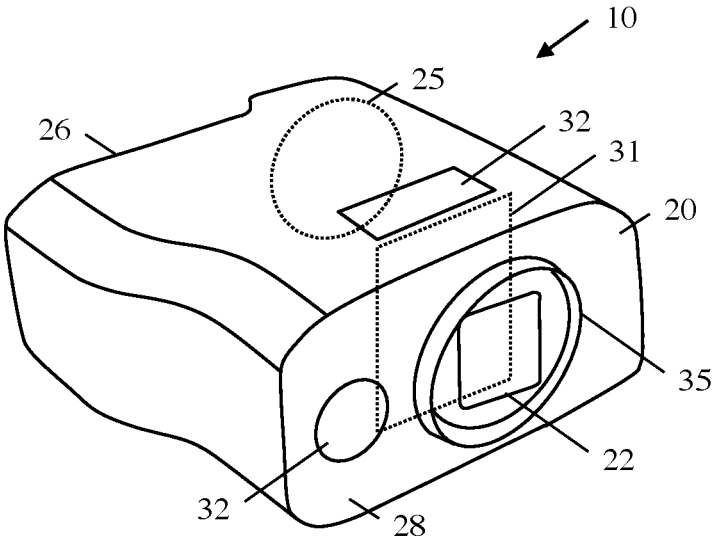
FIG. 6 is a rear perspective view of a digital rangefinder device.
Figure 7:
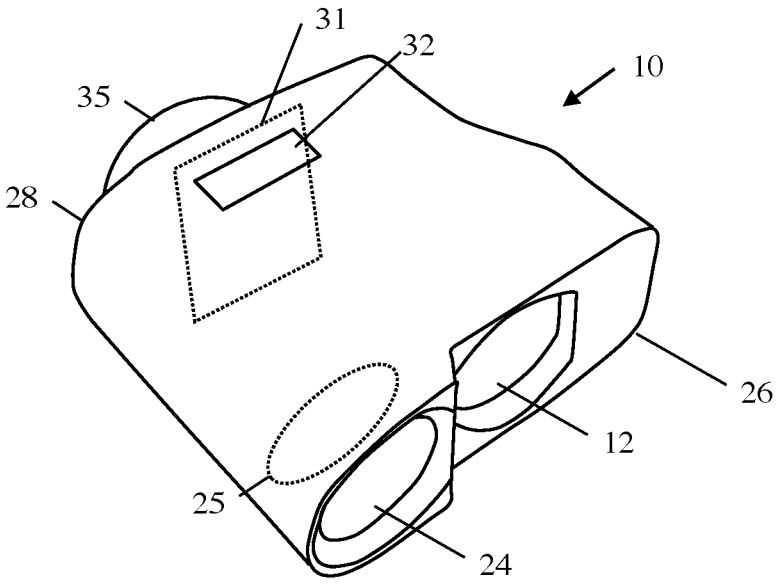
FIG. 7 is a front perspective view of the rangefinder device of FIG. 6.

FIGS. 6 and 7 are rear and front perspective views, respectively, of a digital embodiment of rangefinder device 10.

The digital rangefinder device 10 comprise a housing 20, having an eyepiece 22 at the proximate end 28, a lens 24 and range sensor 12 at the distal end 26, and inputs 32 in various places on exterior. In contrast to the conventional rangefinder, the housing 20 contains a digital camera 25 that captures and digitizes video from the optical image through the lens 24 and contains a digital, high-resolution display 31. The video comprises a series of image frames. The computing element 16 (FIG. 3) processes the image frames, overlays each frame with various indicators, and displays the resulting image on the high-resolution display 31. Further, the high-resolution display 31 is controlled completely by the computing element 16 (FIG. 3) and need not display any of the optical image being captured; instead the high-resolution display 31 may display setup menus, recorded video, or animations generated by the computing element 16 (FIG. 3).

The eyepiece 22 may also be modified to accommodate viewing of the high-resolution display 31. In particular the eyepiece 22 may be inset and be protected by a shroud 35.

In contrast to the conventional rangefinder housing 20, the housing 20 of the digital rangefinder of FIGS. 6 and 7 is more compact, more lightweight, and easier to transport and use, due to removal of the end to end optics. For example, the length between the proximate end 28 and the distal end 26 is shown as less than about four inches. The width and height could be about two inches respectively Enhanced ClearShot Technology for Rifle and Military Markets Various embodiments of the inventions discussed above have been incorporated in Bushnell's The Truth with ClearShot™ laser rangefinder. This product has been very successful and has been critically acclaimed and well received by the industry, especially for bow hunting.

However, the layout of the display, e.g. see FIG. 4, with for example, a 4× focal magnification is limited to relative slow projectiles such as arrows and black powder rifle balls (e.g. less than 400 feet per second), which are typically shot at targets less than 80 yards away.

Modern rifles with high-performance cartridge bullets and other military projectiles such as tank guns can travel 10 to 20 times faster, and can be shot at targets that are hundreds or thousands of yards away. These higher velocity projectiles have a flatter projectile trajectory and the aiming point is closer to the target.

What is needed for higher velocity projectiles, such as those in the rifle hunting, law enforcement, and military industries, is a means for showing a relative aiming point using a reference representing an enlarged view of the target.

Relative Aiming Point

The following sections describe various enhancements to the clear shot technology discussed above, which provide a relative aiming point to meet the needs of users of higher velocity projectiles.

Relative Aiming Point Relative to a Reference of a Predetermined Height

FIGS. 8A through 8F illustrate displays showing embodiments of a relative aiming point 1000 shown relative to a reference of a predetermine size, the reference shown by various means such as a reference image 1002, reference indicators 1006 lines, a generic reference 1005, or a relative target icon 1120.

Figure 8A:
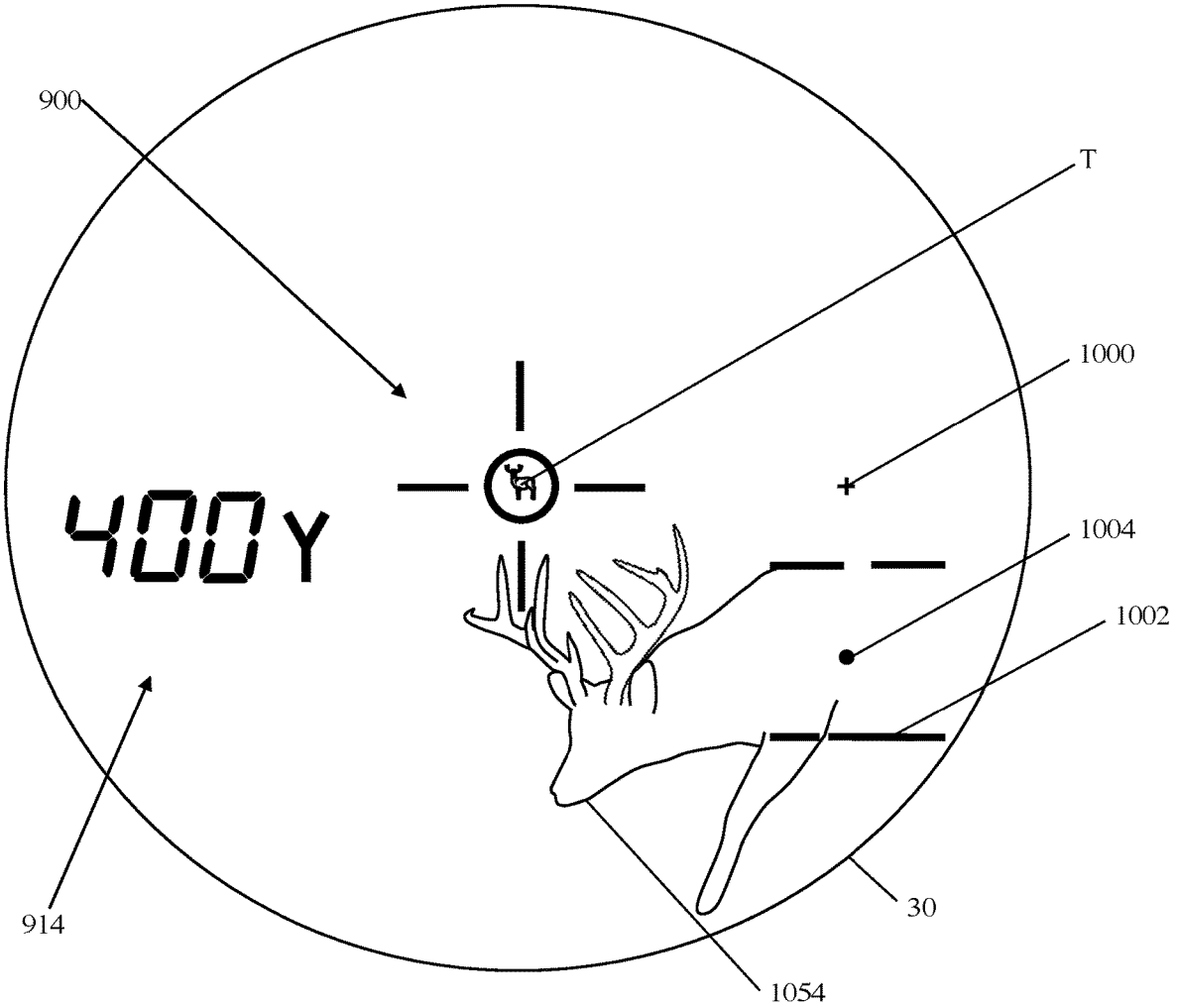
FIGS. 8A through 8F illustrate displays showing embodiments of a relative aiming point 1000 shown relative to a reference of a predetermine size, the reference shown by various means such as a reference image 1002, reference indicators 1006 lines, a generic reference 1005, or a relative target icon 1120.

FIG. 8A illustrates a display 30 showing an embodiment of a relative aiming point 1000 shown relative to a reference of a predetermine size. The display 30 shows the active display elements when a target T is ranged at four hundred yards. Note that the target T is visually much smaller than a deer would be when ranged at sixty yards. The display 30 shows cross hairs 900 (shown here with a center circle) which are placed on the target T. The display 30 dynamically shows that the horizontal range is four hundred yards in a horizontal distance indicator 914.

The target T and the target's surroundings are visually shown at a known focal magnification (such as 4× or 6× based on the lens 24 of the device 10). The display elements are superimposed over, or displayed over, the visual image.

In this embodiment, the reference is shown as a reference image 1002, for example as a generic deer with a chest height of 18 inches. The chest height is measured from the belly to the top of the back. The reference image 1002, such as an image of a deer, can be selected by the user in settings 1034 (discussed below in reference to FIGS. 12A through 12I and in FIG. 15). The user can also set the chest height for the deer, based on predetermined sizes for typical deer, such as 14 inches, 16 inches, or 18 inches.

This embodiment also shows reference target 1004 placed in the reference image 1002.

Operation of the Relative Aiming Point

FIG. 8A shows that the optical image of the deer, target T, at four hundred yards is very small. The indicators as shown in the bow mode embodiment in FIG. 4 do not have high enough precision to be useful for a long-range target T, such as at four hundred yards. This enhancement provides a rifle mode which can be combined with the bow mode in the same device, or which can be implemented independently in rangefinders used in the rifle and military markets.

Initially, the user sets up the rangefinder device 10 by selecting rifle mode; calibrating the device to the zero of the rifle sight or scope, and the ballistic code of the specific ammunition; selecting a reference type (such as the deer references image 1002 as shown); and selecting a reference size. See additional discussion below regarding settings in FIG. 15. See discussion regarding FIGS. 16A through 22F regarding a currently preferred relative target method of entering ballistic curve information (instead of entering a ballistic code).

When the user ranges a target T, the rangefinder device 10 determines a line of sight 3 distance (e.g. the laser distance), determines an angle (using a tilt sensor or accelerometer), and then uses the line of sight distance and the angle to determine a horizontal 4 distance to the target T, which is displayed in the horizontal distance indicator 914.

Next, the device 10 determines the projectile trajectory 2. In rifle mode the shape of the parabola is determined by the ballistic code entered in settings 1034. The values for the projectile trajectory is determined from the ballistic code in a lookup table stored in the device 10, or, preferably, real ballistic curve information is used. For example, a .270 Winchester, zeroed at 100 yards, has about a 10-inch drop at 285 yards.

After calculating the aiming point 982, in relation to the target T, the reference image 1002 is displayed, and the relative aiming point 1000 is displayed relative to the reference using the predetermined reference height, for example 18 inches.

In the exemplary embodiment shown in FIG. 8A, the deer has a predetermined chest height of 18 inches as set by the user. The relative aiming point 1000 is determined to be about 21 inches based on the ballistic code and the 100 yard zero settings, and based on the horizontal distance of 400 yards determined by the rangefinder device 10.

In the FIG. 8A embodiment, the reference image 1002 has a fixed size and position. The relative aiming point 1000 is displayed dynamically based on the measured horizontal distance using the current ballistic, zero, and reference size settings. If the horizontal distance is less than the zero setting, the relative aiming point 1000 is displayed below the reference target 1004. If the horizontal distance is the same as the zero setting, the relative aiming point 1000 is the reference target 1004. If the horizontal distance is greater that the zero setting the relative aiming point 1000 is displayed above the reference target 1004.

Relative Aiming Point Relative to Reference Lines

Figure 8B:
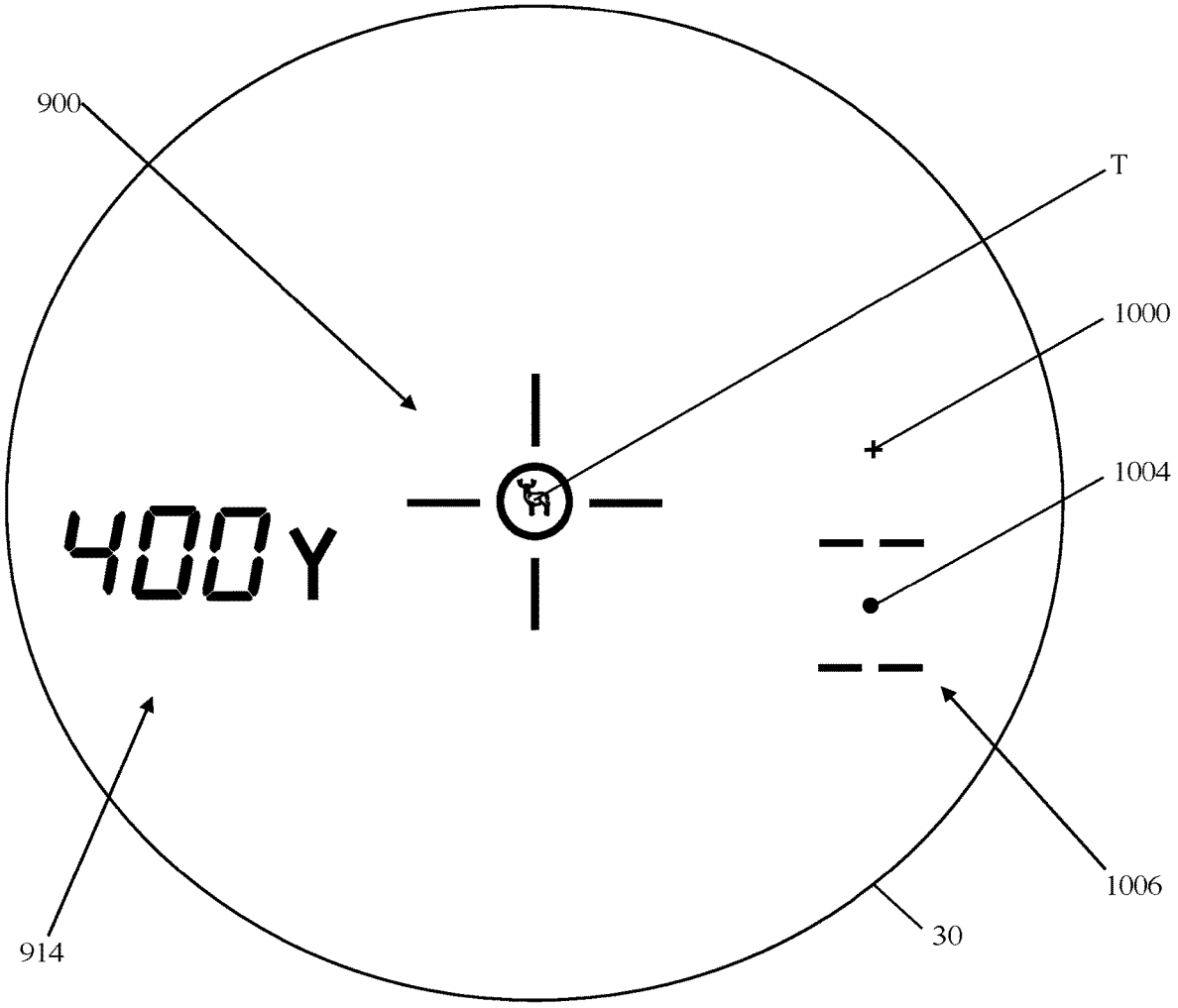

FIG. 8B illustrates a display 30 showing an embodiment of a relative aiming point 1000 shown relative to a reference indicator 1006 shown as reference lines. Like FIG. 8A, the display 30 shows cross hairs 900 and dynamically shows the horizontal range in a horizontal distance indicator 914.

In this embodiment, the reference is shown as the reference indicator 1006 shown as reference lines.

This embodiment also shows reference target 1004 centered in the reference indicator 1006.

In this embodiment, the reference indicator 1006 has a fixed size and position. The relative aiming point 1000 is displayed dynamically based on the measured horizontal distance using the current ballistic, zero, and reference size settings.

Relative Aiming Point Relative to Reference Image and Reference Multiples

Figure 8C:
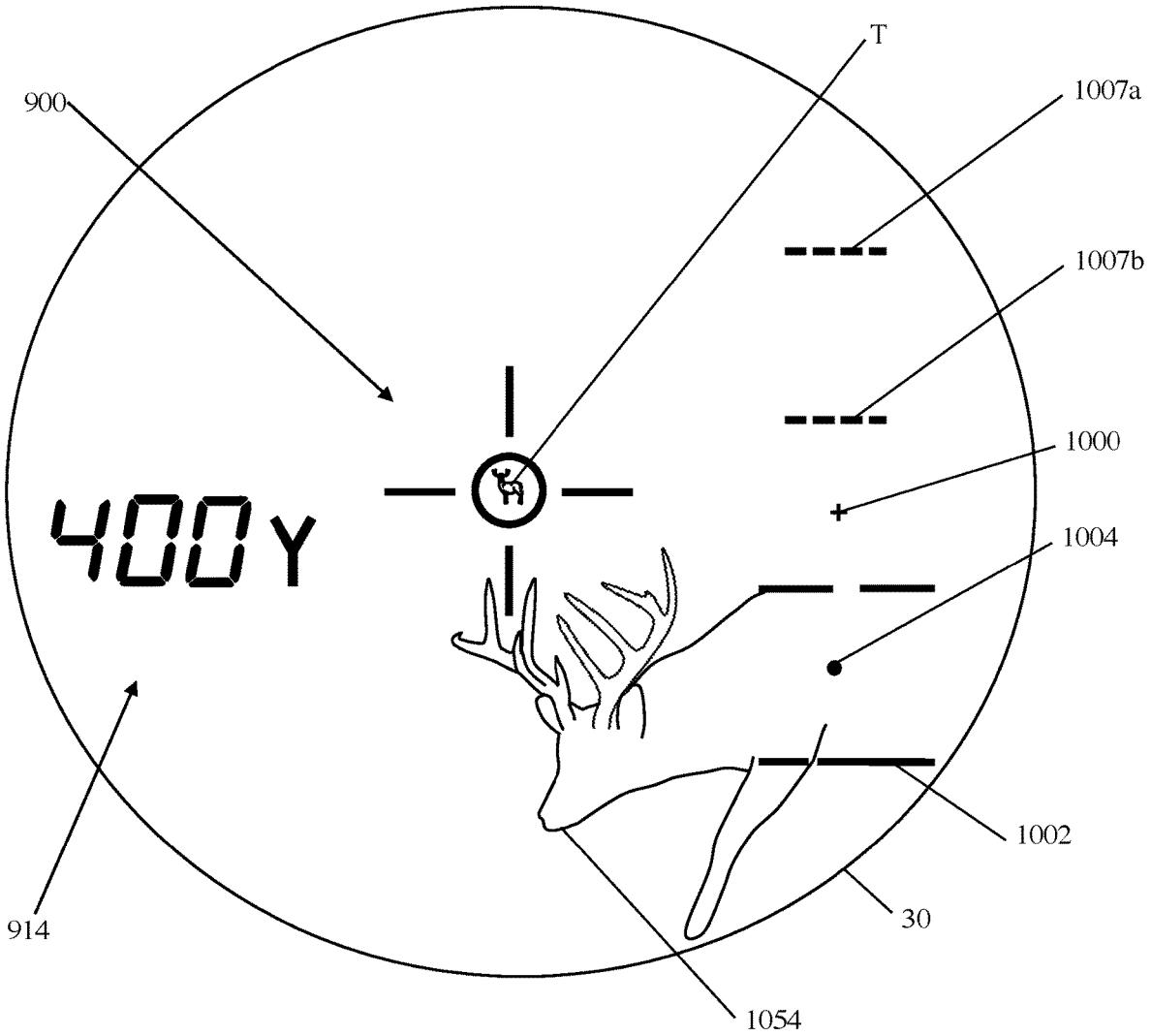

FIG. 8C illustrates a display 30 showing an embodiment of a relative aiming point 1000 shown relative to a reference image 1002 shown as a deer. Like FIG. 8A, the display 30 shows cross hairs 900 and dynamically shows the horizontal range in a horizontal distance indicator 914.

In this embodiment, the reference is shown as the reference image 1002 with a plurality of reference multiples 1007*a-b*, shown as dashed lines. Each reference multiple 1007 is the same height as the reference height, in this example, the same as the chest height of the deer. Reference multiples 1007 are useful for very long shots where the bullet drop larger than the size of the reference. The user 100 can visualize the reference height and then pick an aiming point that is relative to a multiple of the target's visualized height in the scope.

This embodiment also shows reference target 1004 centered in the reference indicator 1006.

In this embodiment, the reference image 1002 and reference multiples 1007*a-b* have fixed heights and positions. The relative aiming point 1000 is displayed dynamically based on the measured horizontal distance using the current ballistic, zero, and reference size settings.

Relative Aiming Point Relative to Reference Lines and Reference Multiples

Figure 8D:
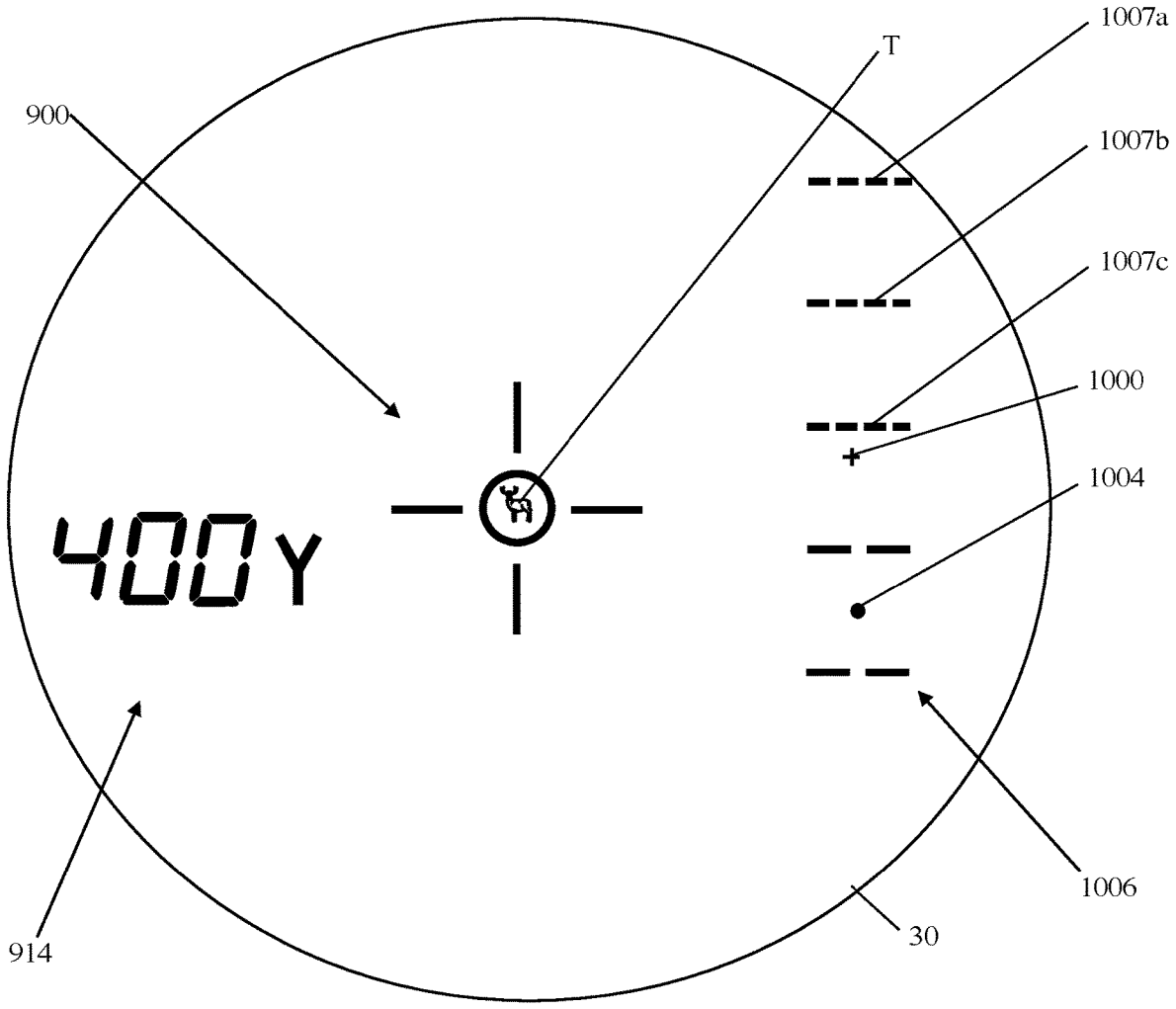

FIG. 8D illustrates a display 30 showing an embodiment of a relative aiming point 1000 shown relative to a reference indicator 1006 shown as reference lines. Like FIG. 8A, the display 30 shows cross hairs 900 and dynamically shows the horizontal range in a horizontal distance indicator 914.

In this embodiment, the reference is shown as the reference indicator 1006 shown as reference lines with a plurality of reference multiples 1007*a-c*, shown as dashed lines. Each reference multiple 1007 is the same height as the reference height. Reference multiples 1007 are useful for very long shots where the bullet drop larger than the size of the reference. The user 100 can visualize the reference height and then pick an aiming point that is relative to a multiple of the target's visualized height in the scope.

This embodiment also shows reference target 1004 centered in the reference indicator 1006.

In this embodiment, the reference indicator 1006 and reference multiples 1007*a-c* have fixed heights and positions. The relative aiming point 1000 is displayed dynamically based on the measured horizontal distance using the current ballistic, zero, and reference size settings.

Relative Aiming Point Relative to Generic Reference

Figure 8E:
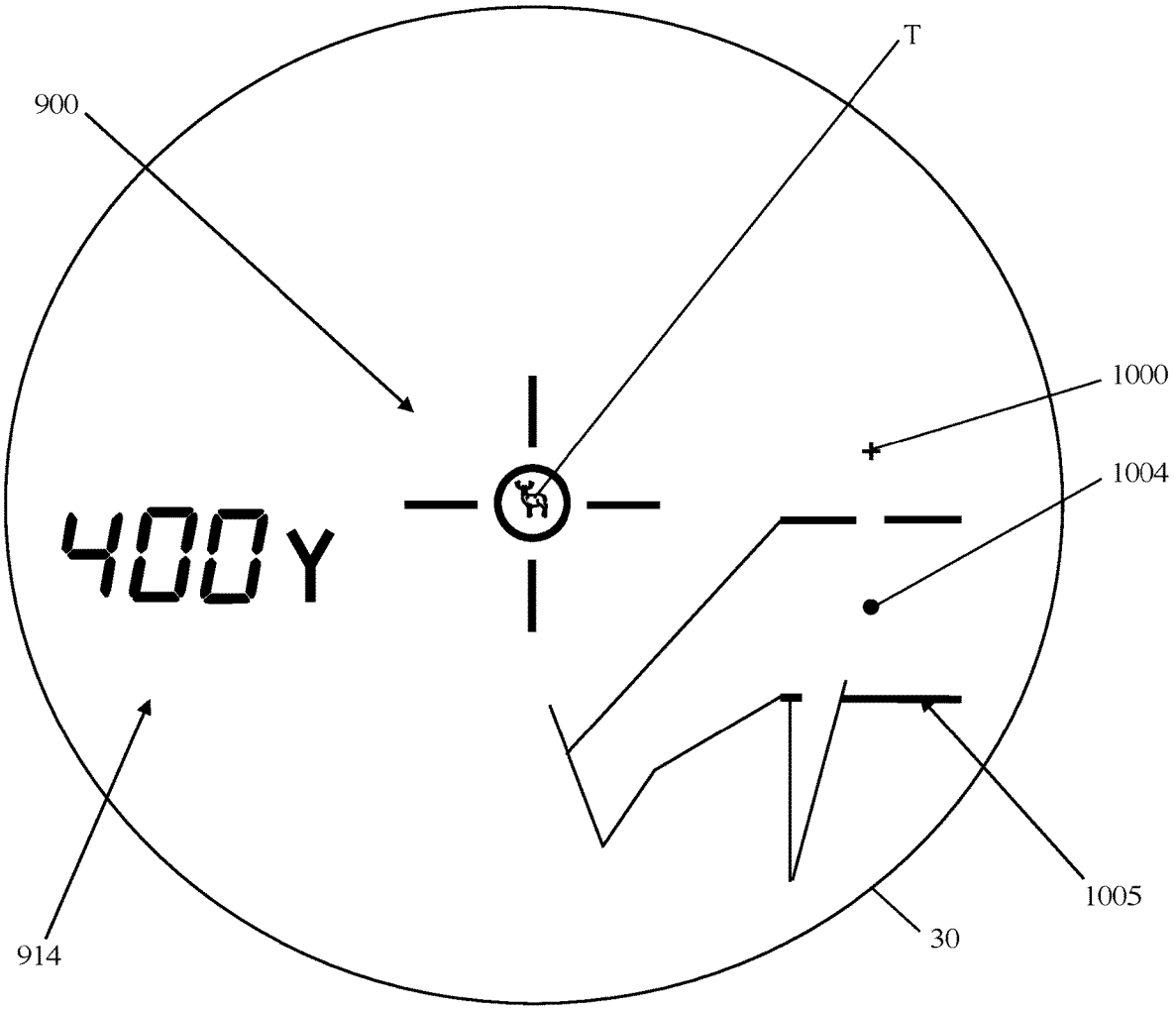

FIG. 8E illustrates a display 30 showing an embodiment of a relative aiming point 1000 shown relative to a generic reference 1005 shown as generic stick figure. Like FIG. 8A, the display 30 shows cross hairs 900 and dynamically shows the horizontal range in a horizontal distance indicator 914.

In this embodiment, the reference is shown as the generic reference 1005. This generic reference 1005 can be used for a variety of four legged mammals, including deer, elk, antelope, moose, coyote, skunk, etc. The generic image can be permanently set simplifying the settings required in this embodiment.

This embodiment also shows reference target 1004 centered in the reference indicator 1006.

In this embodiment, the generic reference 1005 has a fixed height and position. The relative aiming point 1000 is displayed dynamically based on the measured horizontal distance using the current ballistic, zero, and reference size settings.

Relative Aiming Point Relative to Relative Target Icon

Figure 8F:
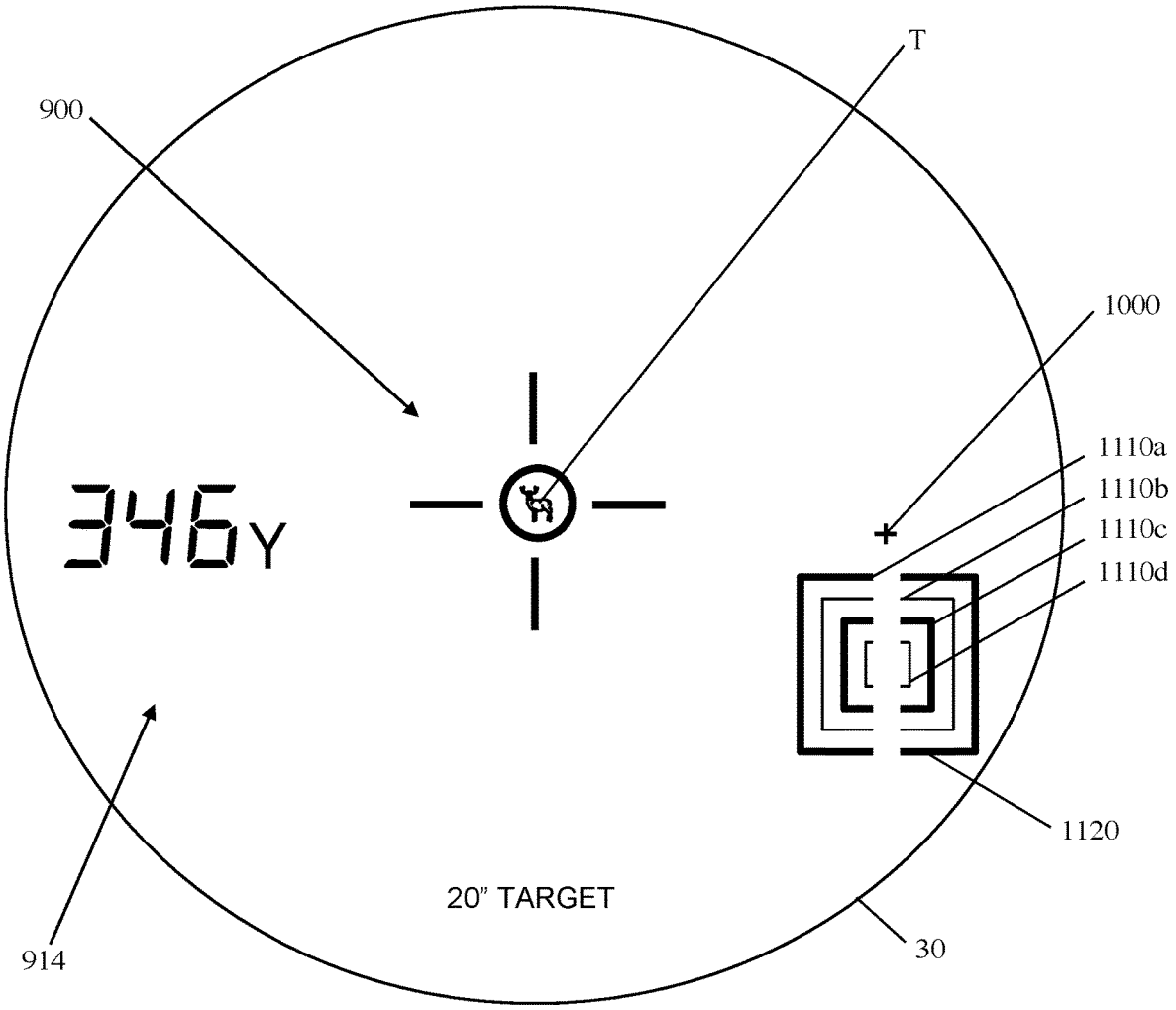

FIG. 8F illustrates a display 30 showing an embodiment of a relative aiming point 1000 shown relative to a novel relative target icon 1120. Like FIG. 8A, the display 30 shows cross hairs 900 and dynamically shows the horizontal range in a horizontal distance indicator 914.

In this embodiment, the novel relative target icon 1120 has a fixed height and position. The relative aiming point 1000 is displayed dynamically based on the measured horizontal distance using the current ballistic, zero, and reference size settings.

The relative target icon 1120 represents a 20-inch by 20-inch relative target 1100 (see FIG. 16A) in Imperial "yard" mode, where the target height is 20 inches. The relative target icon 1120 represents a 50 cm by 50 cm relative target 1100 (see FIG. 16B) in metric "meter" mode, where the target height is 50 cm.

In this embodiment, the reference is shown as the relative target icon 1120. This relative target icon 1120 can be used for a variety of types of target with out having to modify the target height setting. The advantage of the novel relative target icon 1120 over the other embodiments can be understood by the following examples.

When the distances are shown in yards, the relative target icon 1120 corresponds to 20-inch by 20-inch relative target 1100. As discussed below in relation to FIG. 16A, the markings on the relative target 1100 comprise of four concentric squares 1110(*a-d*) having sides measuring 20 inches, 15 inches, 10 inches, and 5 inches, respectively. The relative target icon 1120 comprises display segment elements that correspond to the four concentric squares 1110 (*a-d*) of the relative target 1100. If the current target T is a mule deer having a chest height of 18 inches which is between 20 inches and 15 inches, the user would use the white band between the outer two concentric squares 1100*a* and 1100*b* to visualize the reference to the 18 inch mule deer chest and then used the relative aiming point 1000 to visualize where to aim. If an antelope, having a 15-inch chest height, comes into view, the user would use the 15-inch concentric square 1100*b* to visualize the reference to the 15-inch antelope chest and then used the relative aiming point 1000 to visualize where to aim. If a prairie dog, having a 10-inch body height, comes into view, the user would use the 10-inch concentric square 1100*c* to visualize the reference to the 10-inch prairie dog body and then used the relative aiming point 1000 to visualize where to aim. If no living targets show up for the hunt, a tin can having a height of about 5 inches, can be visualized by using the 5 inch concentric square 1100*d* to visualize the reference to the tin can and then used the relative aiming point 1000 to visualize where to aim.

In a military example, if a terrorist, having a 20-inch chest height, comes into view, the user, a warfighter, would use the 20-inch concentric square 1100*a* to visualize the reference to the terrorist's chest and then used the relative aiming point 1000 to visualize where to aim. If only an enemy's head, about 9 inches high, is seen above a wall, the warfighter would use the 10 inch concentric squares 1100*c* to visualize the reference to the 9 inch head and then used the relative aiming point 1000 to visualize where to aim.

In this example, the operation is as follows: when the user 100 presses the range input 32 button on the range finding device 10, the cross hairs 900 are selective illuminated allowing the user aim the range sensor at the target T, the range finding device 10 uses the distance from the range sensor 12 and the angle from the tilt sensor 14 to determine the horizontal distance to the target which is displayed in the horizontal distance indicator 914, shown as 346 yards. As visualized in FIG. 8F, the resolution of the display 30 is inadequate to show an absolute aiming point 982 in relation to the actual visualized image of the target T. Compare this to the 40-yard example shown in FIG. 4, where the selectable path indicators 930 of layout of FIG. 11B (or FIG. 11D) are adequate to show an absolute aiming point 982, or the 60-yard example shown in FIG. 5 where the digital display 31 has the adequate resolution to show an absolute aiming point 982.

Relative Aiming Point Options

Figure 9A:
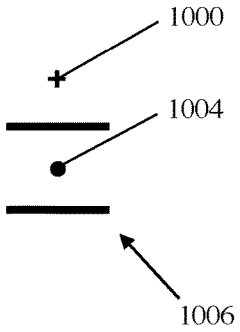
FIGS. 9A through 9C illustrate various options for showing a relative aiming point relative to a reference indicator, including an optional reference target or wind correction.
Figure 9B:
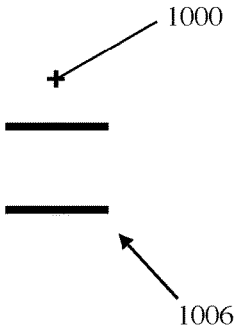
Figure 9C:
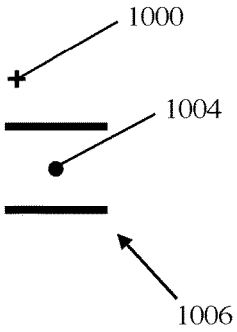

FIGS. 9A through 9C illustrate various options for showing a relative aiming point 100 relative to a reference indicator 1006, including an optional reference target 1004 or wind correction.

FIGS. 9A through 9C illustrate a subset of a display 30 showing embodiments of a relative aiming point 1000 shown relative to a reference indicator 1006 shown as reference lines.

FIG. 9A shows an optional reference target 1004 centered in the reference indicator 1006.

FIG. 9B shows that the optional reference target 1004 can be omitted. While the reference target 1004 is currently preferred and is generally shown in most of the figures in this section, relative aiming point 1000 can be implemented without explicitly showing the reference target 1004, and could be omitted from any specific embodiment.

FIG. 9C shows the relative aiming point 1000 offset from the reference target 1004 wherein the offset adjusts for cross wind drift. In this specific case, the reference target 1004 is useful to visualize the amount of cross wind drift adjustment.

Horizontal Distance and Angle Display Options

Figure 10A:
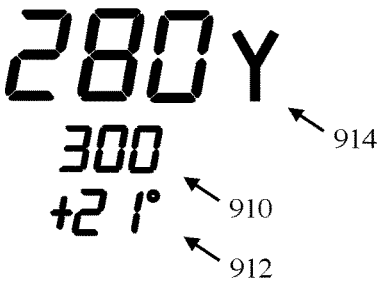
FIGS. 10A through 10C illustrate various options for showing line of sight distance, horizontal distance, and angle.
Figure 10B:
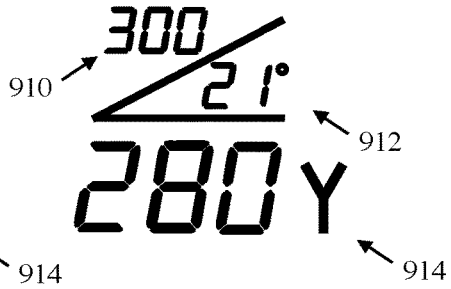
Figure 10C:
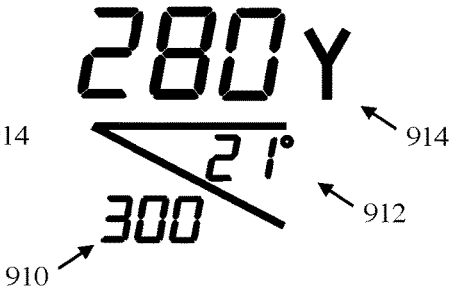

FIGS. 10A through 10C illustrates various options for showing line of sight distance, horizontal distance, and angle.

In other display layouts, the line of sight distance indicator 910 is displayed in larger digits while the angle and horizontal distance is display in smaller digits. However, the most important number for the user 100 is the horizontal distance. An improved display layout having better user interface design will show only the horizontal distance (see FIG. 11A) or show the horizontal distance as the primary number (see FIGS. 10A through 10C, and FIGS. 11B through 11D).

FIG. 10A shows a portion of a display 30 where a horizontal distance indicator 914 has the largest digits, with a distance indicator 910 and an angle indicator 912 shown below in smaller digits.

FIGS. 10B and 10C shows a portion of a display 30 where a horizontal distance indicator 914 has the largest digits, with a distance indicator 910 and an angle indicator 912 both in smaller digits, shown above when the target T is uphill (FIG. 10B, see also FIG. 3B) and shown below when the target T is downhill (FIG. 10C, see also FIG. 3C). This embodiment is more intuitive and shows graphically the horizontal distance indicator 914 next to the horizontal line in the angle graphic, the angle indicator 912 inside the angle, and the line of sight distance indicator 910 next to an uphill line in a first angle graphic (FIG. 10B) or next to a downhill line in a second angle graphic (FIG. 10C). In contrast to FIG. 10A the user does not have to recognize and interpret the plus or minus sign in the angle indicator 912; instead it is shown graphically for better user cognition.

Display Layouts for Relative Aiming Point

FIGS. 11A through 11D show embodiments of layout for the display segments or display elements which are superimposed on the visual image of the target and the target's surroundings.

Figure 11A:
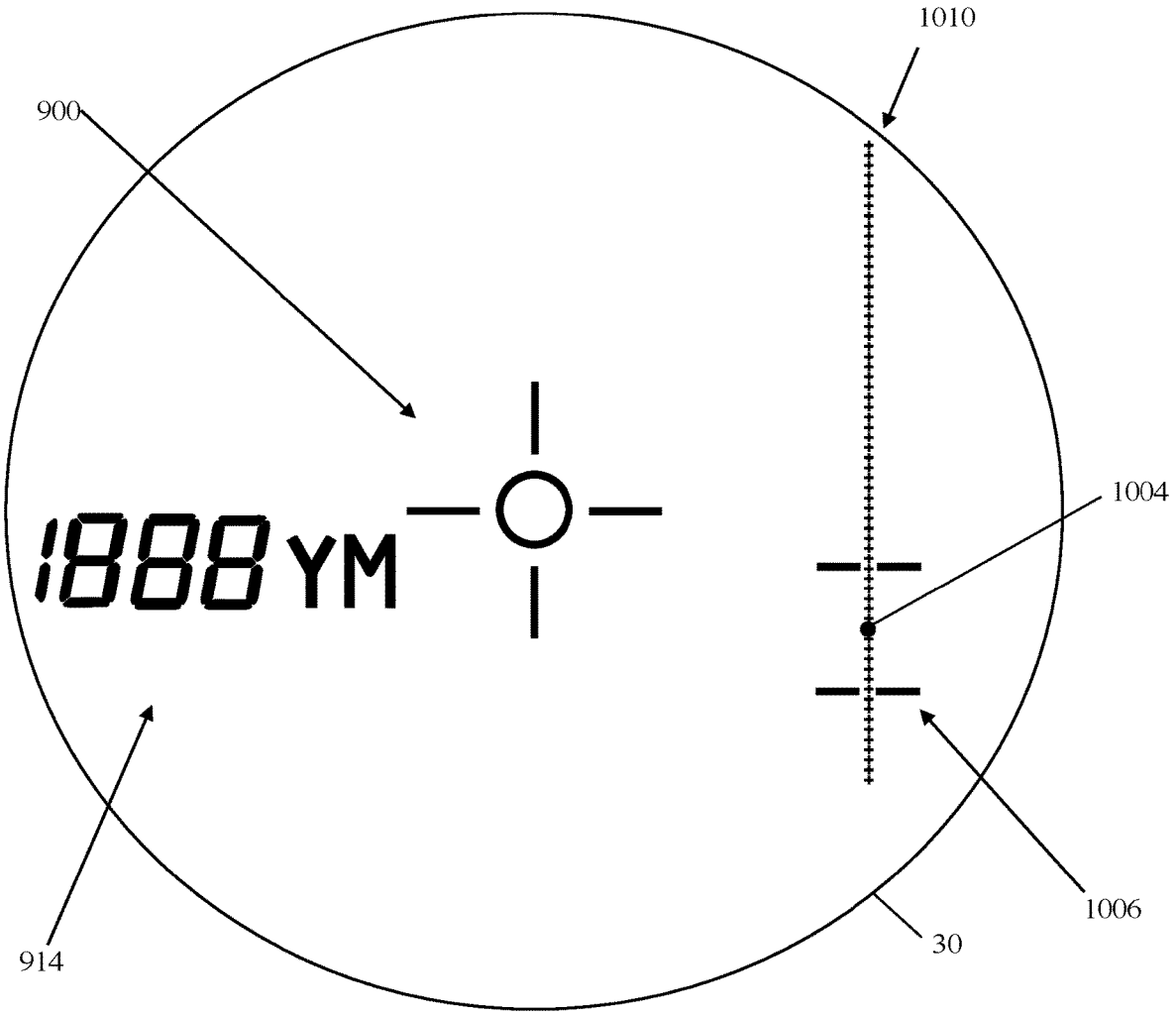
FIGS. 11A through 11D show embodiments of layout for the display segments.

FIG. 11A shows an embodiment of a layout for the display segments. An exemplary display 30 comprises segments forming cross hairs 900, a horizontal distance indicator 914, a reference target 1004, a reference indicator 1006, and a plurality of selectable aiming point indicators 1010.

The cross hairs 900 are positioned centrally in the display 30. The horizontal distance indicator 914 is positioned peripherally, shown near the left edge of the display 30. The reference indicator 1006 is positioned peripherally in the display 30, shown near the right edge of the display 30. The aiming point indicators 1010 are also positioned peripherally and centered on the reference indicator 1006.

The plurality of selectable aiming point indicators 1010 are dynamically and selectively illuminated to provide the relative aiming point 1000.

In other embodiments, two or more reference images 1002 or a generic reference 1005 could also be added to the layout, each as a single segment, which is dynamically and selectively illuminated to provide the reference based on the settings. See FIG. 11C, FIGS. 12A through 12I and FIG. 15.

Figure 11B:
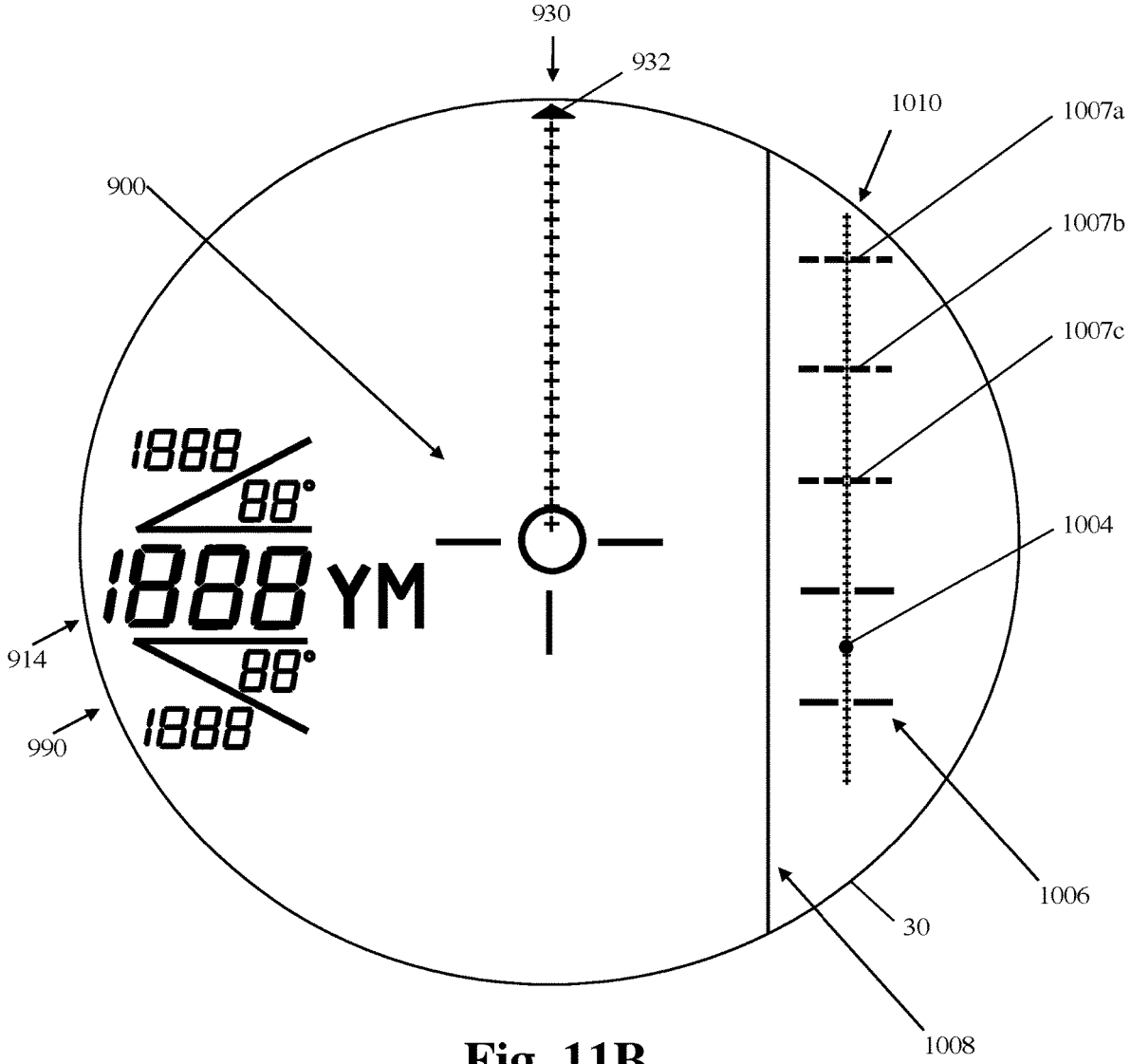

FIG. 11B shows an embodiment of a more robust, hybrid layout for the display segments. An exemplary display 30 comprises segments forming cross hairs 900, a horizontal distance indicator 914, selectable path indicators 930, an off screen indicator 932, angle and second range indicator 990, a reference target 1004, a reference indicator 1006, reference multiples 1007*a-c*, a separator 1008, and a plurality of selectable aiming point indicators 1010.

The cross hairs 900 are positioned centrally in the display 30. The selectable path indicators 930 and off screen indicator 932 are centered on the cross hairs 900. The horizontal distance indicator 914 and angle and second range indicator 990 are positioned peripherally, shown near the left edge of the display 30. The reference indicator 1006 is positioned peripherally in the display 30, shown near the right edge of the display 30. The aiming point indicators 1010 are also positioned peripherally and centered on the reference indicator 1006. The reference multiples 1007*a-c* are also positioned relative to the reference indicator 1006.

This embodiment supports the improved layout of FIGS. 10B and 10C.

The separator 1008 may be useful to help the user visually distinguish, or separate, the visual image of the target and the relative aiming point portions of the display 30.

In hybrid embodiments, the selectable path indicators 930 would illuminate when the target T was close (e.g. visually larger than the reference height, such as 1006) and the reference target 1004, the reference indicator 1006, reference multiples 1007*a-c*, the separator 1008, and one of the plurality of selectable aiming point indicators 1010 would illuminate when the target was far. In other words, one of the aiming point indicators 1010 is used to display the relative aiming point 1000 when the aiming point is close to the target (e.g. within a distance equivalent to the chest height of a deer) and the path indicators 930 is used to display the absolute aiming point 982 when the aiming point is far from the target T but still visible in the display 30, or when the distance to the target T is short.

Figure 11C:
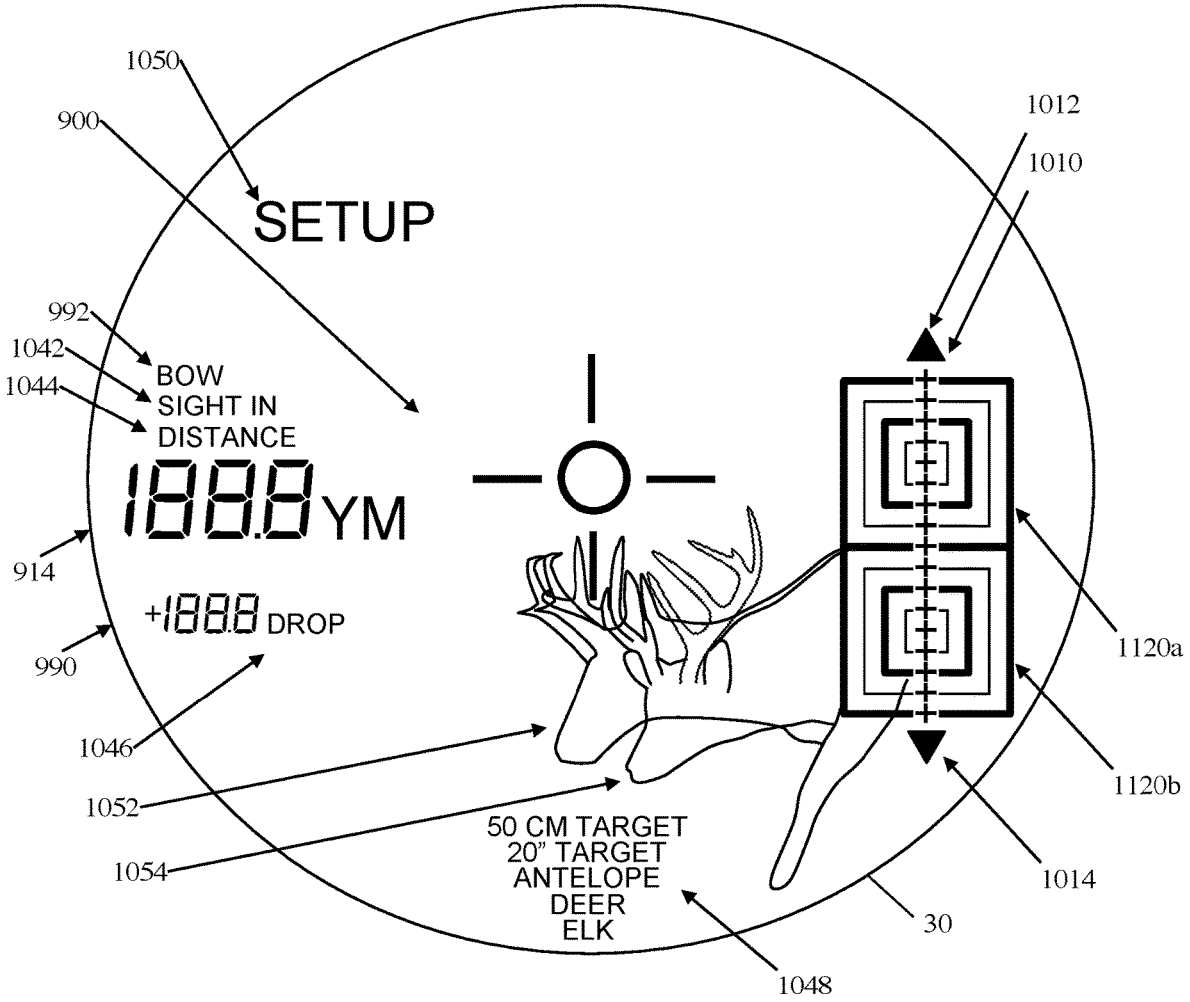

FIG. 11C shows a currently preferred embodiment of a layout for the display segments. An exemplary display 30 comprises segments forming cross hairs 900, a horizontal distance indicator 914, a second numerical indicator 990, multiple reference images 1002, and a plurality of selectable aiming point indicators 1010.

The plurality of selectable aiming point indicators 1010 are dynamically and selectively illuminated to provide the relative aiming point 1000. When one of the aiming point indicators 1010 is not appropriate, either a too high indicator 1012 or a too low indicator 1014 is selectively illuminated.

The layout includes multiple reference images 1002 (shown as antelope reference image 1052 and deer reference image 1054) and relative target icons 1120(*a-b*), each as a single segment, which are dynamically and selectively illuminated to provide the reference based on the settings.

The cross hairs 900 are positioned centrally in the display 30. The horizontal distance indicator 914 and second numerical indicator 990 are positioned peripherally, shown near the left edge of the display 30. The relative target icons 1120(*a-b*) are positioned peripherally in the display 30, shown near the right edge of the display 30. The aiming point indicators 1010 are also positioned peripherally and centered on the relative target icons 1120(*a-b*). The antelope reference image 1052 and deer reference image 1054 are positioned in relation to the lower relative target icon 1120*b*.

The layout also includes selectively illuminated setup indicator 1050, sight in indicator 1042, distance text 1044, drop text 1046, and a plurality of target type indicators 1048. The plurality of target type indicators 1048 are shown to include 20" Target (see FIG. 12I represented FIG. 16A), 50 cm Target (see FIG. 12I represented FIG. 16B), antelope (e.g. see FIG. 12C), deer (e.g. see FIG. 8A and FIG. 12A), and elk (see FIG. 12B). Other target type indicators could be included, for example, such as turkey (see FIG. 12D), prairie dog (see FIG. 12E), enemy (see FIG. 12F), tank (see FIG. 12G), or concentric circle targets (see FIG. 12H).

Figure 11D:
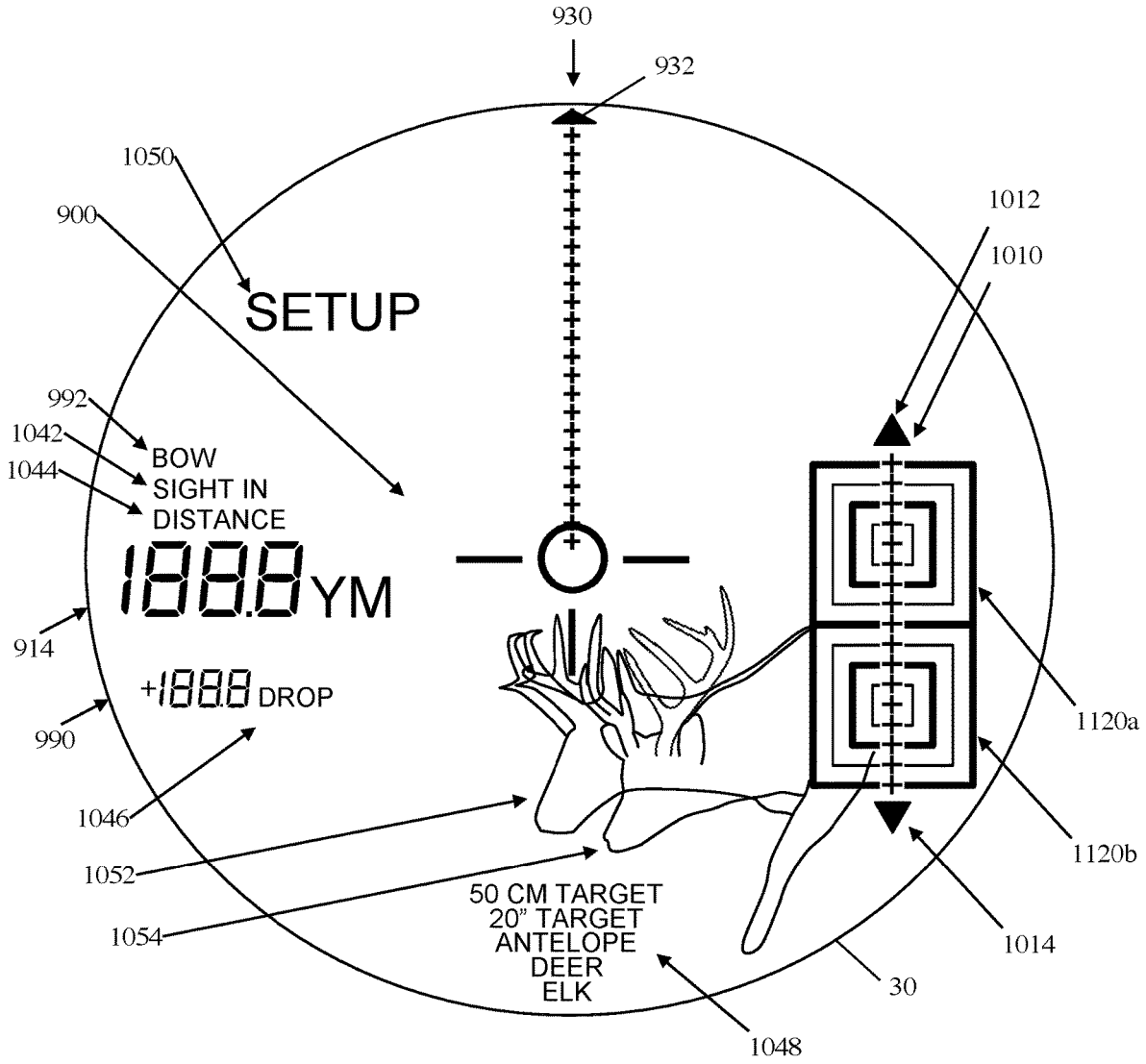

FIG. 11D shows another preferred hybrid embodiment of a display layout for use with bows, pistols, rifles, muzzle-loaders, etc. where all the elements of FIG. 11C are combined with the path indicators 930 and off screen indicator 932 as shown in FIG. 11B. In this embodiment, one of the aiming point indicators 1010 is used to display the separate and distinct relative aiming point 1000 when the aiming point is close to the target T (e.g. within a distance equivalent to the chest height of a deer) and the path indicators 930 is used to display the separate and distinct absolute aiming point 982 when the aiming point is far from the target T but still visible in the display 30, or when the distance to the target T is short.

User Selectable Reference Images and Reference Sizes

FIGS. 12A through 12I show embodiments of various reference images 1002 with relative aiming points 1000.

Figure 12A:
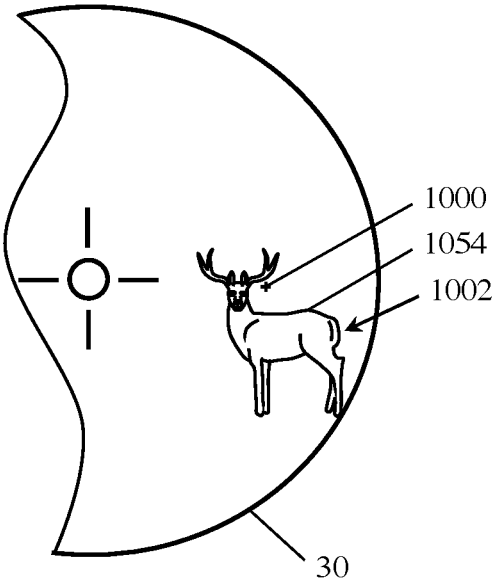
FIGS. 12A through 12I show embodiments of various reference images.

FIG. 12A shows the reference image 1002 as a deer reference image 1054. When a deer is selected the user can also select from corresponding chest heights. Mule deer have chest heights that average 18 inches. Whitetail deer have chest heights that average 16 inches. Deer height ranges could be between 14 and 18 inches.

Figure 12B:
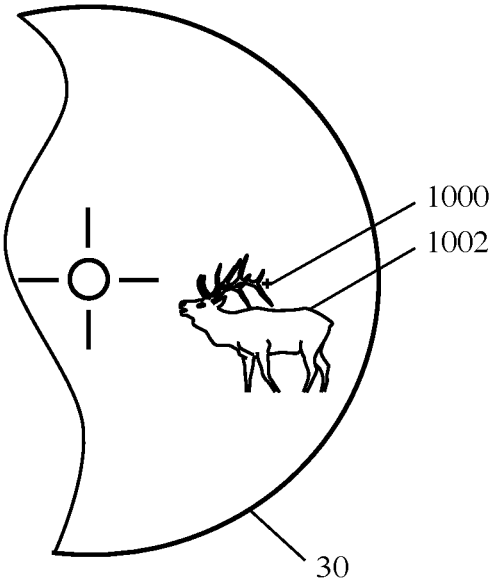

FIG. 12B shows the reference image 1002 as an elk. When an elk is selected the user can also select from corresponding chest heights. Elk have chest heights that average 25 inches.

Figure 12C:
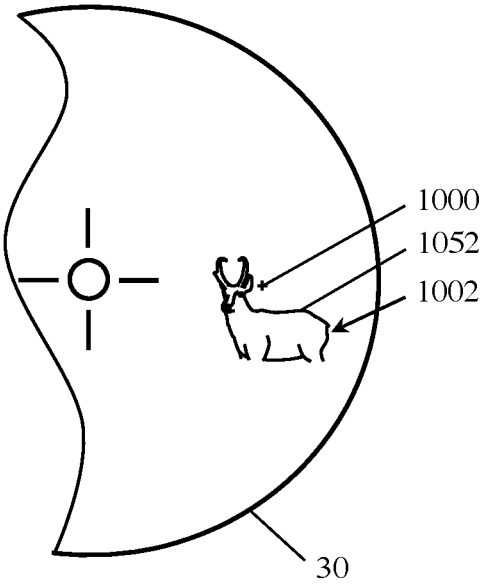

FIG. 12C shows the reference image 1002 as an antelope reference image 1052.

When an antelope is selected the user can also select from corresponding chest heights. Antelope have chest heights between 15 and 16 inches.

Figure 12D:
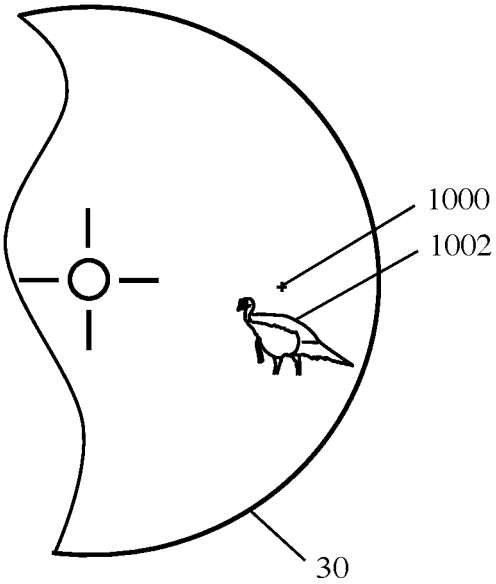

FIG. 12D shows the reference image 1002 as a turkey. When a turkey is selected the user can also select from corresponding reference body heights.

Figure 12E:
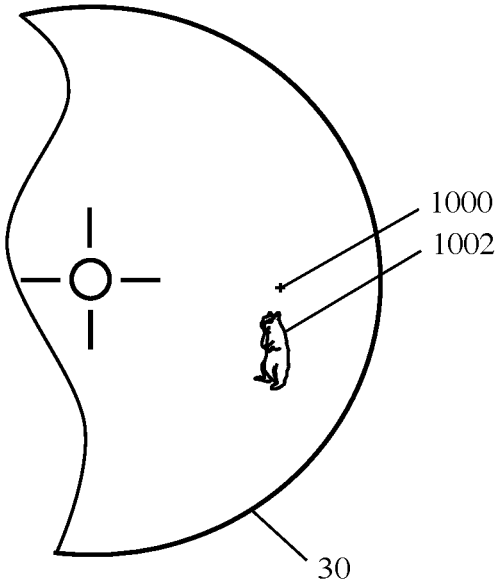

FIG. 12E shows the reference image 1002 as a prairie dog. When a prairie dog is selected the user can also select from corresponding chest heights.

Figure 12F:
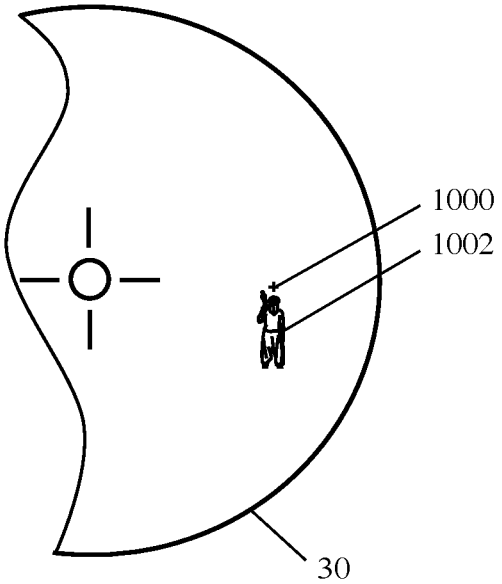

FIG. 12F shows the reference image 1002 as a terrorist. When a terrorist is selected the user can also select from corresponding body heights. Terrorists, for example, could have body heights between 4.5 and 6.5 feet.

Figure 12G:
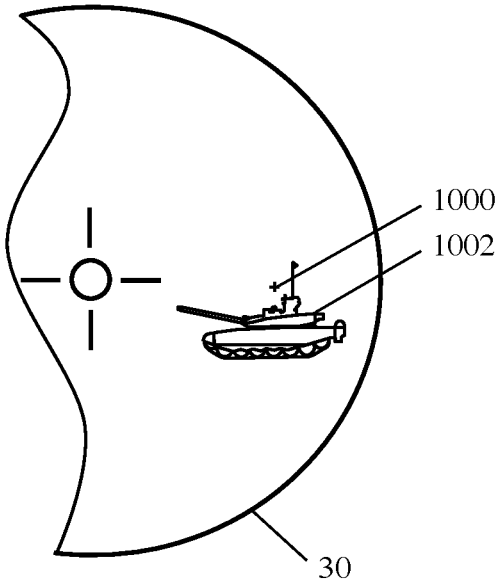

FIG. 12G shows the reference image 1002 as a tank. When a tank is selected the user can also select from corresponding vehicle heights.

Other reference images could include coyote, big horn sheep (20 inches), goats (20 inches) and moose (34 to 40 inches).

Figure 12H:
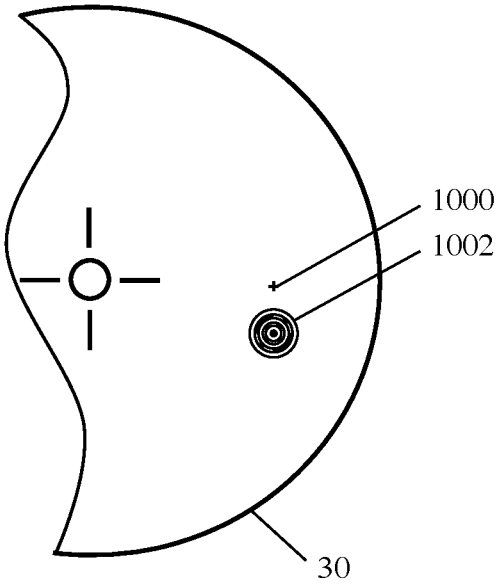
Figure 12I:
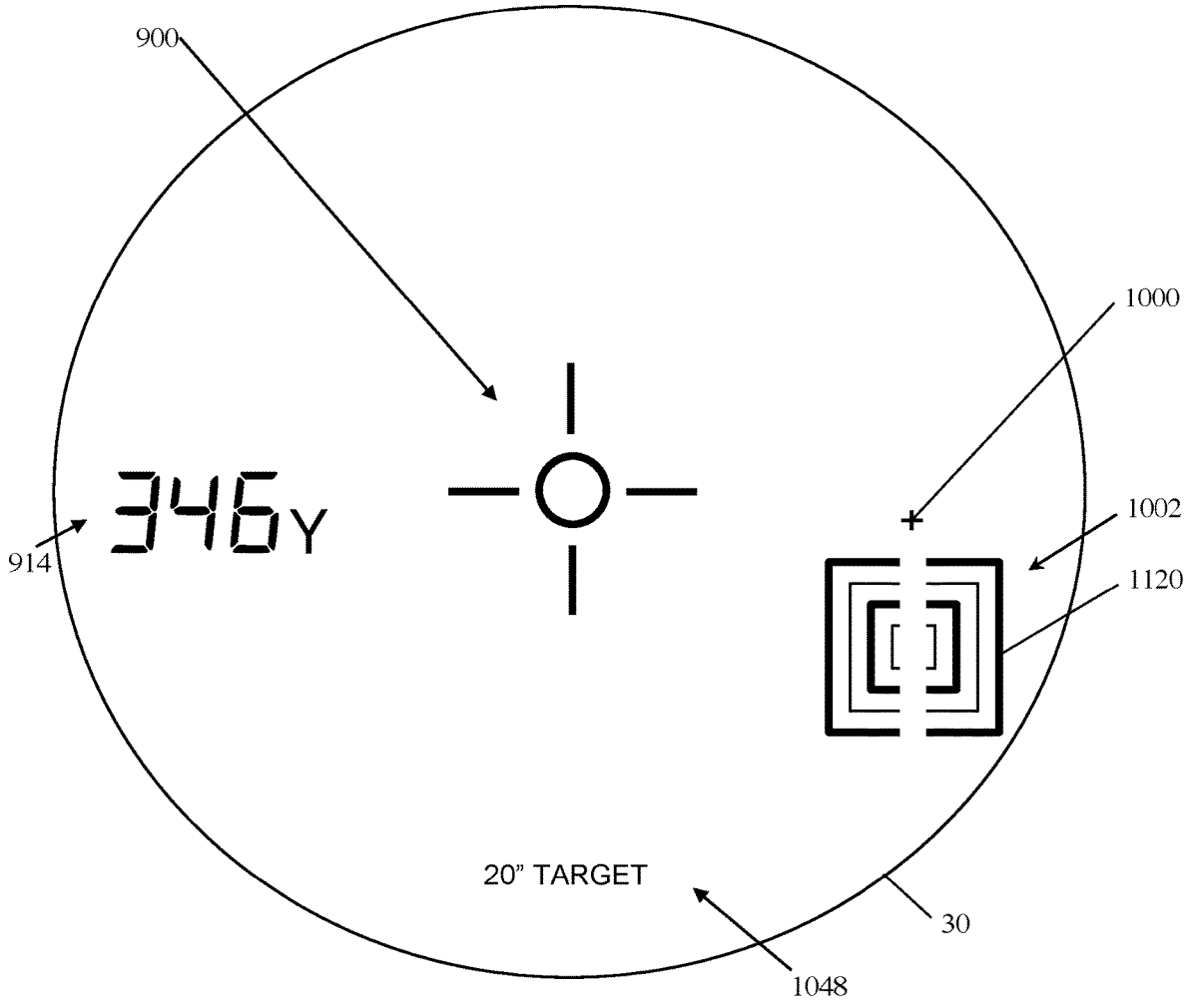

FIG. 12H shows the reference image 1002 as a printed concentric circle target. When a concentric circle target is selected the user can also select from corresponding target heights. Standard concentric circle targets range from 6 inches to 36 inches.

FIG. 12I shows display 30 with the reference image 1002 as a relative target icon 1120, which is indicated as 20" target by the target type indicator 1048. In this example, the relative aiming point 1000 is shown a few inches above the relative target icon 1120 which corresponds to the aiming point at 346 yards (as shown in the a horizontal distance indicator 914) for the specific firearm, and the target in the cross hairs 900.

Aiming Point Relative to Enlarged Target Display

Figure 13:
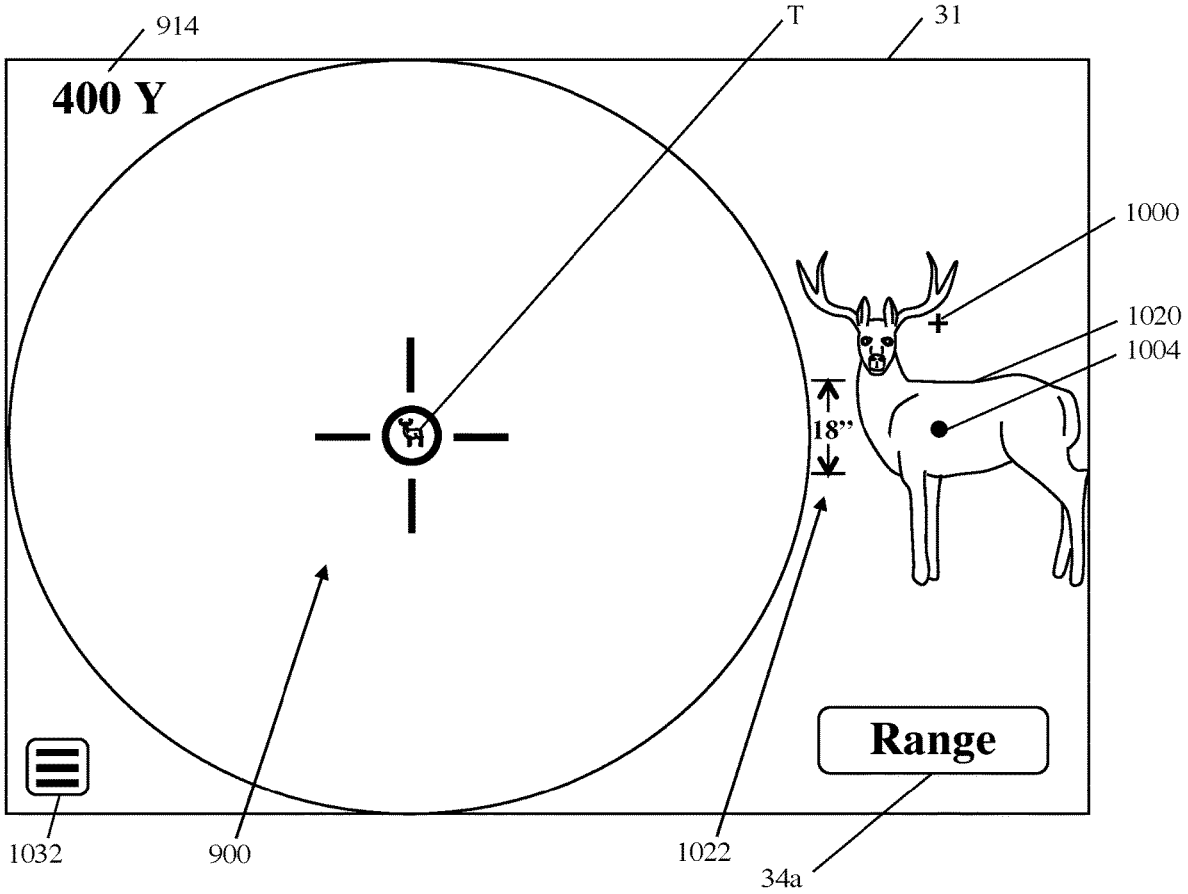
FIG. 13 illustrates a digital display showing a relative aiming point relative to an enlarged target image.

FIG. 13 illustrates a digital display 31 showing a relative aiming point 1000 relative to an enlarged target image 1020.

FIG. 13 illustrates a digital display 31 showing an embodiment of a relative aiming point 1000 shown relative to a reference of a predetermine size. The digital display 31 shows cross hairs 900 (shown here with a center circle) which are placed on the target T. The digital display 31 dynamically shows that the horizontal range is four hundred yards in a horizontal distance indicator 914.

In this embodiment, the reference is shown as an enlarged target image 1020. The enlarged target image 1020 is separate and distinct display element from the target T. When the target T is ranged, a digital snapshot is taken of the target T. The line of sight distance to the target T is known and thus can be enlarged to provide a reference of a predetermined size. The digital device 10 can optionally measure the chest height from the belly to the top of the back, and display the chest height in reference measurement 1022.

This embodiment also shows reference target 1004 placed in the reference image 1002.

The user 100 can range the target by tapping anywhere on a touch screen. Alternatively the user can click a physical button on the device or an optional virtual button on the screen such as the range button identified as input 34*a*.

The operation is similar to the operation of the display as described in reference to FIG. 8A, with the reference image 1002 being the enlarged target image 1020, and the optional calculation of the actual reference height.

The digital display 31 also provides an input to enter set up mode, i.e. a virtual settings control 1032 buttons. When the input is selected the device enters setup mode (see FIG. 15).

Aiming Point Relative to Zoomed Target Display

Figure 14A:
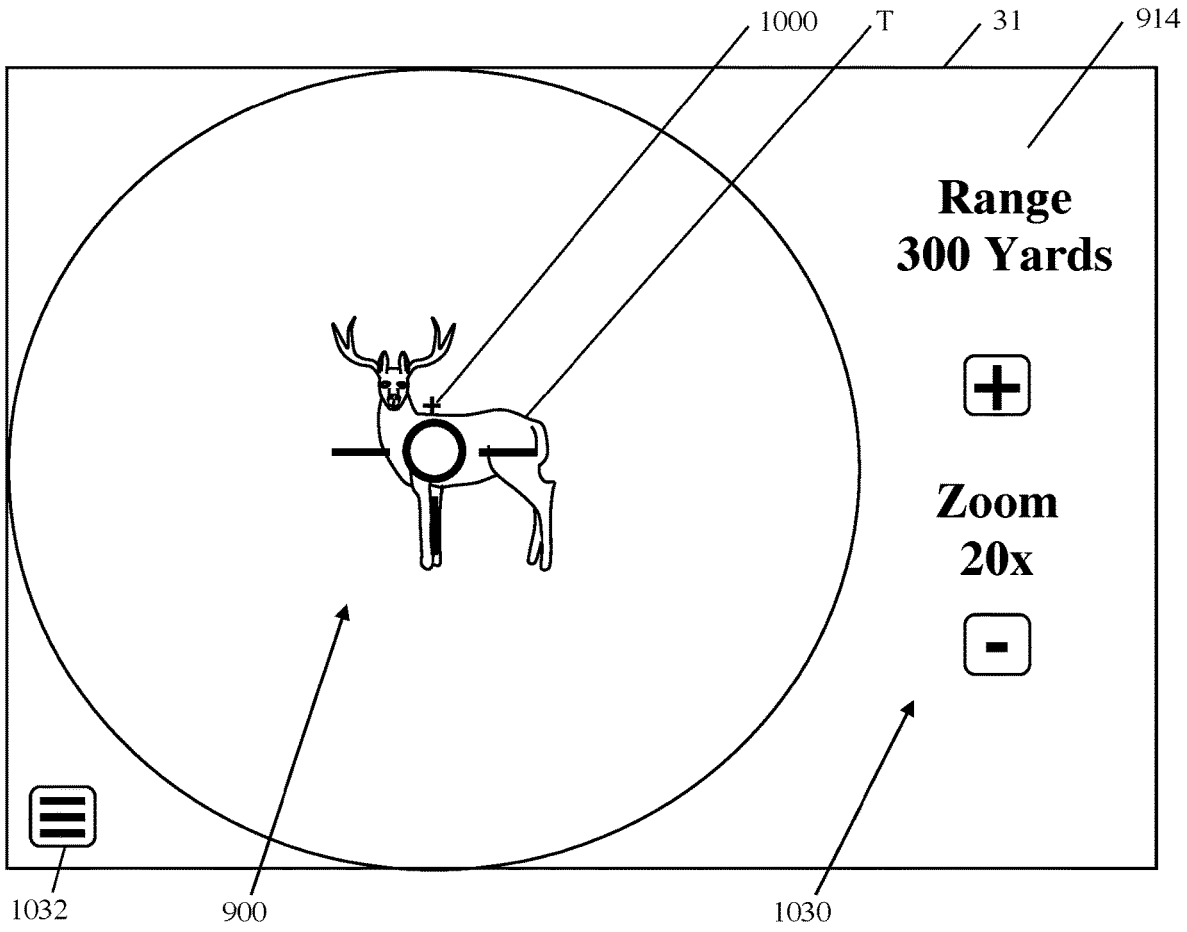
FIGS. 14A and 14B illustrate embodiments of digital displays showing relative aiming point relative to an zoomed target image, and zoom controls.
Figure 14B:
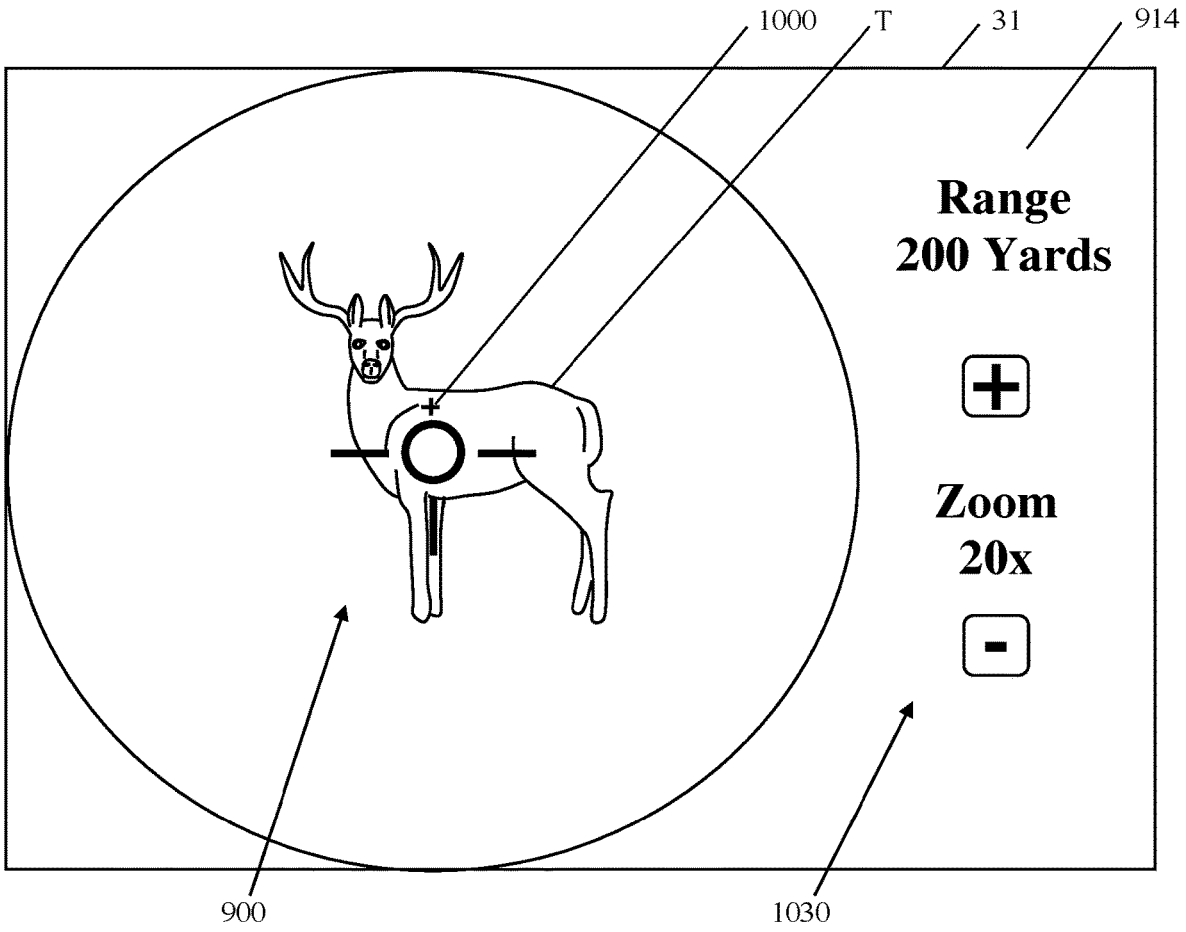

FIGS. 14A and 14B illustrate embodiments of digital displays 31 showing relative aiming points 1000 relative to an zoomed target image, and zoom controls 1030.

FIG. 14A illustrates a digital display 31 showing a relative aiming point 1000 relative to an zoomed target T image.

FIG. 14A illustrates a digital display 31 showing an embodiment of a relative aiming point 1000 shown relative to a reference of a predetermine size. The digital display 31 shows cross hairs 900 (shown here with a center circle) which are placed on the target T. The digital display 31 dynamically shows that the horizontal range is three hundred yards in a horizontal distance indicator 914.

In this embodiment, the reference is shown as a zoomed image of the target T. There is not separate reference.

The digital display includes a zoom control 1030 which allows the user 100 to zoom in and zoom out, and which displays the current zoom factor, e.g. 20×.

The user 100 can range the target by tapping anywhere on a touch screen (except in the zoom control). Alternatively the user can click a physical button on the device or a virtual button on the screen (not shown).

The operation is similar to the operation of the display as described in reference to FIG. 8A, with the reference image 1002 being the zoomed image of target T.

The digital display 31 also provides an input to enter set up mode, i.e. a virtual settings control 1032 buttons. When the input is selected the device enters setup mode (see FIG. 15).

FIG. 14B shows the same embodiment as FIG. 14A where the target T is ranged at 200 yards. Notice that the deer appears larger at the same zoom factor because it is closer. The relative aiming point 1000 is relative lower than in the 300 yard example of FIG. 14A. In this example, the relative aiming point 1000 is below the deer's back.

Settings and Calibration Related to Relative Aiming Point Embodiments

Various settings have been discussed above.

Figure 15:
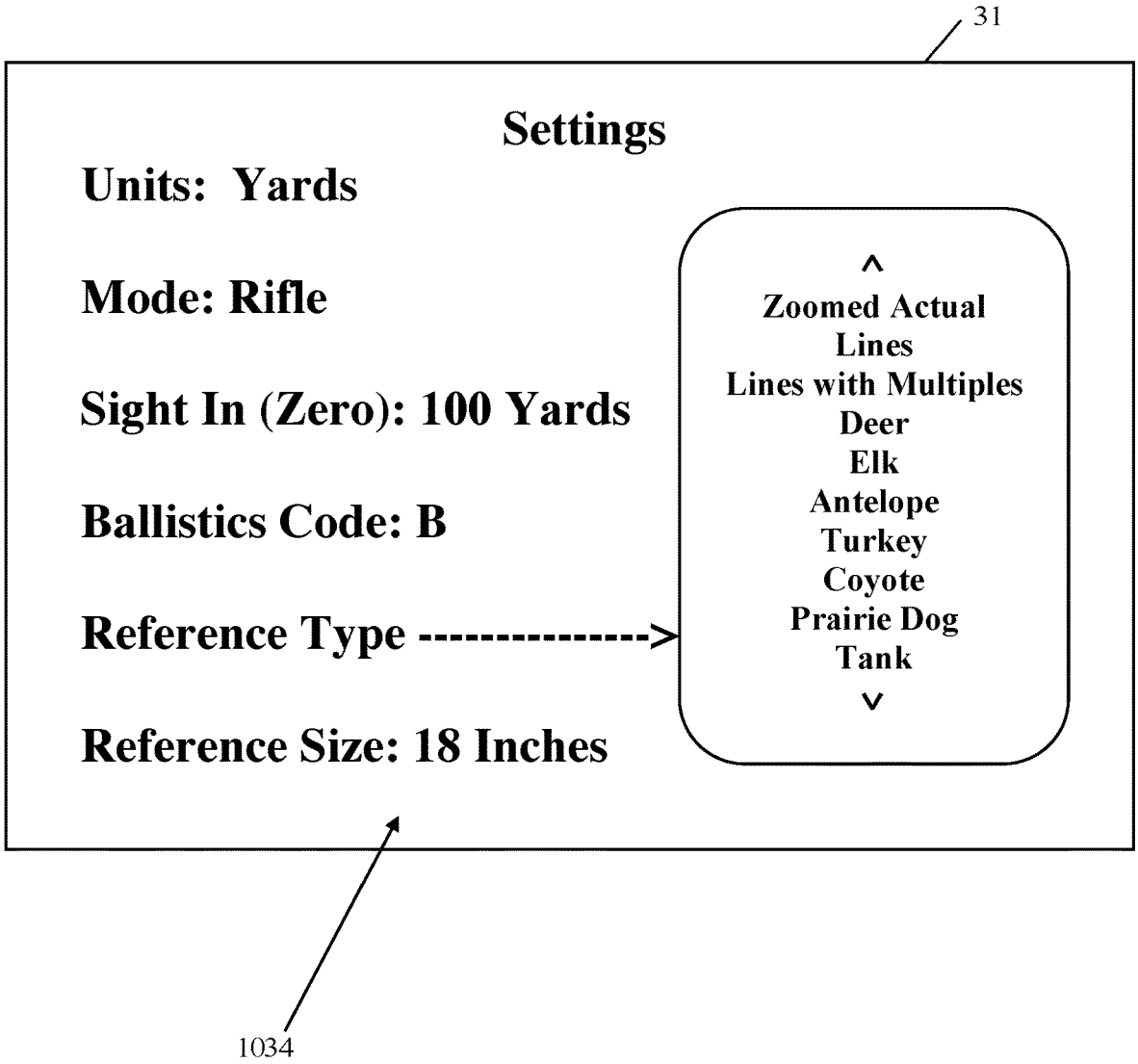
FIG. 15 illustrates a digital embodiment of a display showing various settings.

FIG. 15 illustrates a digital embodiment of a display showing various settings 1034.

Settings for units (i.e. yards or meters) and mode (bow or rifle) are well known as discussed above.

In some embodiments, the device 10 can be simplified by assuming that sight or scope is zeroed at 100 yards. In more complex embodiments (such as the one shown), the user can calibrate the device 10 to the sight or scope by setting a "zero at" or "sight in" setting.

In one embodiment, the user would enter a ballistics code that indicates the characteristics of a specific ammunition and firing device. In rifle mode, the ballistics code is used to determine the projectile trajectory 2. Alternatively, the user enters the bullet drop, for example, in inches, at the "sight in" (or "zero at") distance.

In the currently preferred embodiment, the user does not enter a ballistic code or a bullet drop directly, but uses the novel real calibration processes using a relative target as described below in reference to FIG. 16A through FIG. 22F.

The reference type can also be set in settings. The exemplary embodiment shown in FIG. 15 shows the current setting as reference type and the choices include zoomed actual (e.g. FIGS. 14A and 14B), lines (e.g. FIG. 8B), lines with multiples (e.g. FIG. 8D), deer (e.g. FIG. 12A), elk (e.g. FIG. 12B), antelope (e.g. FIG. 12C), turkey (e.g. FIG. 12D), coyote, prairie dog (e.g. FIG. 12E), tank (e.g. FIG. 12G), and others not visualized but accessible by selecting the scroll arrows at the top or bottom of the list. Alternatively in a simpler embodiment having only reference lines or a generic reference, the reference type can be removed for the required settings.

Once the reference type is selected, then the reference size can also be selected from corresponding ranges of sizes (as discussed above in relations to FIGS. 12A through 12I).

A digital display 31 provides a more robust interface as shown in FIG. 15. However, the same settings can be made on a display 30 such as a display with LCD segments.

Relative Target

U.S. patent application Ser. No. 14/471,786 first showed the use of a specially printed target to calibrate a rangefinder to a user's specific bow sight on a specific bow that was set to a specific type of arrow.

Figure 16A:
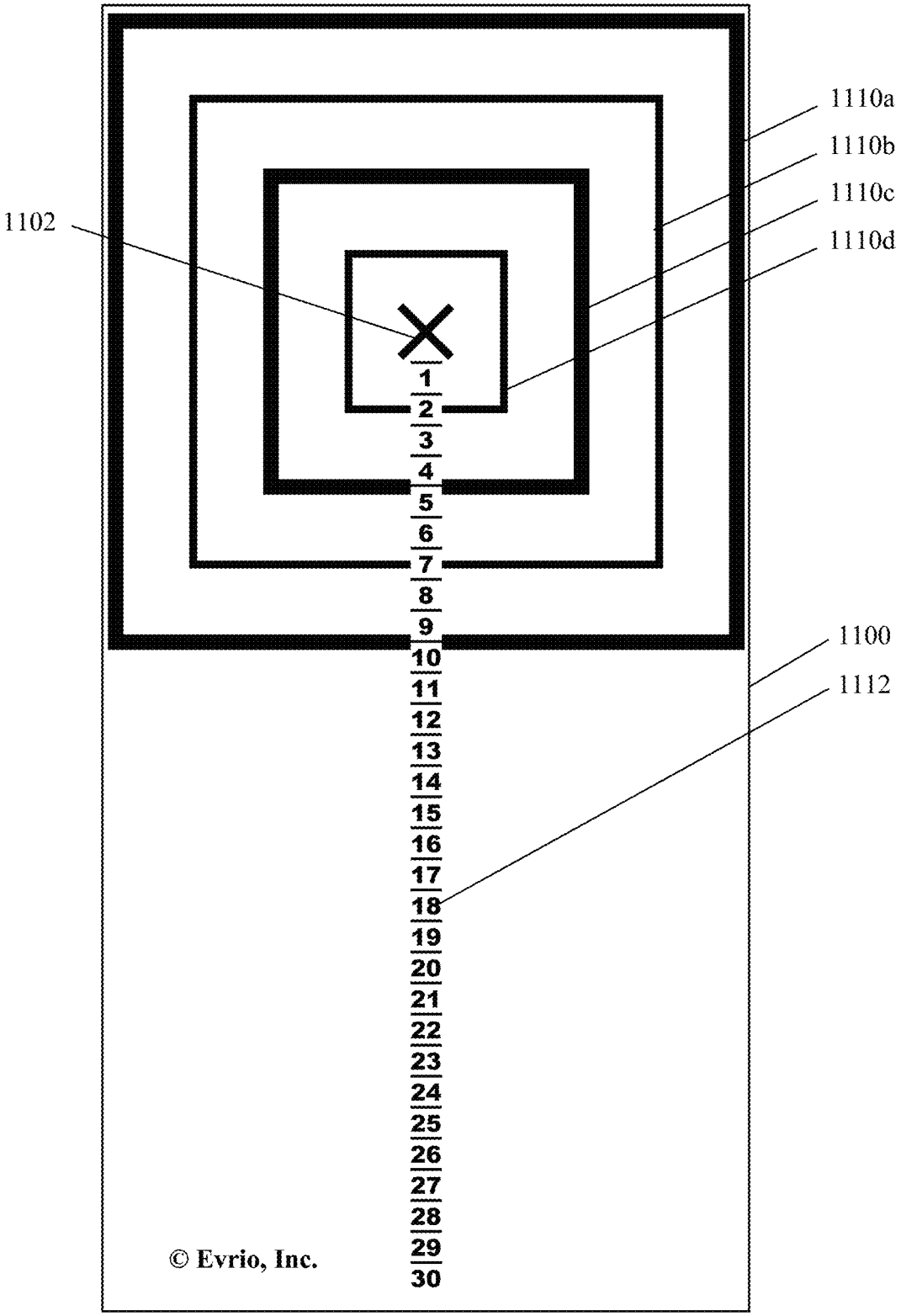
FIGS. 16A through 16C shows embodiments of a printed relative target.

FIG. 16A shows a novel relative target 1100 which can be used with a method aspect of this invention to calibrate a rangefinder device to any user's specific bow, crossbow, pistol, rifle or other firearm with a specific type of arrow or ammunition. The markings on the relative target 1100 comprise of four concentric squares 1110(*a-d*) having sides measuring 20 inches, 15 inches, 10 inches, and 5 inches, respectively, an "X" marking the target center 1102, and a measuring scale 1112 indicating the number of inches below the target center 1102.

Figure 16B:
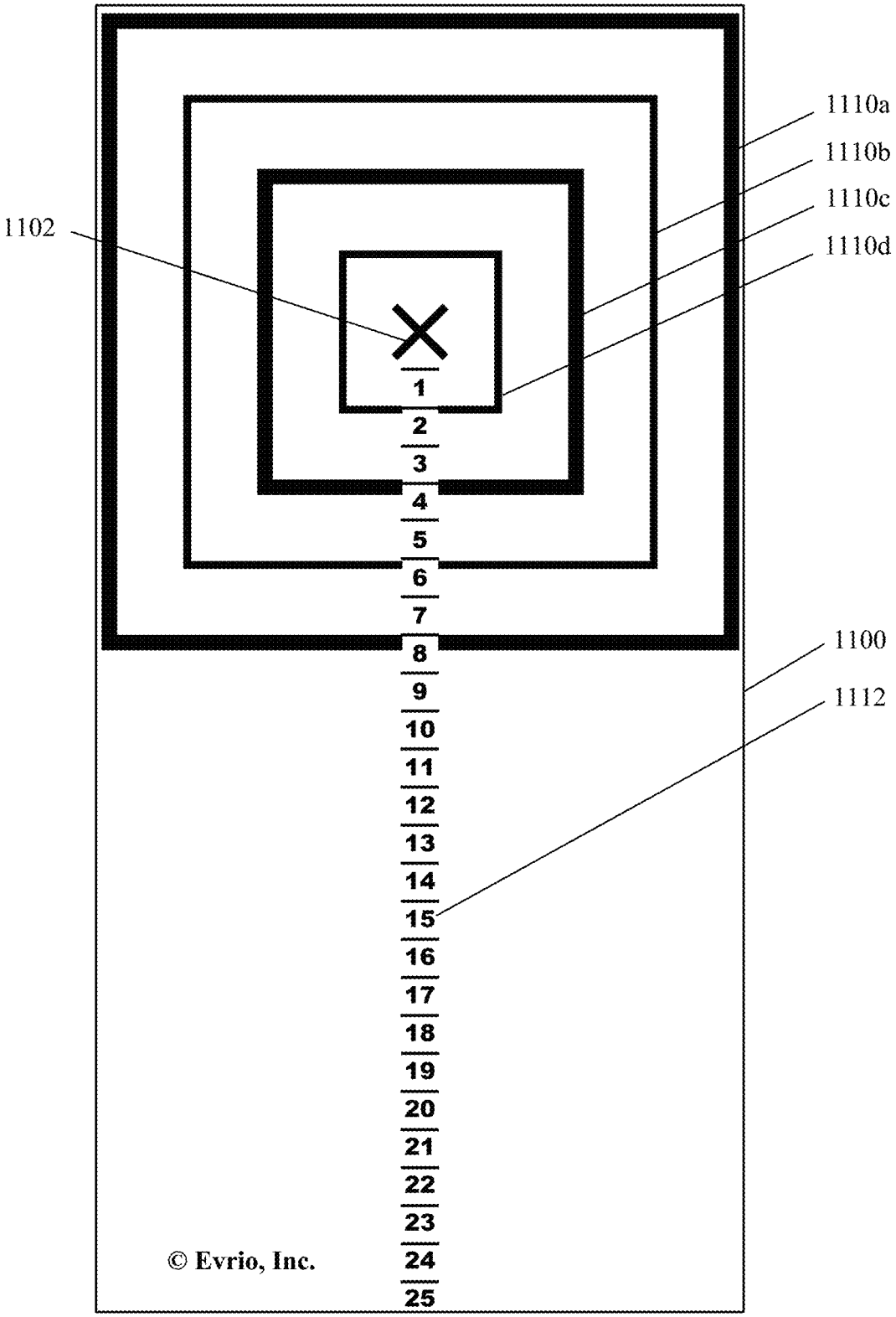

FIG. 16B shows a metric version of the relative target 1100 of FIG. 16A. The four concentric squares 1110(*a-d*) having sides measuring 50 cm, 37.5 cm, 25 cm, and 12.5 cm, respectively. In the metric embodiment measuring scale 1112 indicates the number of centimeters below target center 1102.

In the preferred embodiment, the metric version, as shown in FIG. 16B, which is slightly smaller that the Imperial inches version, as shown in FIG. 16A, is printed on the back of the inches version.

Figure 16C:
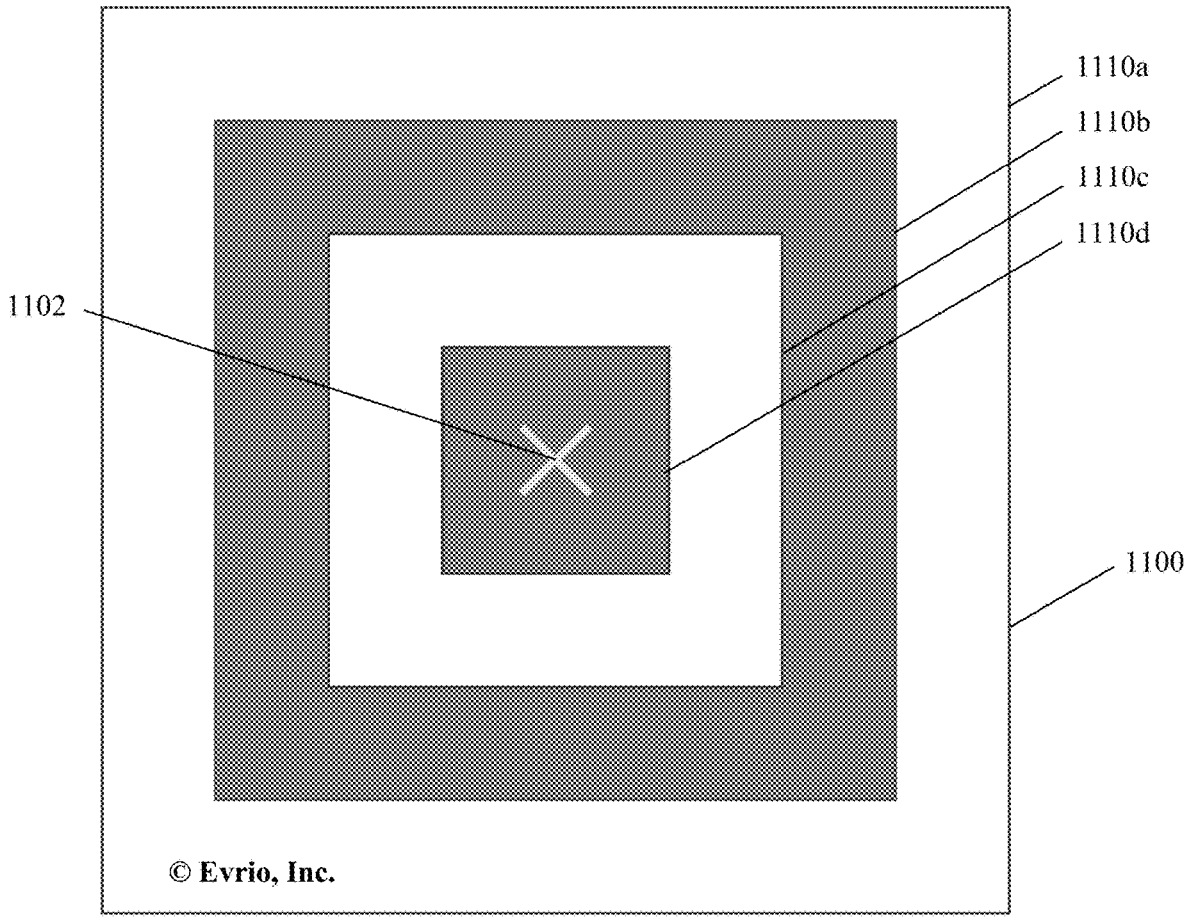

FIG. 16C shows an alternate version of the four concentric squares 1110(*a-d*) the relative target 1100 of FIG. 16A. The four concentric squares 1110(*a-d*) having sides measuring 20 inches, 15 inches, 10 inches, and 5 inches, respectively. This embodiment is preferred for very long range shooting, e.g. 1000 yards. Each band on the target is 2.5 inches wide and alternate dark (e.g. red) and white around the dark 5-inch center square 1110*d*. The outer band 1110*a* is white so that the four corners of the target 1100 will be seen around the scope's reticle cross hairs at distances over 500 yards.

Testing of an embodiment of this target worked well with a 6× riflescope where the four corners of the inner white band 1110*c* were visualized between the scope's heavy duplex cross hairs at 500 yards. At 500 yards, the crosshair intersection visually covers the 5-inch center square 1100*d*. With a 12× riflescope at 1000 yards, the target would be visualized the same way.

The relative target 1100 with this style of four concentric squares 1110(*a-d*) would have a scale 1112 as shown in FIG. 16A.

Calibration instructions 198 could also be printed on the lower half of the relative target 1100. The following sections will discusses examples of how the relative target 1100 is used to calibrate the range finding device 10.

Relative Target Preparation with a Specific Bow and Arrow

Figure 17A:
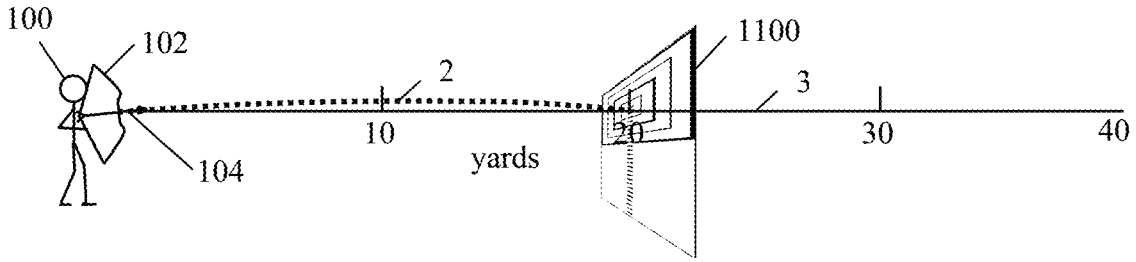
FIGS. 17A through 17D illustrates an example of preparation of a relative target with a specific bow and specific arrow.

FIGS. 17A through 17D illustrate the steps of the relative target preparation process with a bow. FIG. 17A shows a user 100 shooting an arrow 104 with a bow 102 at the relative target 1100 placed on a horizontal line of sight 3 at 20 yards. When the bow sight 110 20-yard pin 220 is set properly, the arrow 104 will hit the target center 1102 (not visible at this scale). The user 100 can shoot an arrow in the configuration shown in FIG. 17A to confirm that the 20-yard pin 220 is properly set for that specific bow 102 and that specific arrow 104. The projectile trajectory 2 is shown as a dashed line.

Figure 17B:
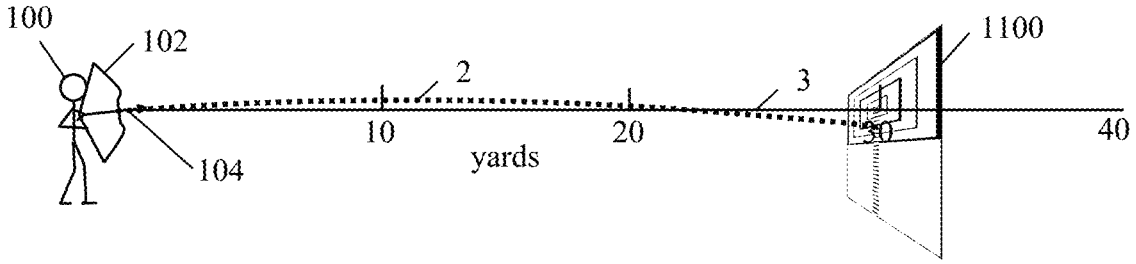

The next step, as shown in FIG. 17B is to move the relative target 1100 to 30 yards on the horizontal line of sight 3, and shoot the arrow 104 while aiming with the 20-yard pin 220 at the target center 1102. The arrow will follow the same projectile trajectory 2, but with the longer distance will hit the relative target 1100 at a lower point, in this example, with about a 4 inch drop, where the arrow will make a first shot mark 1130*a* (see FIG. 17D).

Figure 17C:
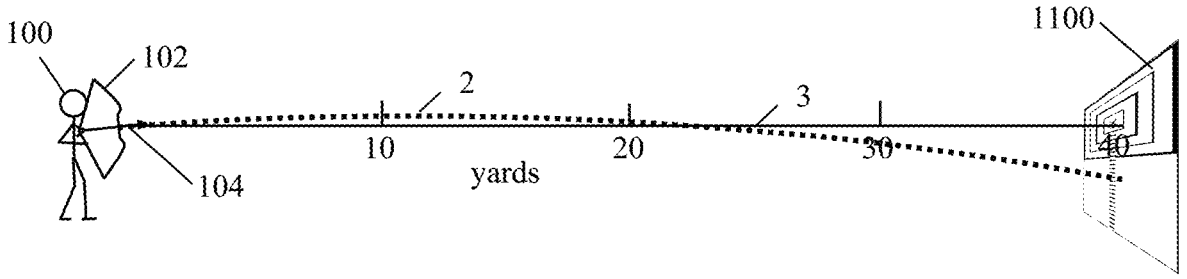

The next step, as shown in FIG. 17C is to move the relative target 1100 to 40 yards on horizontal line of sight 3, and shoot the arrow 104 while aiming with the 20-yard pin 220 at the target center 1102. The arrow will follow the same projectile trajectory 2, but with the even longer distance will hit the target at a lower point, in this example, with about a 12 inch drop, where the arrow will make a second shot mark 1130*b* (see FIG. 17D).

Figure 17D:
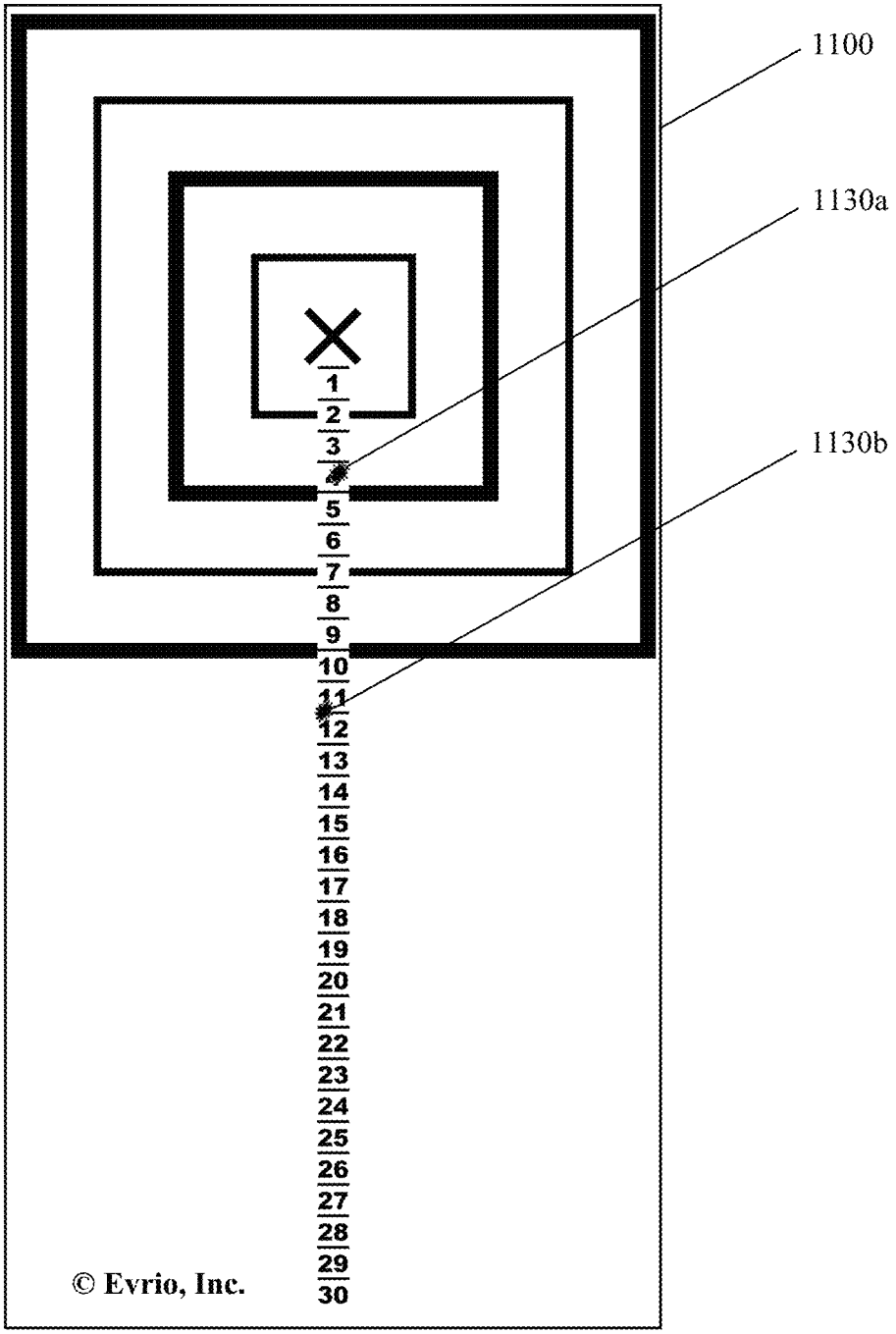

FIG. 17D illustrates the relative target 1100 showing the first shot mark 1130*a*, corresponding to the 30-yard shot, and the second shot mark 1130*b*, corresponding to the 40-yard shot.

Ballistic Calibration to a Specific Bow and Arrow

FIGS. 18A through 18F show the bow ballistic calibration process used to calibrate the device 10 to a specific bow and arrow. In these figures the display 30 corresponds to the currently preferred display element configuration as shown in FIG. 11D.

Figure 18A:
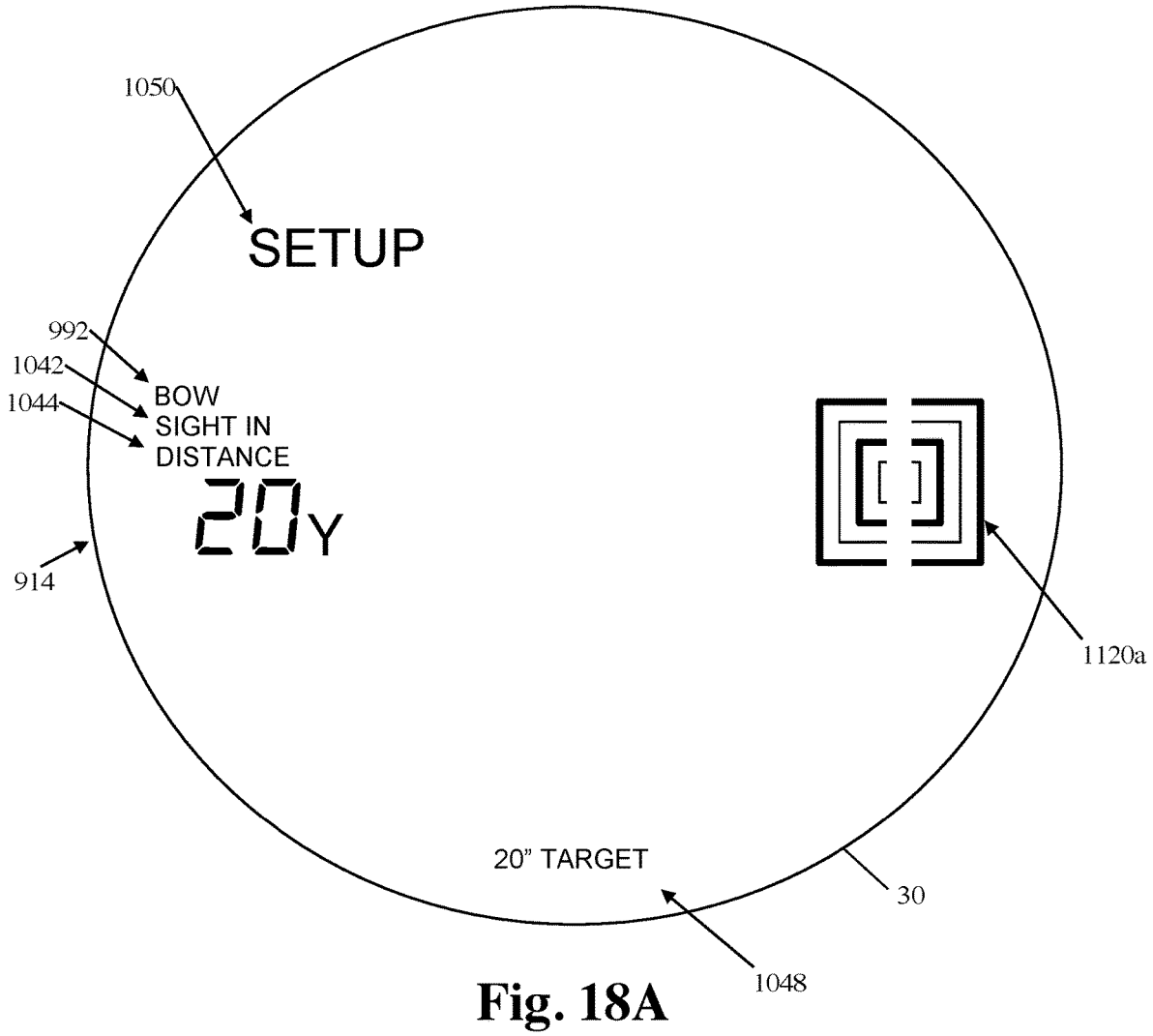
FIGS. 18A through 18F illustrates an example of calibrating a range finding device to a specific bow and specific arrow using a relative target icon aligned with a prepared relative target.

Initially, the rangefinder device 10 is put into setup mode and the yard or metric setting has been selected, in this example yard (or Imperial) mode, bow mode has been selected, and the 20" target reference icon has been selected. As shown in FIG. 18A, setup mode is indicated by selectively illuminating the setup indicator 1050. Bow mode is indicated by selectively illuminating the bow mode indicator 992. The yard mode is indicated be selectively illuminating the "Y" as the units in the horizontal distance indicator 914. The upper relative target icon 1120*a* is illuminated, and because the device 10 is in yard mode, the '20" Target' target type indicator 1048 is illuminated.

Next, as shown in FIG. 18A, the bow sight in distance of 20 yards is displayed in the display 30. In the preferred embodiment, the "Sight In" indicator 1042, "Distance" text 1044, and the "20 Y" horizontal distance indicator 914 would be flashing indicating that the bow sight in distance is currently being set. The user can accept 20-yards or cycle through a preset sequence, such as 20, 30, 40.

Figure 18B:
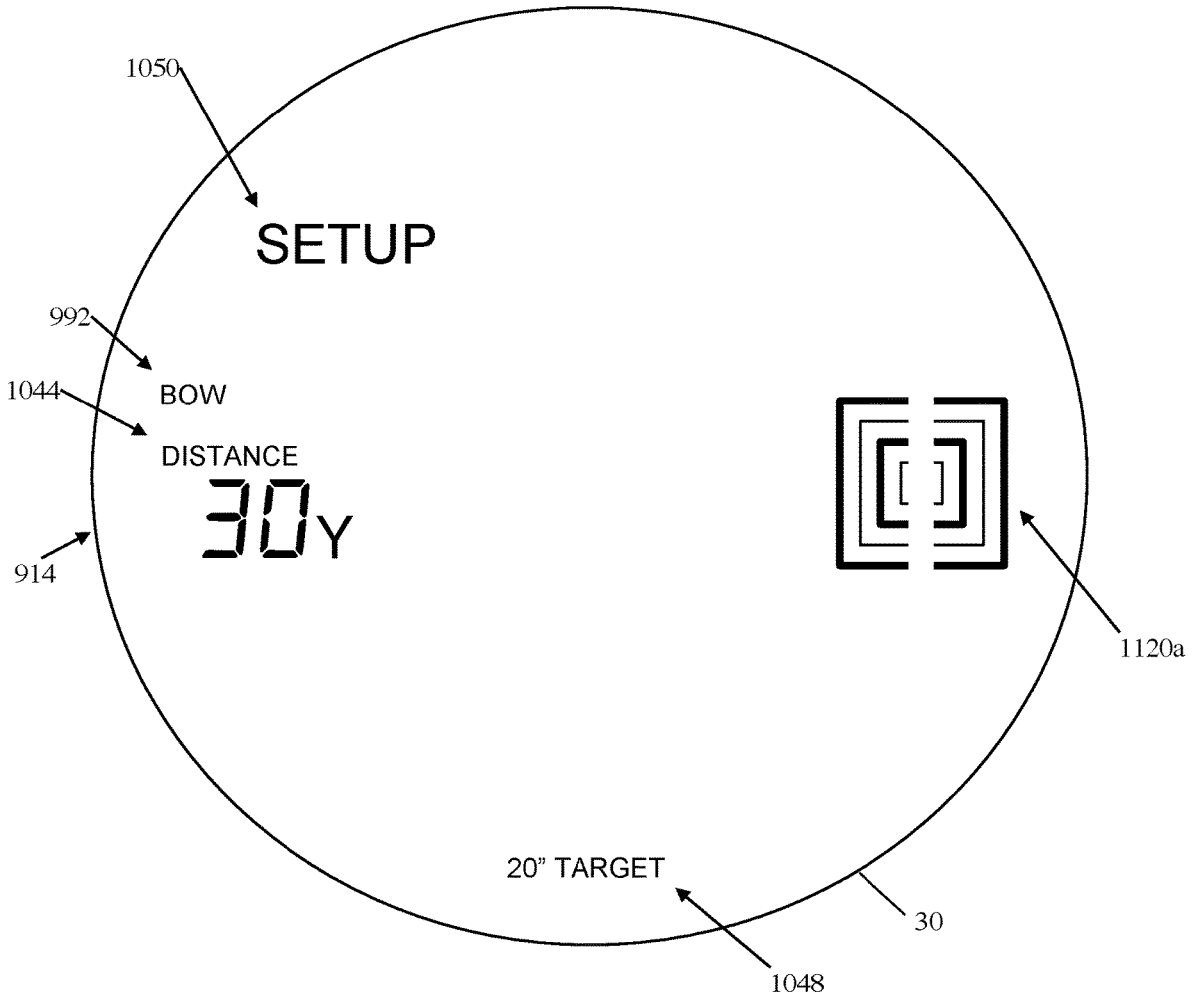

Next as shown in FIG. 18B the words "Sight In" 1042 disappear and the word "Distance" 1044 continues to flash. If 20 were selected as the Sight In distance, the user can sequence through 30, 40, 50, 60 to select the first distance mark. In this case the user selects 30.

Figure 18C:
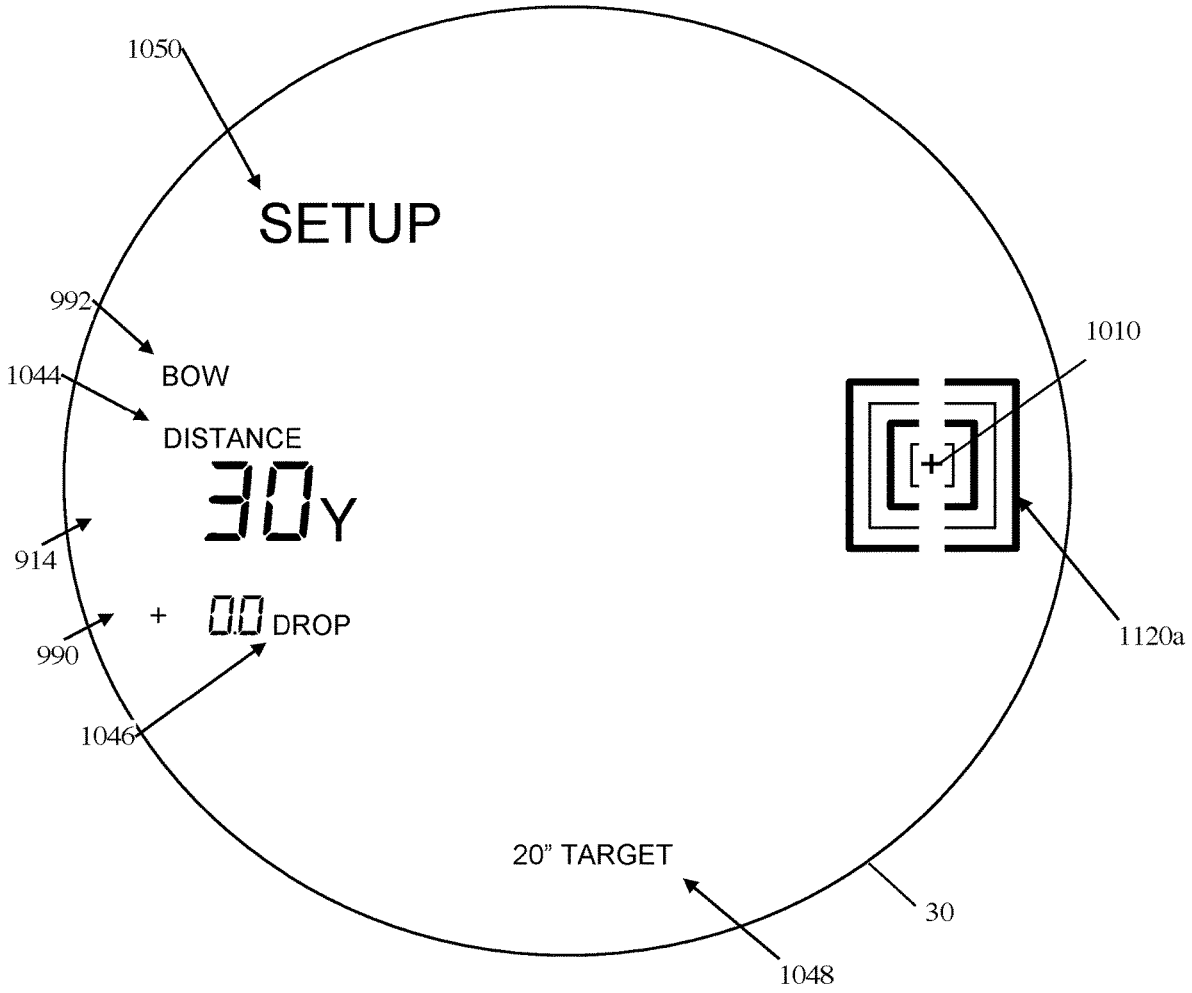

Next, after the 30-yard distance is selected and confirmed as shown in FIG. 18C, "Distance" 1044 stops flashing, and one of the aiming point indicators 1010 and the word "Drop" start to flash.

Figure 18D:
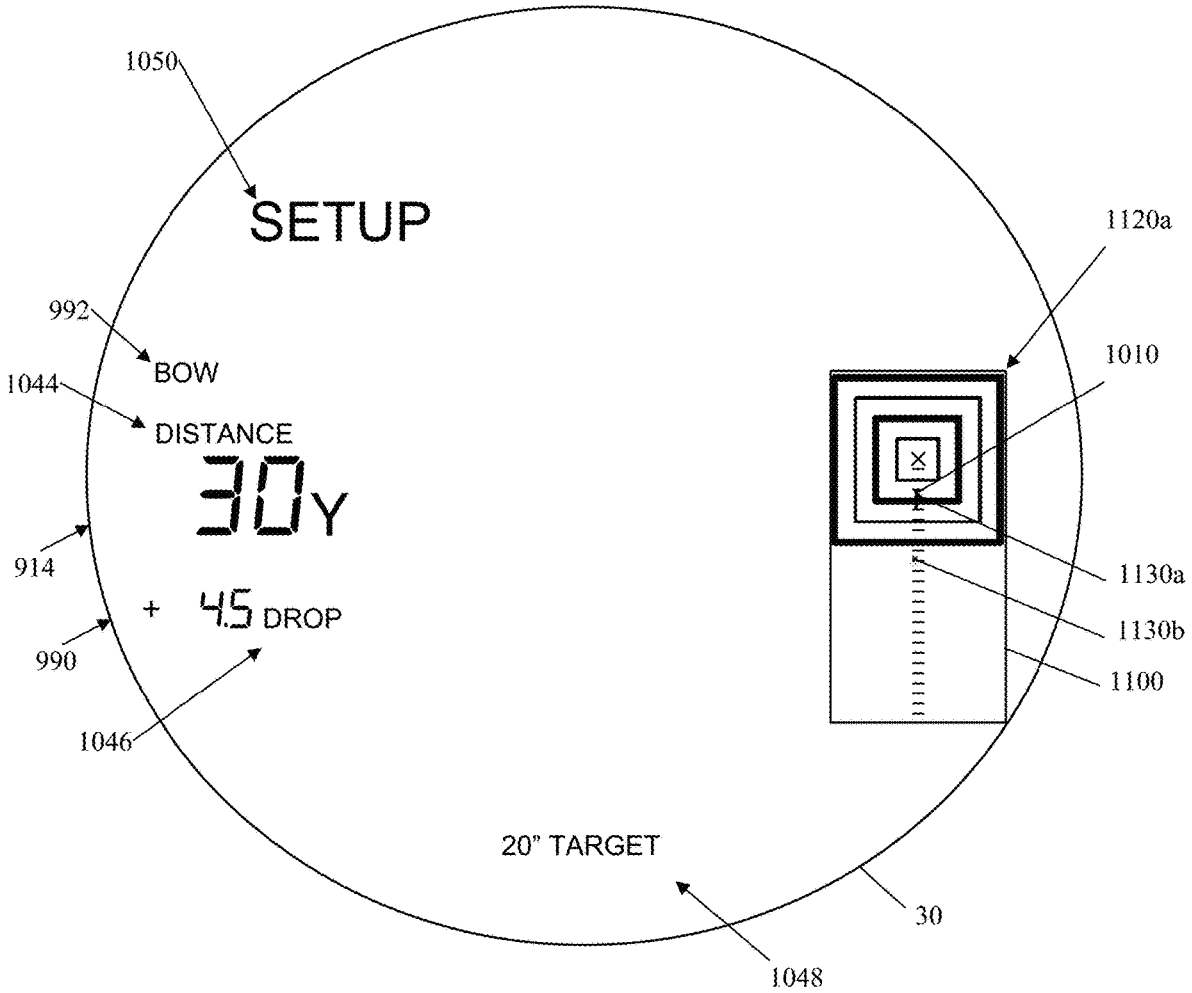

At this point, the user aims the device 10 to view the prepared relative target 1100, as shown in FIG. 17D. As shown in FIG. 18D, the user matches the visualized image of the relative target 1100 to the relative target icon 1120 shown in the display. This is done by hanging the relative target 1100 at eye level and positioning the device 10 at a distance such that the size of the relative target icon 1120 matches the visualized size of the relative target 1100 through the optics of the device 10. Each time the user hits a button, the flashing aiming point indicator 1010 moves down one location. The user moves the flashing aiming point indicator 1010 down until it visually matches the first shot mark 1130*a*. For each location, the corresponding drop amount is displayed (e.g. 4.5 inches).

Figure 18E:
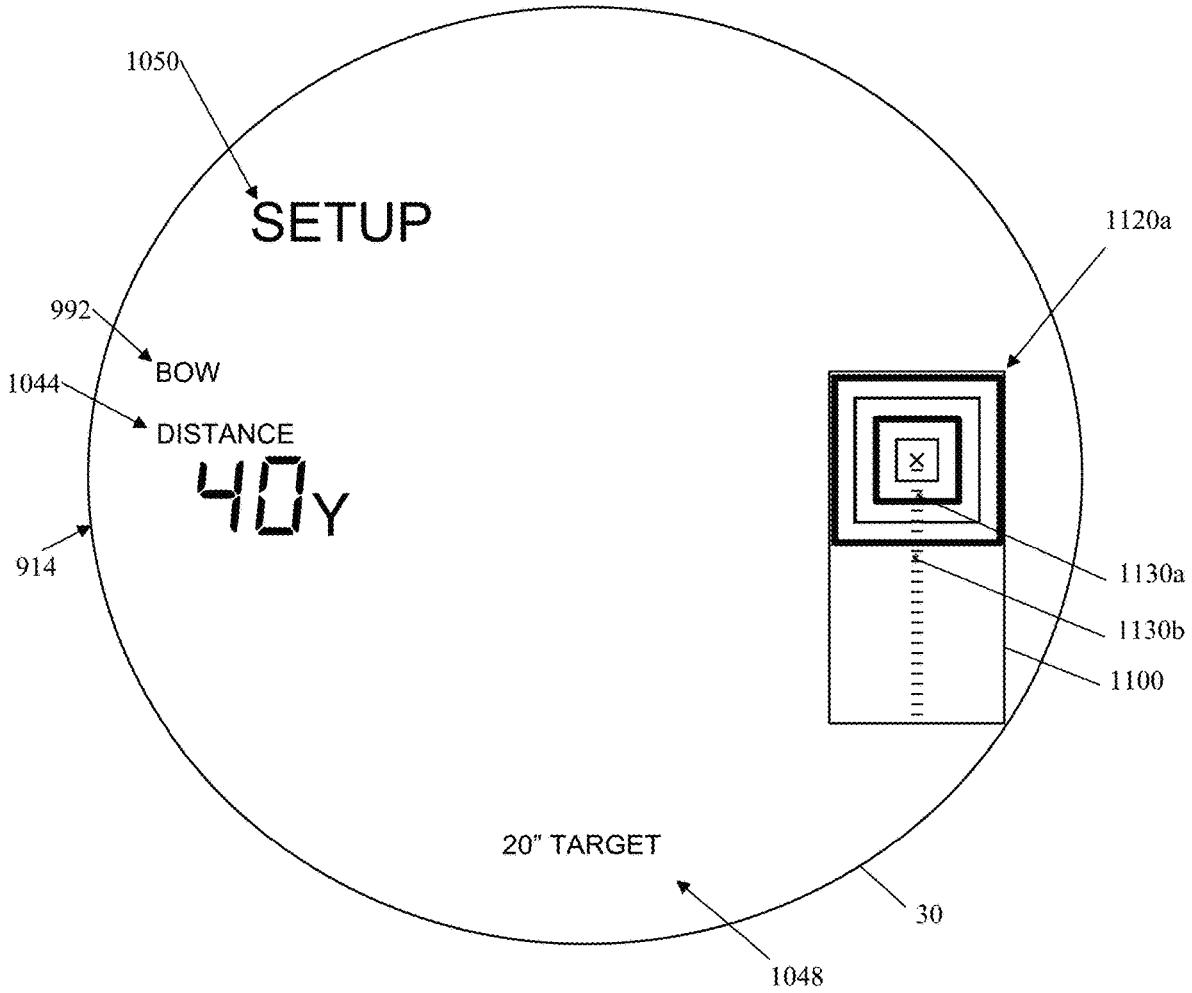

Next, after the 30-yard shot mark 1130*a* is matched and confirmed, as shown in FIG. 18E the words the word "Distance" 1044 flashes again. If 20 was selected as the Sight In distance, and 30 was selected as the first distance mark, the user can continue to sequence through 40, 50, 60 to select the second distance mark. In this case, the user selects 40.

Figure 18F:
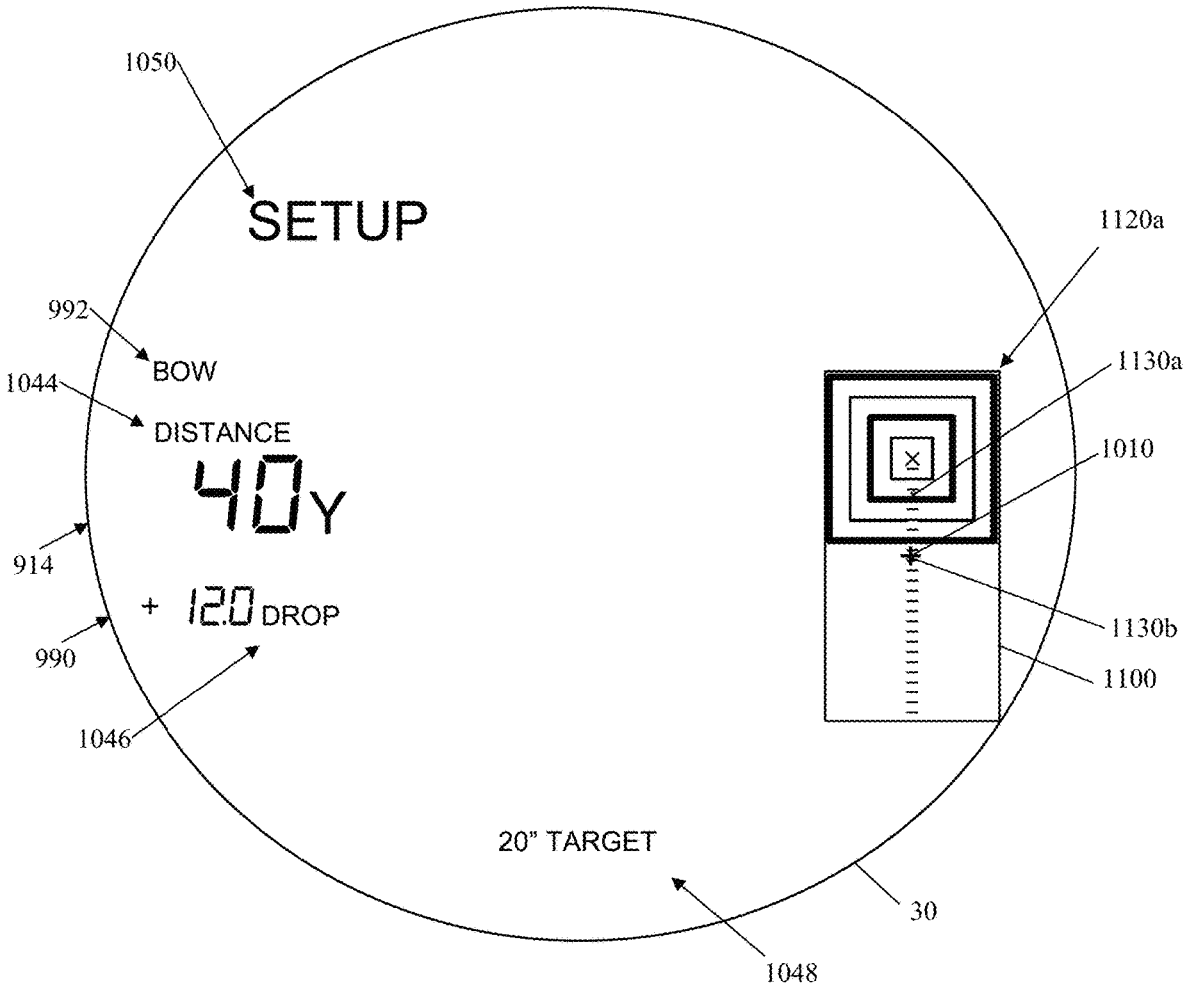

Next, after the 40-yard distance is selected and confirmed as shown in FIG. 18F, "Distance" 1044 stops flashing, and one of the aiming point indicators 1010 and the word "Drop" start to flash.

The user moves the flashing aiming point indicator 1010 down until it visually matches the second shot mark 1130*b*. At this point, the drop amount will show 12 inches.

At this point, three sets of values have been entered during the configuration process: 1) the sight in or zero at distance (e.g. 20 Y), 2) the first shot mark 1130*a* distance and visual drop (e.g. 30 Y and 4.5 inches), and 3) the second shot mark 1130*b* distance and visual drop (e.g. 40 Y and 12 inches). These three points are then used with the starting coordinate of (0,0) to determine a real projectile trajectory 2 which would be generally parabolic and adjusted for the real characteristics of the specific bow 102, specific arrow 104, the archer 100, and the environmental conditions such as altitude, humidity, air density, and their impact on the arrow's trajectory. This real calibration is superior to selection of a ballistic curve from a finite set of predetermined curves.

Relative Target Preparation with a Specific Rifle and Ammunition

Figure 19A:
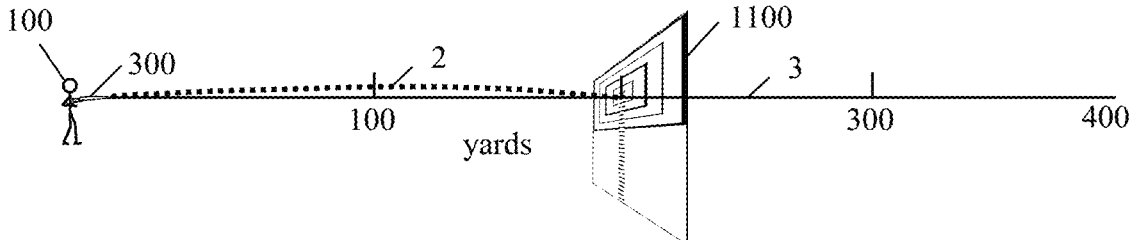
FIGS. 19A through 19D illustrates an example of preparation of a relative target with a specific rifle and specific ammunition.

FIGS. 19A through 19D illustrate the steps of the relative target preparation process with a specific rifle and specific ammunition. FIG. 19A shows a user 100 shooting a rifle 300 at the relative target 1100 placed on a horizontal line of sight 3 at 200 yards. When the riflescope is zeroed at, or sighted in at, 200 yards, the bullet will hit the target center 1102 (not visible at this scale). The user 100 can shoot a bullet in the configuration shown in FIG. 19A to confirm that the rifle scope is properly sighted in or zeroed for that specific rifle 300 and that specific ammunition. The projectile trajectory 2 is shown as a dashed line.

Figure 19B:
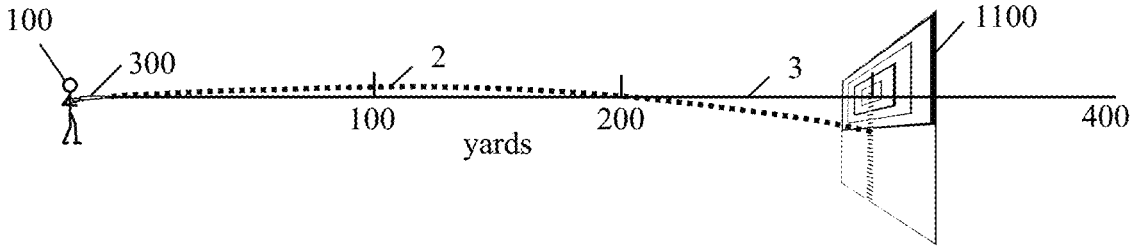

The next step, as shown in FIG. 19B is to move the relative target 1100 to 300 yards on the horizontal line of sight 3, and shoot the rifle 300 while aiming with the riflescope at the target center 1102. The bullet will follow the same projectile trajectory 2, but with the longer distance will hit the relative target 1100 at a lower point, in this example, with about an 8 inch drop, where the bullet will make a first shot mark 1130*a* (see FIG. 19D).

Figure 19C:
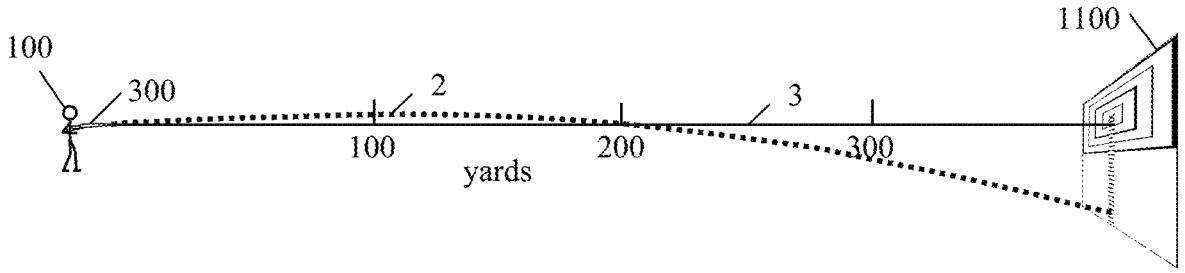

The next step, as shown in FIG. 19C is to move the relative target 1100 to 400 yards on horizontal line of sight 3, and shoot the rifle 300 while aiming with the riflescope at the target center 1102. The bullet will follow the same projectile trajectory 2, but with the even longer distance will hit the target at a lower point, in this example, with about a 19 inch drop, where the bullet will make a second shot mark 1130*b* (see FIG. 19D).

Figure 19D:
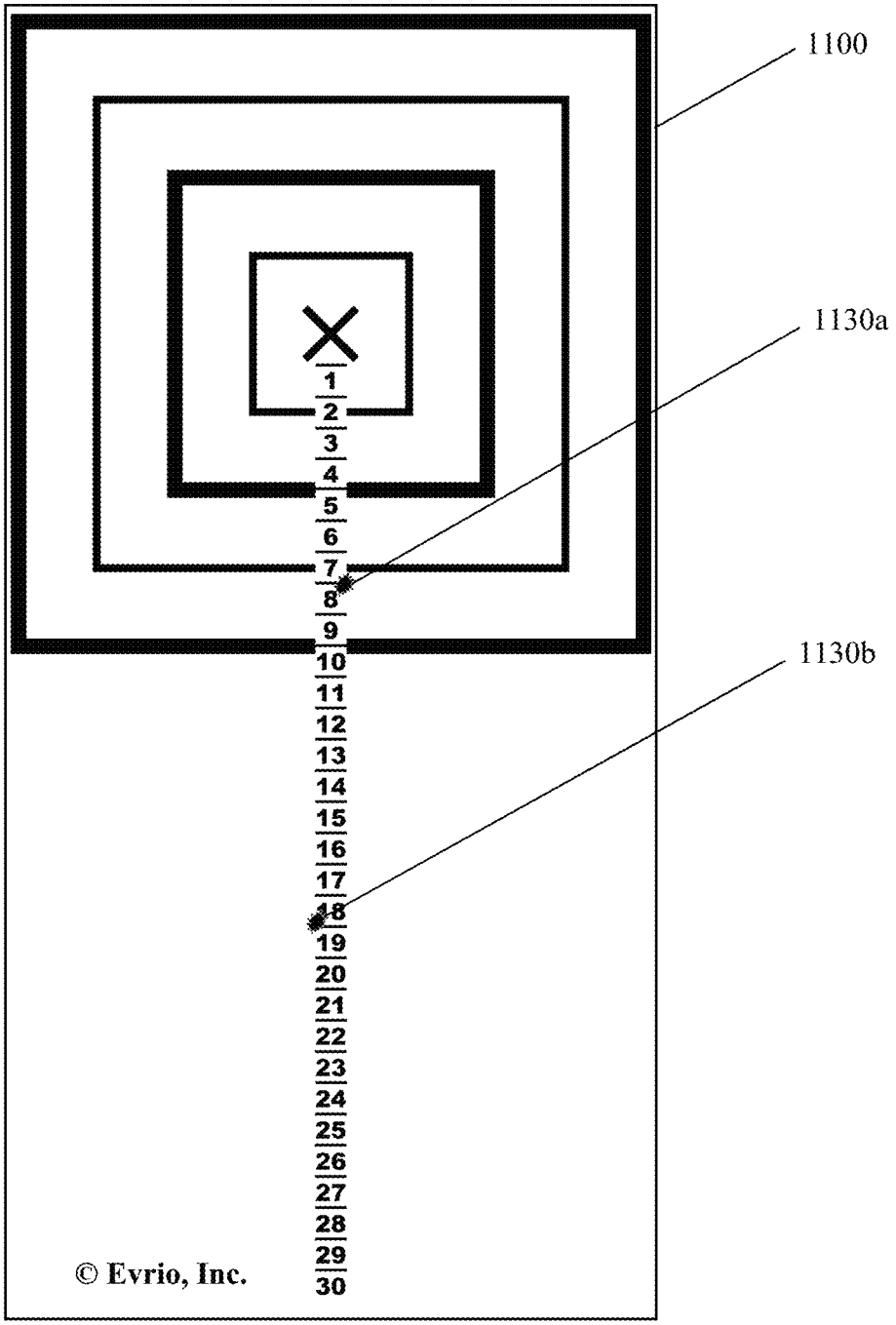

FIG. 19D illustrates the relative target 1100 showing the first shot mark 1130*a*, corresponding to the 300-yard shot, and the second shot mark 1130*b*, corresponding to the 400-yard shot.

Ballistic Calibration to a Specific Rifle and Ammunition

FIGS. 20A through 20F show the rifle ballistic calibration process used to calibrate the device 10 to a specific rifle and specific ammunition. In these figures the display 30 corresponds to the currently preferred display element configurations as shown in FIG. 11C or FIG. 11D.

Figure 20A:
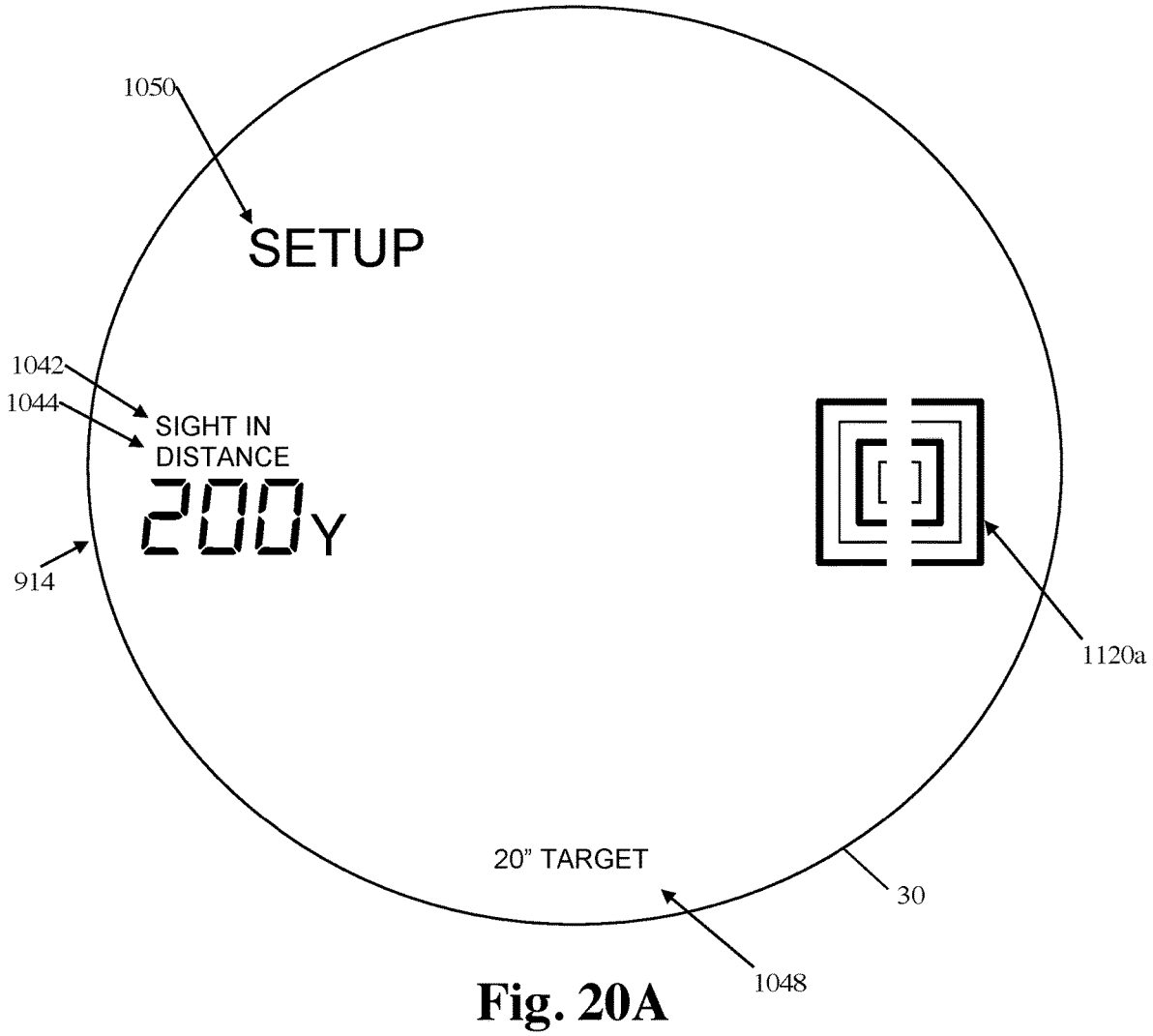
FIGS. 20A through 20F illustrates an example of calibrating a range finding device to a specific rifle and specific ammunition using a relative target icon aligned with a prepared relative target.

Initially, the rangefinder device 10 is put into setup mode and the yard or metric setting has been selected, in this example yard (or Imperial) mode, rifle mode has been selected, and the 20" target reference icon has been selected. As shown in FIG. 20A, setup mode is indicated by selectively illuminating the setup indicator 1050. The yard mode is indicated be selectively illuminating the "Y" as the units in the horizontal distance indicator 914. The upper relative target icon 1120*a* is illuminated, and because the device 10 is in yard mode, the '20" Target' target type indicator 1048 is illuminated.

Next, as shown in FIG. 20A, the sight in distance of 100 yards is displayed in the display 30. In the preferred embodiment, the "Sight In" indicator 1042, "Distance" text 1044, and the "50 Y" horizontal distance indicator 914 would be flashing indicating that the sight in distance is currently being set. The user can accept 50-yards or cycle through a preset sequence, such as 100, 150, 200, 250. The user selects 200 yards sight in distance.

Figure 20B:
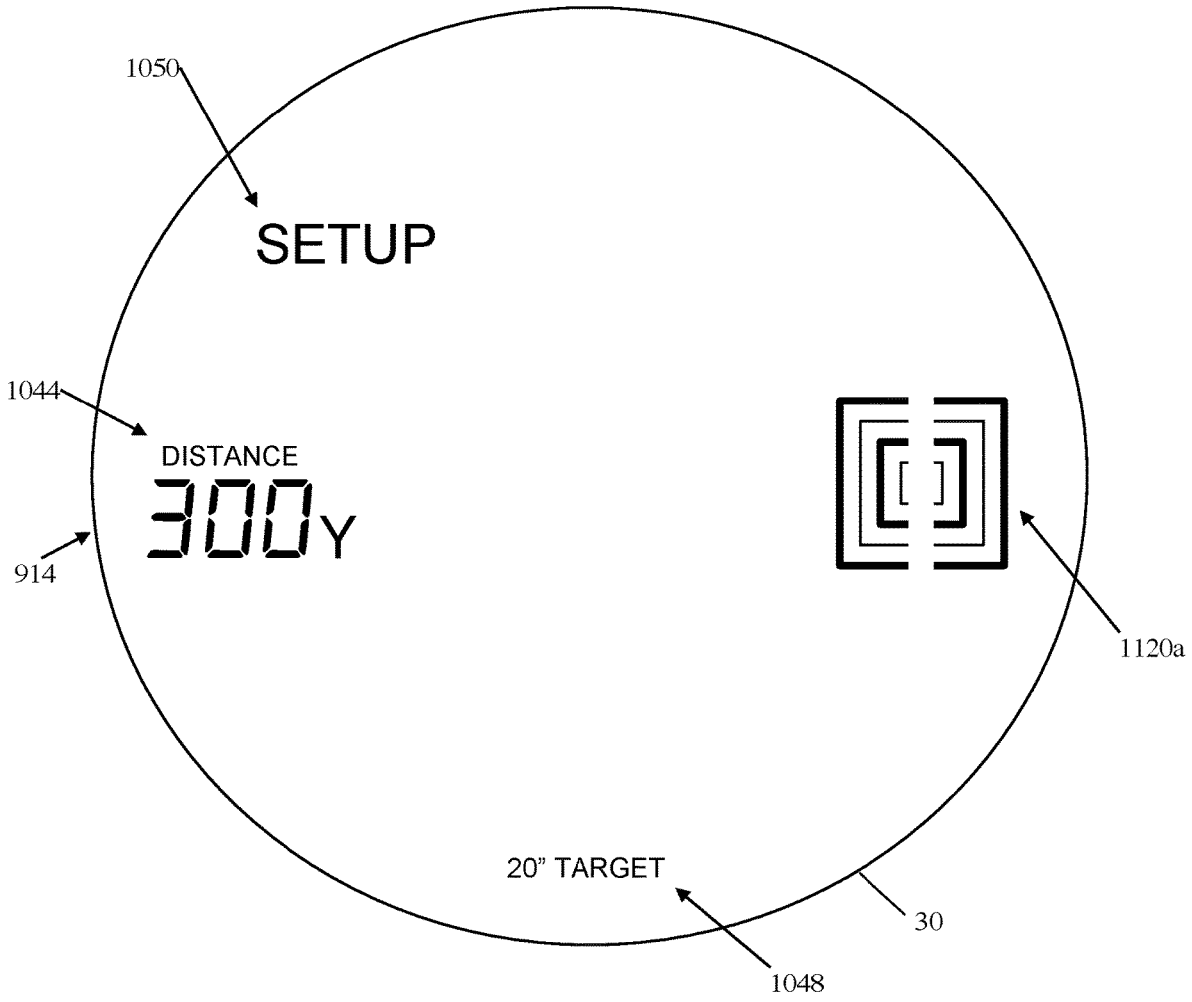

Next as shown in FIG. 20B the words "Sight In" 1042 disappear and the word "Distance" 1044 continues to flash. If 200 were selected as the Sight In distance, the user can sequence through 100, 150, 250, 300, 350, 400 to select the first distance mark. In this case the user selects 300.

Figure 20C:
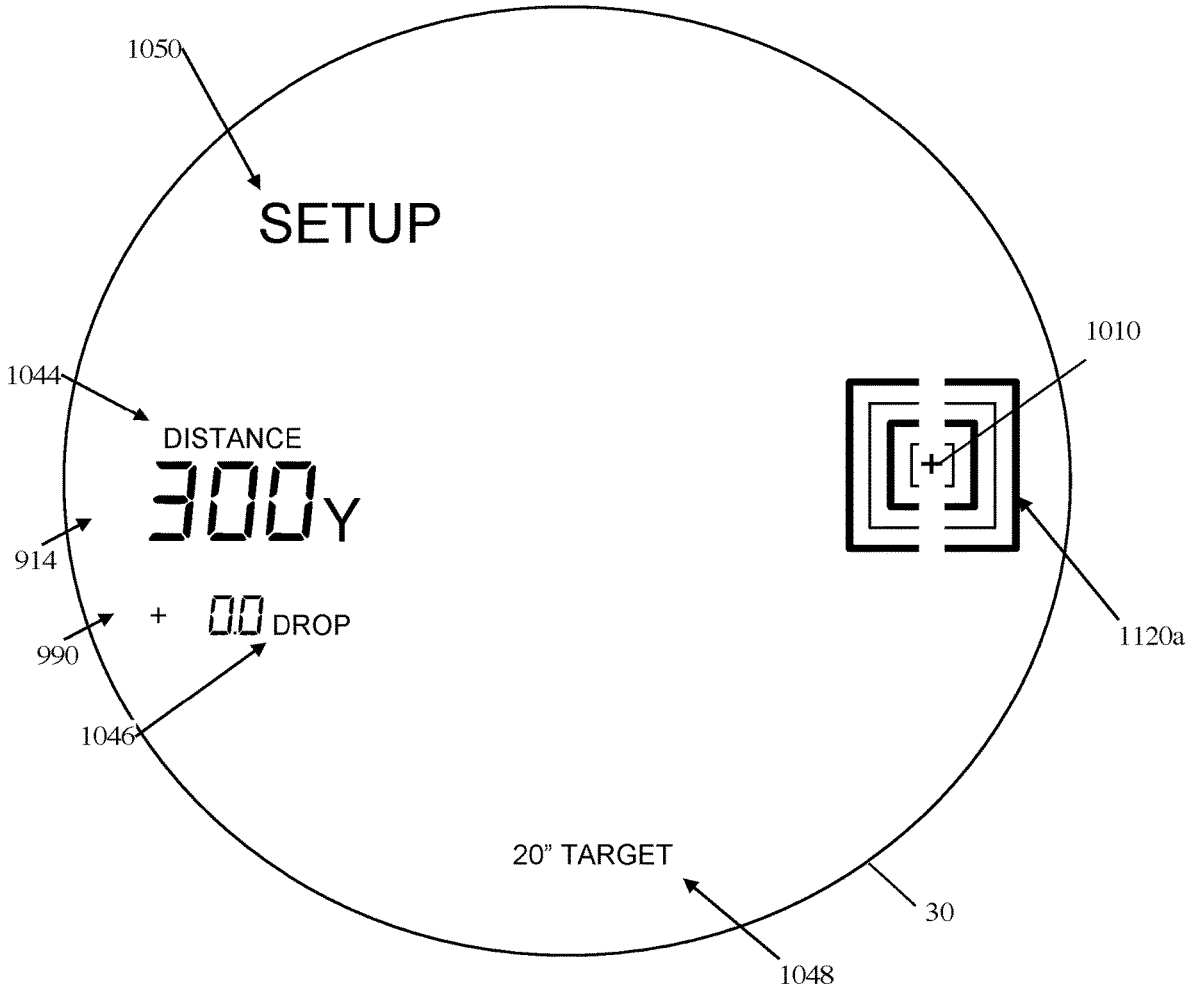

Next, after the 300-yard distance is selected and confirmed as shown in FIG. 20C, "Distance" 1044 stops flashing, and one of the aiming point indicators 1010 and the word "Drop" start to flash. In this example, because the current distance is 300 yards, which is greater than the sight in distance of 200 yards, the one of the plurality of aiming point indicators 1010 that corresponds to the target center 102 will be flashing.

Figure 20D:
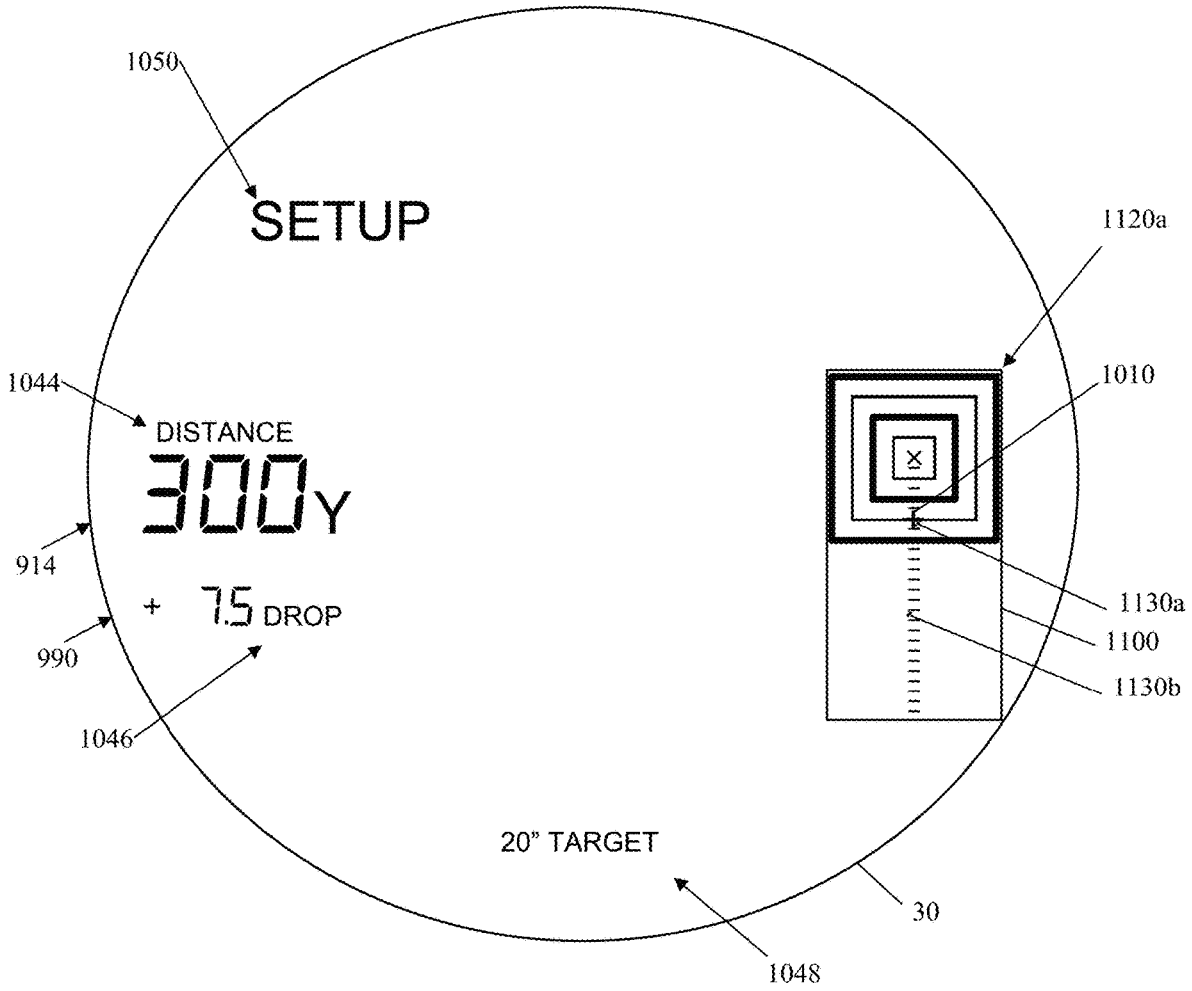

At this point, the user aims the device 10 to view the prepared relative target 1100, as shown in FIG. 19D. As shown in FIG. 20D, the user matches the visualized image of the relative target 1100 to the relative target icon 1120 shown in the display. This is done by hanging the relative target 1100 at eye level and positioning the device 10 at a distance such that the size of the relative target icon 1120 matches the visualized size of the relative target 1100 through the optics of the device 10. Each time the user hits a button, the flashing aiming point indicator 1010 moves down one location. The user moves the flashing aiming point indicator 1010 down until it visually matches the first shot mark 1130*a*. For each location, the corresponding drop amount is displayed (e.g. 7.5 inches). Note that in this embodiment the distance between the plurality of aiming point indicators 1010 corresponds to 2.5 inches, so 7.5 is the closest increment to 8 inches.

Note that in other embodiments, the plurality of aiming point indicators 1010 could be configured to correspond to 1-inch increments or 0.5 inch increments. In yet another embodiment, once the mark is visually marked to the closest increment, a fine tuning mode could be entered where each time the button is pressed the drop amount is changed by 0.5 inches.

Figure 20E:
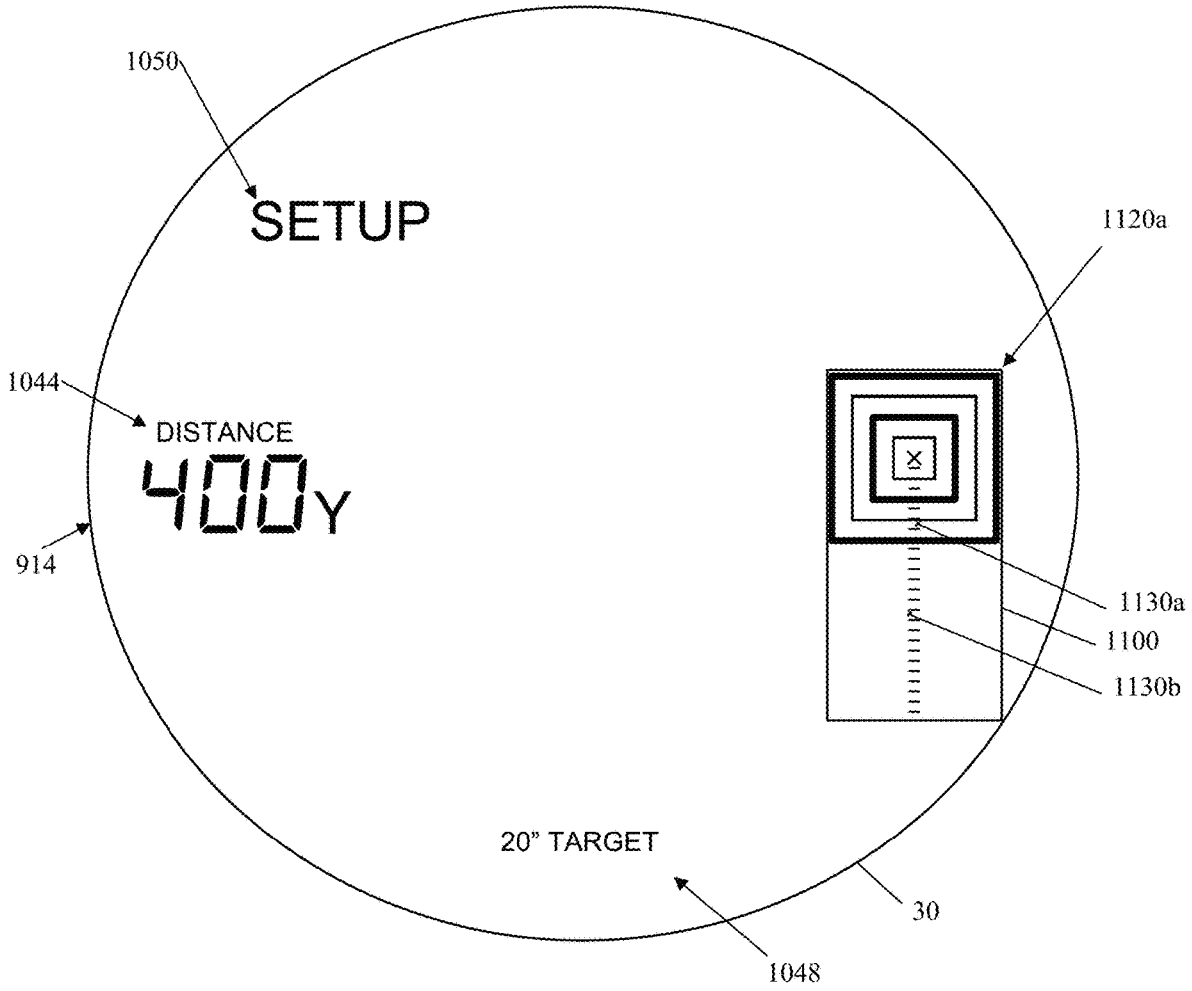

Next, after the 300-yard shot mark 1130*a* is matched and confirmed, as shown in FIG. 20E the words the word "Distance" 1044 flashes again. If 200 was selected as the Sight In distance, and 300 was selected as the first distance mark, the user can continue to sequence through 350, 400 to select the second distance mark. In this case, the user selects 400.

Figure 20F:
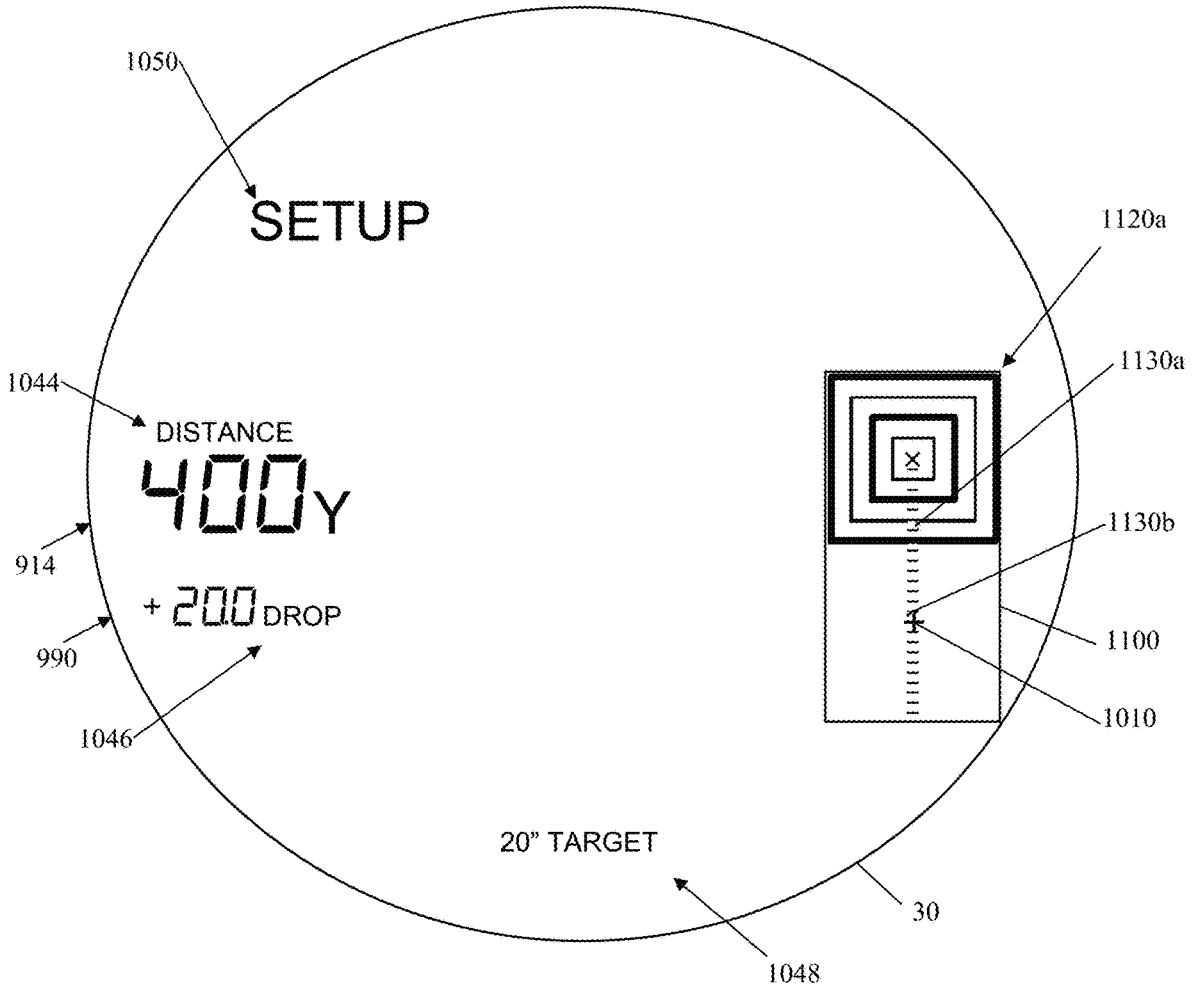

Next, after the 400-yard distance is selected and confirmed as shown in FIG. 20F, "Distance" 1044 stops flashing, and one of the aiming point indicators 1010 and the word "Drop" start to flash.

The user moves the flashing aiming point indicator 1010 down until it visually matches the second shot mark 1130*b*. At this point, the drop amount will show 20 inches (which is the closest 2.5 increment to 19 inches).

At this point, three sets of values have been entered during the configuration process: 1) the sight in or zero at distance (e.g. 200 Y), 2) the first shot mark 1130*a* distance and visual drop (e.g. 300 Y and 7.5 inches), and 3) the second shot mark 1130*b* distance and visual drop (e.g. 400 Y and 20 inches). These three points are then used with the starting coordinate of (0,0) to determine a real projectile trajectory 2 which would be generally parabolic and adjusted for the real characteristics of the specific rifle 300, specific ammunition, the user 100, and the environmental conditions such as altitude, humidity, air density, and their impact on the bullet's trajectory. This real calibration is superior to selection of a ballistic curve from a finite set of predetermined curves.

Alternative Relative Target Preparation

Figure 21A:
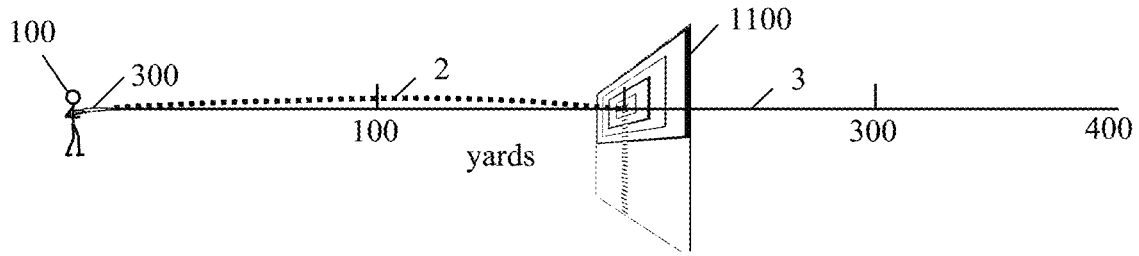

FIGS. 21A through 21D illustrate the steps of the relative target preparation process with a specific rifle and specific ammunition, where the user does not have a long shooting range or wants to calibrate using a shorter shot distance. FIG. 21A shows a user 100 shooting a rifle 300 at the relative target 1100 placed on a horizontal line of sight 3 at 200 yards. When the riflescope is zeroed at, or sighted in at, 200 yards, the bullet will hit the target center 1102 (not visible at this scale). The user 100 can shoot a bullet in the configuration shown in FIG. 21A to confirm that the rifle scope is properly sighted in or zeroed for that specific rifle 300 and that specific ammunition. The projectile trajectory 2 is shown as a dashed line. Up until this point, the process is the same as shown in FIG. 19A; however, the next step will be different.

Figure 21B:
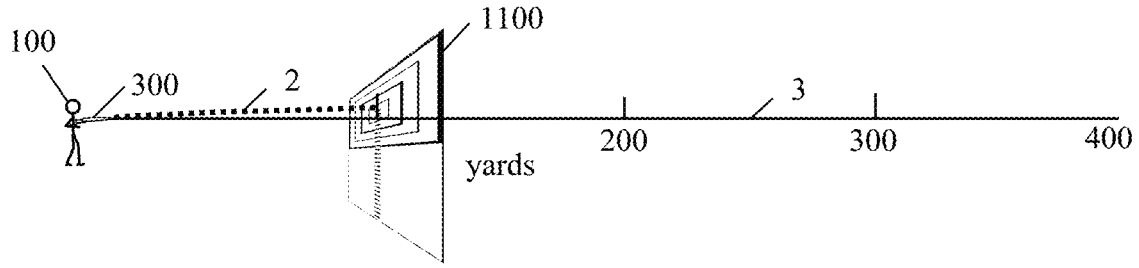

The next step, as shown in FIG. 21B is to move the relative target 1100 to 100 yards on the horizontal line of sight 3, and shoot the rifle 300 while aiming with the riflescope at the target center 1102. Unlike FIG. 19B, this is a distance shorter than the sight in distance of 200 yards. The bullet will follow the same projectile trajectory 2, but with the shorter distance will hit the relative target 1100 at a higher point, in this example, with about an negative −2.5 inch drop, where the bullet will make a first shot mark 1130*a* (see FIG. 21D).

Figure 21C:
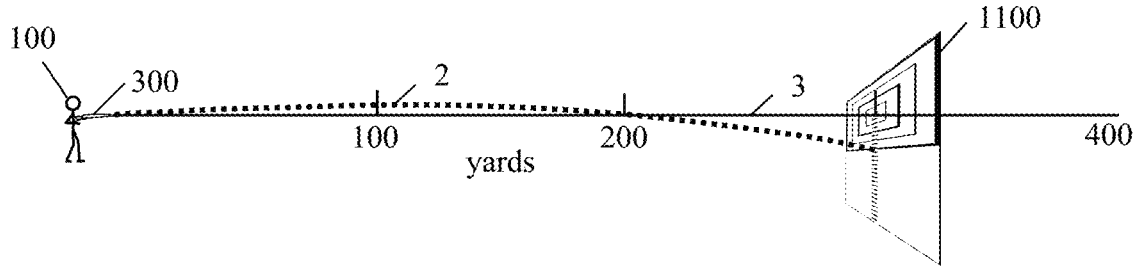

The next step, as shown in FIG. 21C is to move the relative target 1100 to 300 yards on horizontal line of sight 3, and shoot the rifle 300 while aiming with the riflescope at the target center 1102. The bullet will follow the same projectile trajectory 2, but with the longer distance will hit the target at a lower point, in this example, with about an 8 inch drop, where the bullet will make a second shot mark 1130*b* (see FIG. 21D).

Figure 21D:
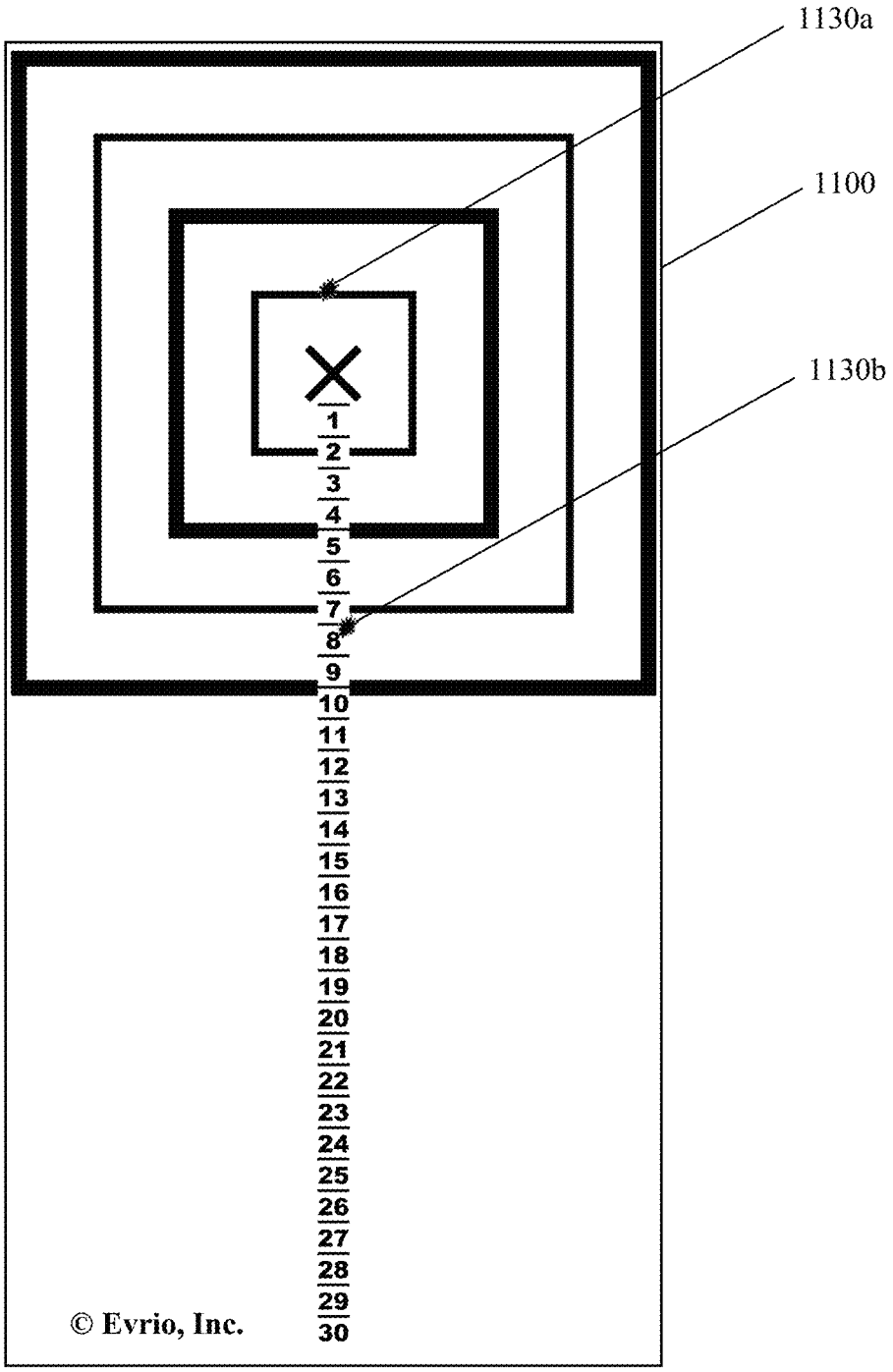

FIG. 21D illustrates the relative target 1100 showing the first shot mark 1130*a*, corresponding to the 100-yard shot, and the second shot mark 1130*b*, corresponding to the 300-yard shot.

Alternate Ballistic Calibration

FIGS. 22A through 22F show the rifle ballistic calibration process used to calibrate the device 10 to a specific rifle and specific ammunition where the relative target has been prepared with at first shot mark 1130*a* which is was shot at a distance less than the sight in distance. In these figures the display 30 corresponds to the currently preferred display element configurations as shown in FIG. 11C or FIG. 11D.

Figure 22A:
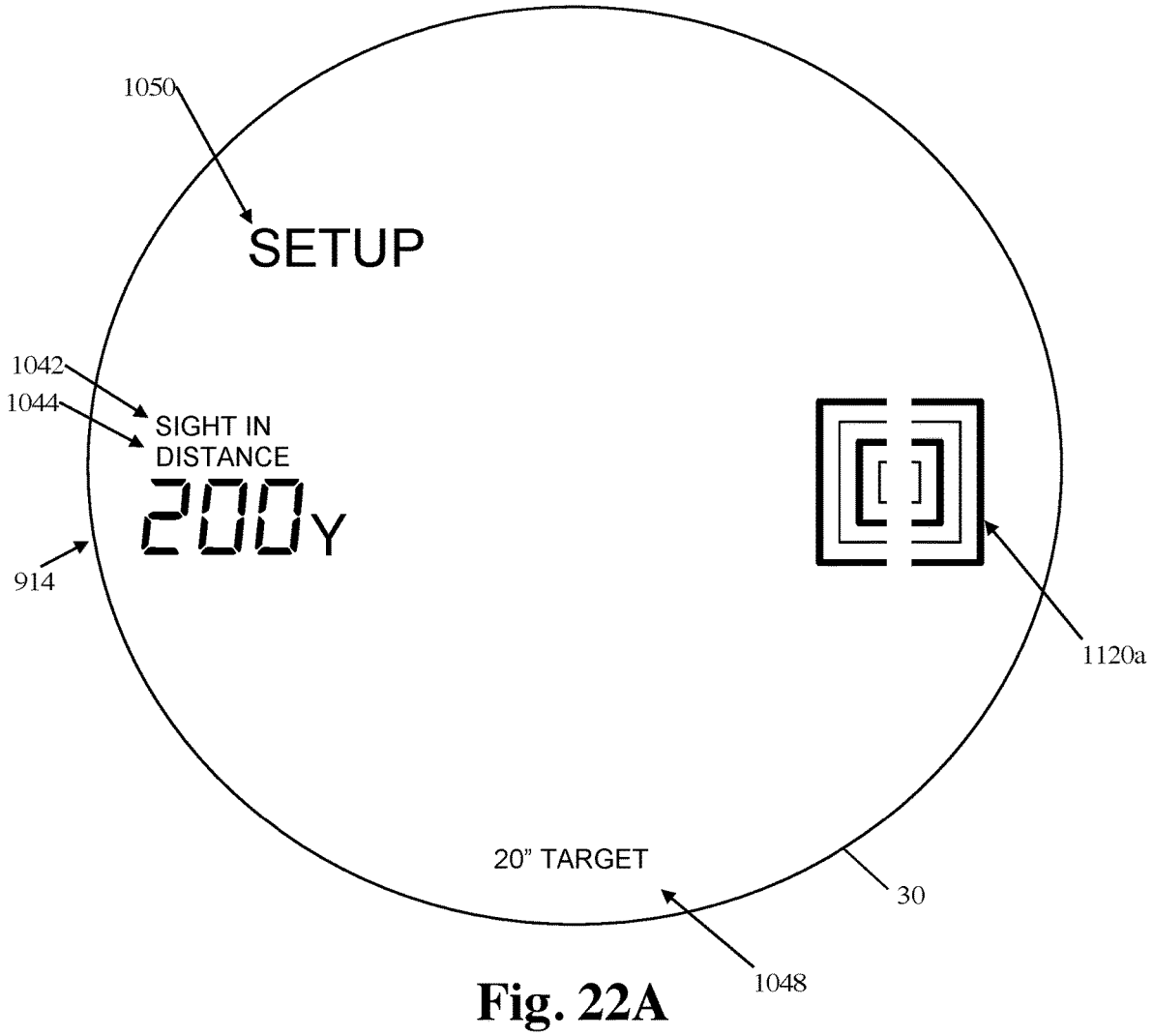

Initially, the rangefinder device 10 is put into setup mode and the yard or metric setting has been selected, in this example yard (or Imperial) mode, rifle mode has been selected, and the 20" target reference icon has been selected. As shown in FIG. 22A, setup mode is indicated by selectively illuminating the setup indicator 1050. The yard mode is indicated be selectively illuminating the "Y" as the units in the horizontal distance indicator 914. The upper relative target icon 1120*a* is illuminated, and because the device 10 is in yard mode, the '20" Target' target type indicator 1048 is illuminated.

Next, as shown in FIG. 22A, the sight in distance of 100 yards is displayed in the display 30. In the preferred embodiment, the "Sight In" indicator 1042, "Distance" text 1044, and the "50 Y" horizontal distance indicator 914 would be flashing indicating that the sight in distance is currently being set. The user can accept 50-yards or cycle through a preset sequence, such as 100, 150, 200, 250. The user selects 200 yards sight in distance.

Up to this point, the setup process is the same as with FIG. 20A.

Figure 22B:
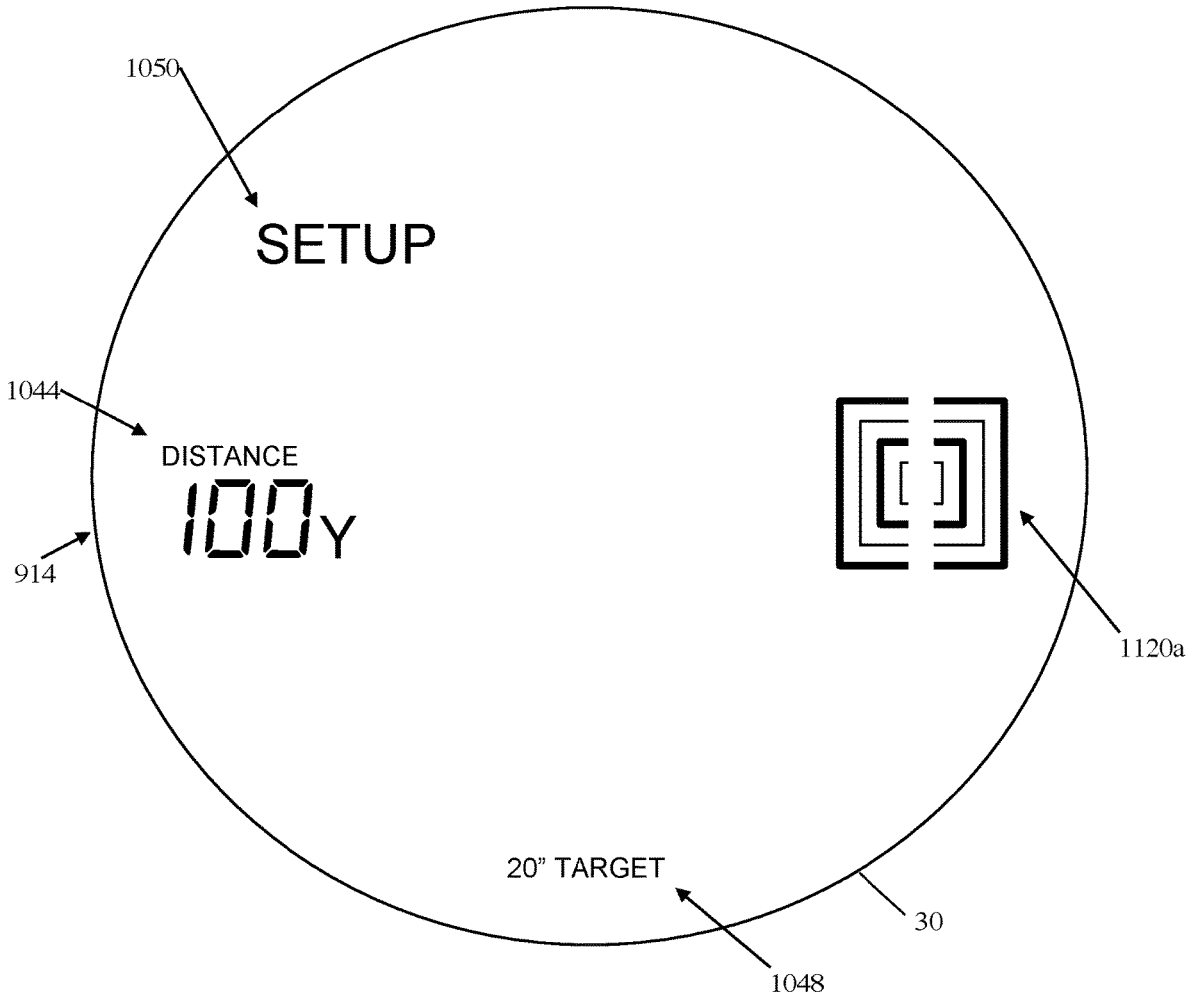

Next as shown in FIG. 22B the words "Sight In" 1042 disappear and the word "Distance" 1044 continues to flash. If 200 were selected as the Sight In distance, the user can sequence through 100, 150, 250, 300, 350, 400 to select the first distance mark. In this case the user selects 100.

Figure 22C:
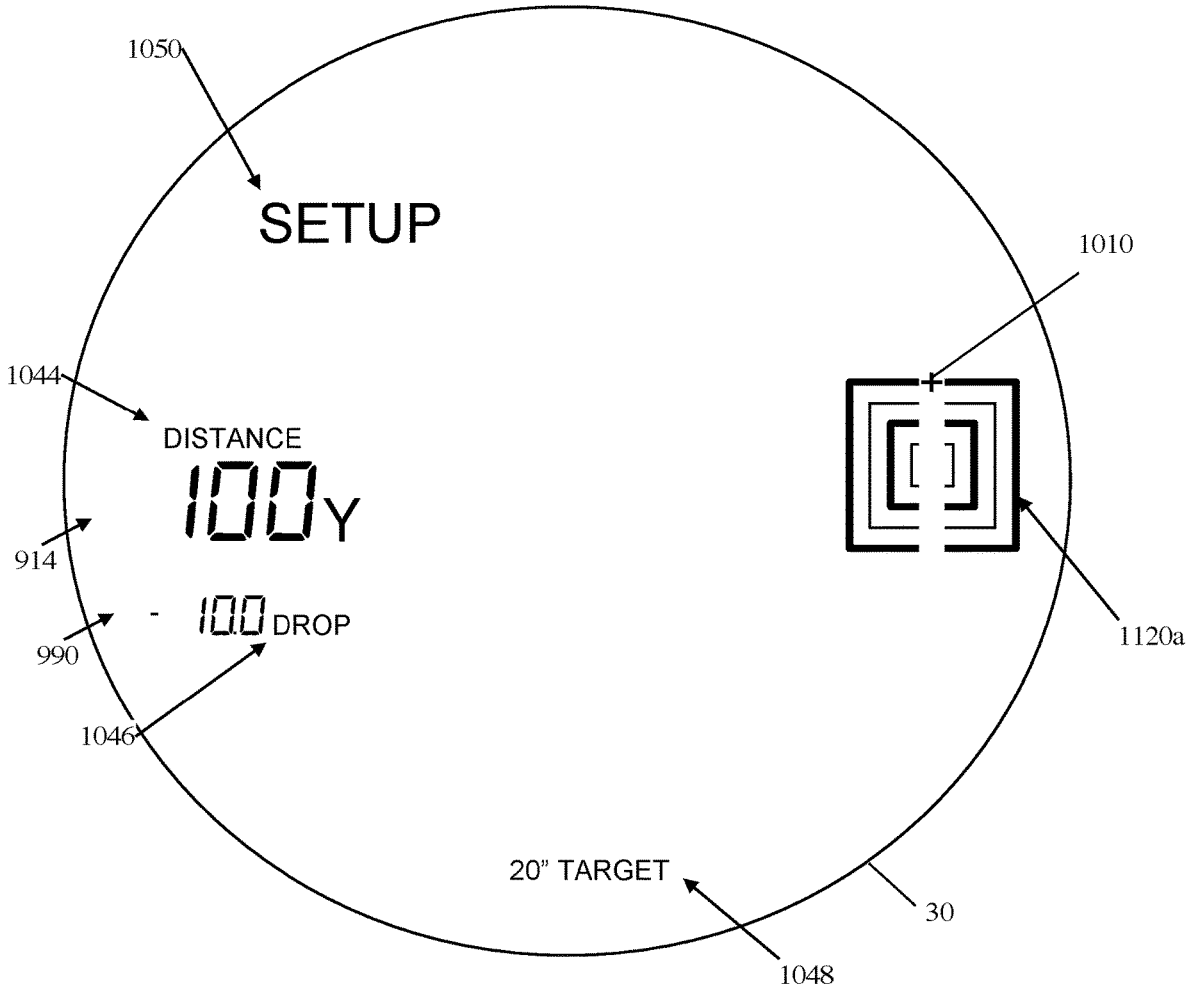

Next, after the 100-yard distance is selected and confirmed as shown in FIG. 22C, "Distance" 1044 stops flashing, and one of the aiming point indicators 1010 and the word "Drop" start to flash. In this example, because the current distance is 100 yards, which is less than the sight in distance of 200 yards, the highest one of the plurality of aiming point indicators 1010 will be flashing. As shown here the highest of aiming point indicators 1010 corresponds to a negative −10.0 in. drop.

Figure 22D:
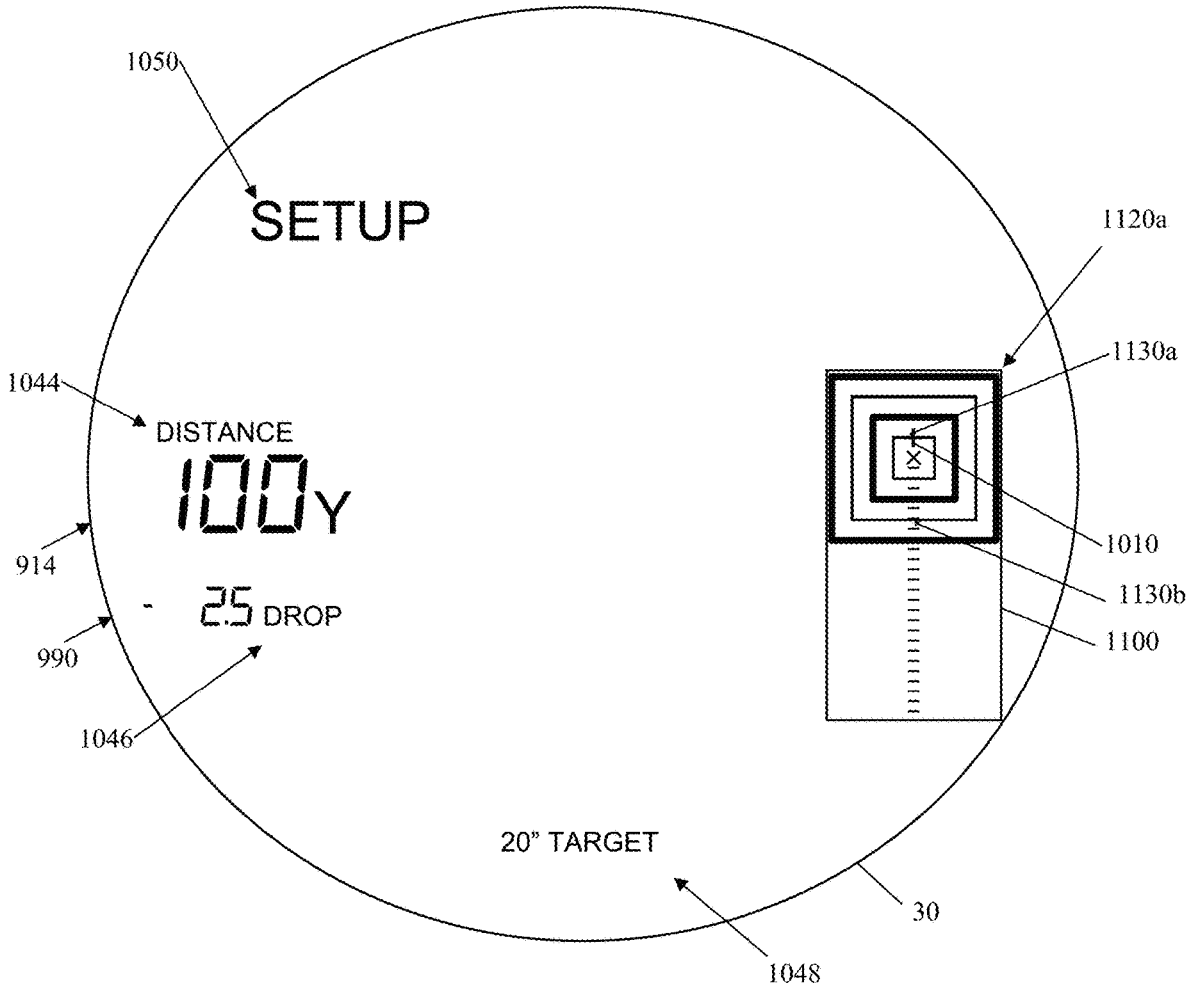

At this point, the user aims the device 10 to view the prepared relative target 1100, as shown in FIG. 21D. As shown in FIG. 22D, the user matches the visualized image of the relative target 1100 to the relative target icon 1120 shown in the display. This is done by hanging the relative target 1100 at eye level and positioning the device 10 at a distance such that the size of the relative target icon 1120 matches the visualized size of the relative target 1100 through the optics of the device 10. Each time the user hits a button, the flashing aiming point indicator 1010 moves down one location. The user moves the flashing aiming point indicator 1010 down until it visually matches the first shot mark 1130*a*. For each location, the corresponding drop amount is displayed (e.g. −2.5 inches).

Figure 22E:
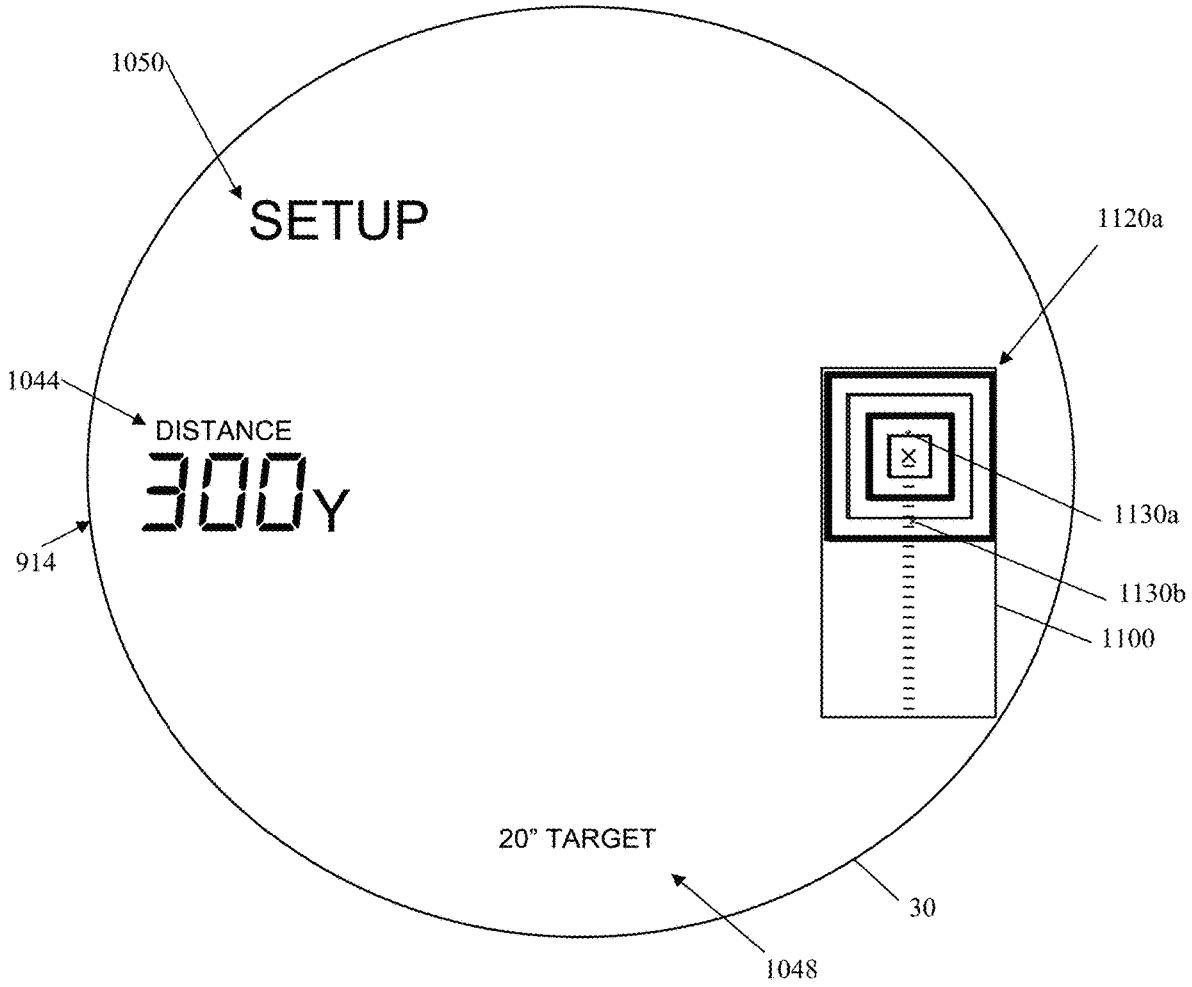

Next, after the 100-yard shot mark 1130*a* is matched and confirmed, as shown in FIG. 22E the words the word "Distance" 1044 flashes again. If 200 was selected as the Sight In distance, and 100 was selected as the first distance mark, the user can continue to sequence through 150, 300, 350, 400 to select the second distance mark. In this case, the user selects 300.

Figure 22F:
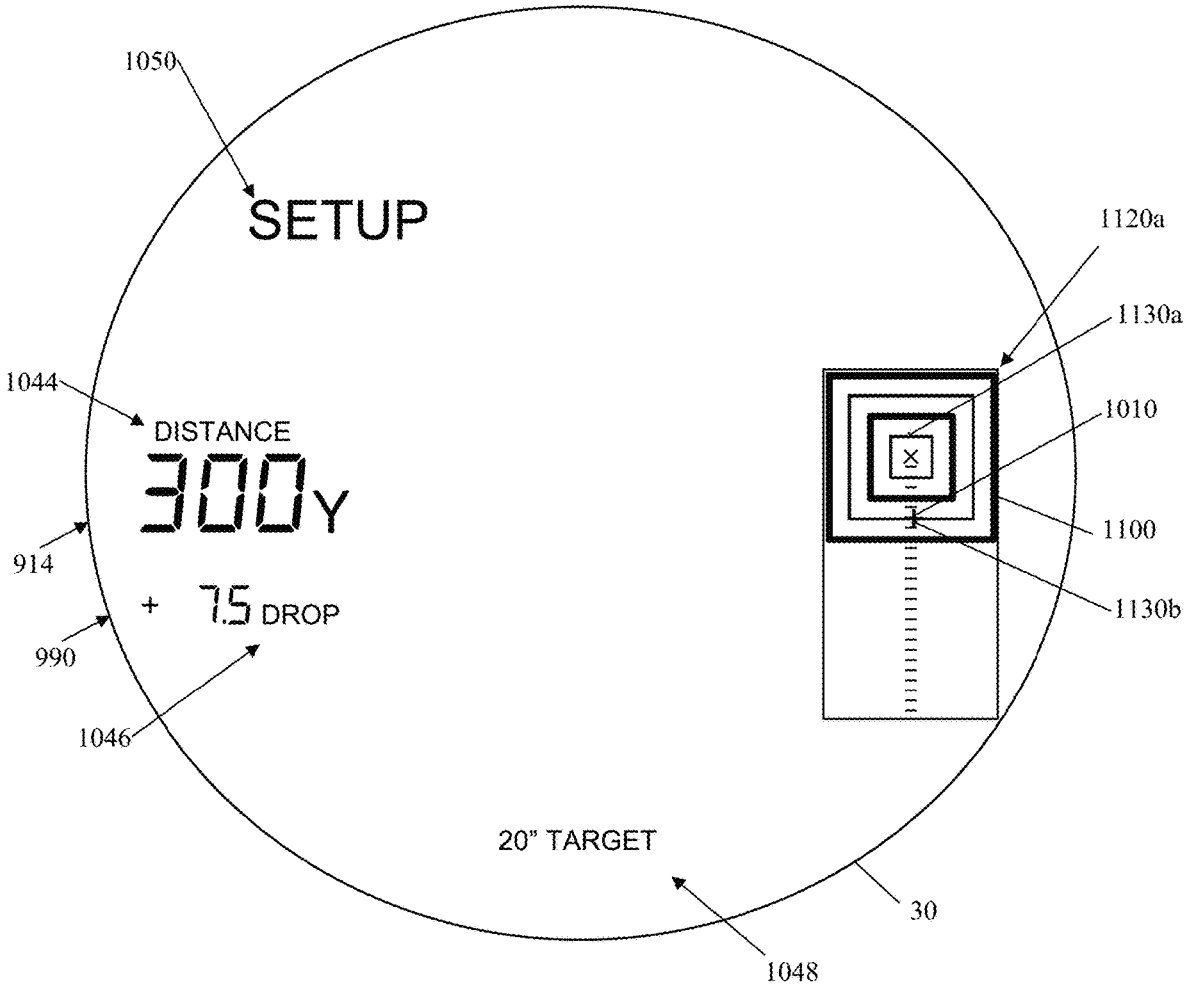

Next, after the 300-yard distance is selected and confirmed as shown in FIG. 22F, "Distance" 1044 stops flashing, and one of the aiming point indicators 1010 and the word "Drop" start to flash.

The user moves the flashing aiming point indicator 1010 down until it visually matches the second shot mark 1130*b*. At this point, the drop amount will show 7.5 inches (which is the closest 2.5 increment to 8 inches).

At this point, three sets of values have been entered during the configuration process: 1) the sight in or zero at distance (e.g. 200 Y), 2) the first shot mark 1130*a* distance and visual drop (e.g. 100 Y and −2.5 inches), and 3) the second shot mark 1130*b* distance and visual drop (e.g. 300 Y and 7.5 inches). These three points are then used with the starting coordinate of (0,0) to determine a real projectile trajectory 2 which would be generally parabolic and adjusted for the real characteristics of the specific rifle 300, specific ammunition, the user 100, and the environmental conditions such as altitude, humidity, air density, and their impact on the bullet's trajectory. This real calibration is superior to selection of a ballistic curve from a finite set of predetermined curves.

Display Interface Guidelines

The use of display 30 during the setup process examples illustrated in FIGS. 18A-18F, FIGS. 20A-20F, and FIGS. 22A-22F, respectively illustrate some guidelines for implementing the setup process. Only the relevant display elements are illuminated at any point in time. Display elements related to the data currently being set flash. For example, when the sight in distance is being set, the words "Sight In" 1042 and "Distance" 1044 flash. When the first or second shot distance is being set, the word "Sight In" 1042 is not illuminated, and only the word "Distance" 1044 flashes. When the aiming point indicator 1010 is being matched to the first or second shot mark 1130 (a or b), the selected aiming point indicator 1010 and the word "Drop" 1046 flash. The user is given a number of options that are appropriate for the current context. For example, in bow mode the ranges for sight in distance may start at 20 yards, and in rifle mode the ranges for sight in distance will be longer and start at 50 or 100 yards. After the user has some preliminary values, then the subsequent values options should start at a reasonable point in the sequence. However, the user should be able to cycle through the entire sequence and start over again.

In hybrid embodiments that support multiple modes the user could calibrate for a specific bow and arrow in bow mode setup and then calibrate for one or more specific firearm and ammunition pairs in rifle or other firearm modes. Once calibrated for multiple real ballistic curves, the user would easily be able to select one of the real ballistic curves and corresponding mode.

Operation after Calibration

As discussed in the previous sections, our novel relative target and relative target icon can be used a universal calibration method for any range finding device 10. After the range finding device 10 has been calibrated to one or more real ballistic curves, then the operation of the preferred embodiment is as described in relation to FIG. 8F and FIG. 16A.

During calibration the upper relative target icon 1120*a* of the layout of FIG. 11C (or FIG. 11D) is used. However during the normal operation the lower relative target icon 1120*b* of the layout of FIG. 11C (or FIG. 11D) is used. Having the two relative target icons 1120(*a*-*b*) allows for the plurality of aiming point indicator 1010*s* to be used for the dual purposes of calibration and for normal operation, thus reducing the total number of display elements required to implement the display 30.

Other Alternatives

In the foregoing examples, the user is able to specify the sight in distance. The setup steps could be simplified by have a default sight in distances, for example, the bow sight could default to 20 yards, and the rifle sight in distance could default to 100 yards for lower end range finding devices and 200 yards for higher end range finding devices. The design choice would simplify setup but reduce user control and flexibility.

In the foregoing examples, two shot distances and two shot marks were used to calibrate the range finding device. The ballistic curve may be slightly improved with a third or forth set of distances and drop coordinates; however, these would increase the complexity of the calibration method. For lower end rangefinder a single shot distance could be used. In some embodiments the user could choose to enter zero or more distances and drop coordinates. If zero were entered, a default standard curve would be used. If one or more coordinates were entered the additional data would be used to approximate the best estimated of the ballistic curve based on the amount of data entered.

Advantages

Faster

The clear shot technology and relative aiming point technology provides the user with visual indications that do not require mathematical calculations or adjustments. The user immediate sees and image in the rangefinder device, which is then replicated with the scope or sight on the firing device. In other words, the user stays "right brained" allowing for rapid and accurate action.

Accurate

The clear shot technology provides an accurate projective trajectory to a ranged target that takes into account the obstacles that may be in the trajectory.

The relative aiming point technology provides an accurate aiming point relative to the target size reference.

Effective

Because the clear shot technology provides an accurate projective trajectory to a ranged target that takes into account the obstacles that may be in the trajectory, the user can adjust the position of the shot to ensure that an unexpected obstacle will not interfere with the shot. Thus, the first shot will always reach its target being more effective.

The relative aiming point technology provides an accurate aiming point that can the user can intuitively match.

Confidence

The clear shot technology gives the user confidence that despite numerous obstacles that may be near a projectile trajectory that a difficult shot can be successfully taken.

The relative aiming point technology gives the user confidence that the target will be hit.

This increased confidence will improve the user's performance and satisfaction.

Adjustable

The embodiments of these displays and rangefinders can be adjusted to be consistent with an individual user and associated sights, for example the specific pins on a individual user's bow sight, and specific ammunition and scopes.

Lightweight

The enhanced features of the clear shot technology do not add weight to the convention device. Embodiments with a digital camera and a high-resolution display have lighter weight than conventional rangefinders.

Easy to Transport and Use

Devices containing the clear shot and relative aiming point technology are easy to transport and use. Embodiments with a digital camera and a high-resolution display are smaller.

Fun

Games containing displays simulating the clear shot and relative aiming point technology are fun to play and help introduce a new generation of potential sportsman to the archery and shoot sports.

CONCLUSION, RAMIFICATION, AND SCOPE

Although the invention has been described with reference to the preferred embodiments illustrated in the attached drawings, it is noted that equivalents may be employed and substitutions made herein without departing from the scope of the invention as recited in the claims.

Accordingly, the reader will see that the enhanced displays, rangefinders, and methods provide important information regarding the projectile trajectory and importantly provide greater accuracy, effectiveness, and safety.

While the above descriptions contain several specifics these should not be construed as limitations on the scope of the invention, but rather as examples of some of the preferred embodiments thereof. Many other variations are possible. For example, the display can be manufactured in different ways and/or in different shapes to increase precision, reduce material, or simplify manufacturing. Further, this technology could be applied to military situations where the projectiles is fired from a cannon, tank, ship, or aircraft and where the obstacles could be moving objects such as helicopters or warfighters. On the battlefield with three dimensional information, e.g. from satellite imaging and computer maps and charts, a computer using clear shot technology could aim an fire multiple weapons over mountains and through obstacles to continuously hit multiple targets. The variations could be used without departing from the scope and spirit of the novel features of the present invention.

Accordingly, the scope of the invention should be determined not by the illustrated embodiments, but by the appended claims and their legal equivalents.

We claim:

1. An electronic display for an electronic range finding device for indicating to a user a relative aiming point for a target, the electronic display comprising:

a) a visual image of the target and the surroundings of the target, b) a cross hairs displayed over the visual image and positioned centrally in the display, wherein the cross hairs are used to aim the range finding device, c) a relative target icon displayed over the visual image and positioned peripherally in the display, wherein the relative target icon comprises a plurality of concentric icon squares, wherein a height of each concentric square corresponds to a predetermined target height, and d) a relative aiming point displayed over the visual image and positioned centered relative to the relative target icon, wherein the relative aiming point corresponds to a sight or scope calibrated for the predetermined range, wherein, when the range finding device determines a range to the target, the relative aiming point is dynamically displayed to indicate where to aim the calibrated sight or scope.

2. The electronic display of claim 1 wherein the height of one of the plurality of concentric icon squares corresponds to 20 inches.

3. The electronic display of claim 1 wherein the heights the plurality of concentric squares icon corresponds to multiples of 5 inches.

4. The electronic display of claim 1 wherein the height of one of the plurality of concentric icon squares corresponds to 50 centimeters.

5. The electronic display of claim 1 wherein the heights the plurality of concentric icon squares corresponds to multiples of 12.5 centimeters.

6. The electronic display of claim 1 further comprising a horizontal distance indicator, wherein the range to the target is displayed when the relative aiming point is dynamically displayed.

7. The electronic display of claim 1 further comprising a reference image aligned to the position of to the relative target icon.

8. The electronic display of claim 7 wherein the reference image is one of the group of a deer reference image and an antelope reference image.

9. An electronic display for an electronic range finding device for indicating to a user a relative aiming point for a target, the electronic display comprising:

a) a visual image of the target and the surroundings of the target, b) a cross hairs displayed over the visual image and positioned centrally in the display, wherein the cross hairs is used to aim the range finding device, c) a relative target icon displayed over the visual image and positioned peripherally in the display, wherein the relative target icon comprises a plurality of concentric icon squares, wherein a height of each concentric square corresponds to a predetermined target height, d) a relative aiming point displayed over the visual image and positioned centered relative to the relative target icon, wherein the relative aiming point corresponds to a sight or scope calibrated for the predetermined range, and e) a target type indicator, wherein the target type indicator selectively displays the type of target being used as a reference from the group of a 20 inch target, a 50 cm target, a deer, an elk, and an antelope, wherein, when the range finding device determines a range to the target, the relative aiming point is dynamically displayed to indicate where to aim the calibrated sight or scope.

10. A system for indicating to a user a relative aiming point for a target, the system comprising:

a) an electronic range finding device comprising:

i) electronic display comprising:

(1) a visual image of the target and the surroundings of the target, (2) a cross hairs displayed over the visual image and positioned centrally in the display, wherein the cross hairs are used to aim the range finding device, (3) a relative target icon displayed over the visual image and positioned peripherally in the display, wherein the relative target icon comprises a plurality of concentric icon squares, wherein a height of each concentric square corresponds to a predetermined target height, (4) a relative aiming point displayed over the visual image and positioned centered relative to the relative target icon, wherein the relative aiming point corresponds to a sight or scope calibrated for the predetermined range, and (5) a horizontal distance indicator, ii) a range sensor for determining a first line of sight distance to the target, iii) a tilt sensor for determining an angle to the target, iv) at least one input, v) a lens for receiving the visual image, wherein, when the range finding device determines a range to the target, the relative aiming point is dynamically displayed to indicate where to aim the calibrated sight or scope, and the range to the target is displayed in the horizontal distance indicator, and b) a printed relative target comprising:

i) a plurality of concentric target squares, ii) a target center, and iii) a scale showing the vertical distance from the target center toward the bottom of the relative target, wherein concentric target squares of the printed relative target correspond to the concentric icon squares of the relative target icon, whereby a user can visually align the concentric target squares in the visual image with the concentric icon squares.

11. The system of claim 10 wherein the height of one concentric target square of the plurality of concentric target squares measures 20 inches, wherein the height of one concentric icon square of the plurality of concentric icon squares corresponds to 20 inches, and wherein the distance between the displayed position of relative aiming point and the center of the relative target icon corresponds to the number of inches that the calibrated sight or scope should be aimed above the target.

12. The system of claim 10 wherein the height of one concentric target square of the plurality of concentric target squares measures 50 centimeters, wherein the height of one concentric icon square of the plurality of concentric icon squares corresponds to 50 centimeters, and wherein the distance between the displayed position of relative aiming point and the center of the relative target icon corresponds to the number of centimeters that the calibrated sight or scope should be aimed above the target.

13. The system of claim 10 further comprising a method of calibrating the range finding device to a specific firing device and specific projectile, the method comprising steps of:

a) placing the relative target at a first shot distance, aiming the calibrated sight or scope, and firing the projectile making a first shot mark, b) placing the relative target at a second shot distance, aiming the calibrated sight or scope, and firing the projectile making a second shot mark, c) placing the range finding device in calibration setup mode, d) visually aligning the concentric target squares in the visual image with the concentric icon squares, e) selecting the first shot distance, f) adjusting the relative aiming point indicator to visually match the first shot mark, g) selecting the second shot distance, and h) adjusting the relative aiming point indicator to visually match the second shot mark.

14. The system of claim 13, wherein the method of calibrating the range finding device further comprises a step of selecting a zeroed at distance.

15. The system of claim 13, wherein the method of calibrating the range finding device further comprises steps of:

placing the relative target at a third shot distance, aiming the calibrated sight or scope, and firing the projectile making a third shot mark, selecting the third shot distance, and adjusting the relative aiming point indicator to visually match the third shot mark.

16. A printed relative target comprising:

i) a plurality of concentric target squares, ii) a target center, and iii) a scale showing the vertical distance from the target center toward the bottom of the relative target, wherein the scale comprises a plurality of equally spaced horizontal lines and a plurality of numbers, wherein the horizontal lines and numbers indicate the vertical distance in one of the group of inches or centimeters.

17. The printed relative target of claim 16 wherein the height of one of the plurality of concentric target squares corresponds to 20 inches, and wherein the scale is in inches.

18. The printed relative target of claim 16 wherein the heights of the plurality of concentric target squares are in multiples of 5 inches, and wherein the scale is in inches.

19. The printed relative target of claim 16 wherein a first and a third of the plurality of concentric target squares are a solid dark color and a second and a fourth of the plurality of concentric target squares is white.

20. The electronic display of claim 1 wherein the electronic display comprises a predetermined number of display segments which are superimposed over the visual image, the display segments comprising:

e) a plurality of aiming point indicators positioned centered relative to the relative target icon, wherein one of the plurality of aiming point indicators is selectively illuminated to display the relative aiming point, and f) a plurality of path indictors positioned centered relative to the cross hair, wherein one of the plurality of path indictors is selectively illuminated to display an absolute aiming point.

* * * * *